US010875308B2

(12) United States Patent
Suzuki et al.

(10) Patent No.: US 10,875,308 B2
(45) Date of Patent: Dec. 29, 2020

(54) LIQUID DROPLET EJECTING APPARATUS AND MAINTENANCE METHOD FOR LIQUID DROPLET EJECTING APPARATUS

(71) Applicant: SEIKO EPSON CORPORATION, Tokyo (JP)

(72) Inventors: Kazunaga Suzuki, Azumino (JP); Tsuyoshi Hayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/550,824

(22) Filed: Aug. 26, 2019

(65) Prior Publication Data

US 2020/0070499 A1 Mar. 5, 2020

(30) Foreign Application Priority Data

Aug. 29, 2018 (JP) ..... 2018-160036

(51) Int. Cl.
*B41J 2/165* (2006.01)
*B41J 2/045* (2006.01)

(52) U.S. Cl.
CPC ..... *B41J 2/16505* (2013.01); *B41J 2/0451* (2013.01); *B41J 2/04581* (2013.01)

(58) Field of Classification Search
CPC .. B41J 2/16505; B41J 2/04581; B41J 2/0451; B41J 2/165; B41J 2/16535; B41J 2/16544; B41J 2/16508; B41J 2/16526; B41J 2/16517
See application file for complete search history.

(56) References Cited

U.S. PATENT DOCUMENTS 6,467,873 B1 * 10/2002 Toba ..... B41J 2/16538 347/33
2004/0135842 A1 * 7/2004 Saksa ..... B41J 2/16535 347/33
2005/0122360 A1 6/2005 Sakagami et al.
2007/0257956 A1 11/2007 Akase et al.
2009/0174735 A1 * 7/2009 Yamada ..... B41J 2/17509 347/7
2011/0285775 A1 11/2011 Shinkawa
(Continued)

FOREIGN PATENT DOCUMENTS

JP 2003-039701 A 2/2003
JP 2004-276273 A 10/2004
JP 2007-136772 A 6/2007
(Continued)

*Primary Examiner* — Justin Seo
(74) *Attorney, Agent, or Firm* — Workman Nydegger

(57) ABSTRACT

A liquid droplet ejecting apparatus includes a liquid droplet ejecting portion that includes a plurality of nozzles ejecting liquids as liquid droplets, a cap configured to be in a capping state in which a space in which the plurality of nozzles are open is formed, a detection portion configured to detect an abnormality of an ejecting state of the liquid droplets from the nozzles, and a control portion that estimates that a malfunction of the cap causes the abnormality of the ejecting state when the abnormality of the ejecting state occurs in the capping state, in which the control portion causes a notification portion to perform a display corresponding to the malfunction of the cap when the control portion estimates that the malfunction of the cap causes the abnormality of the ejecting state.

9 Claims, 25 Drawing Sheets

(56) References Cited

U.S. PATENT DOCUMENTS

2016/0167364 A1 6/2016 Matsumoto et al.

FOREIGN PATENT DOCUMENTS

| | | | |
|---|---|---|---|
| JP | 2008-044337 | A | 2/2008 |
| JP | 2011-240564 | A | 12/2011 |
| JP | 2014-094449 | A | 5/2014 |
| JP | 2016-112713 | A | 6/2016 |

* cited by examiner

LIQUID DROPLET EJECTING APPARATUS AND MAINTENANCE METHOD FOR LIQUID DROPLET EJECTING APPARATUS

The present application is based on, and claims priority from JP Application Serial Number 2018-160036, filed Aug. 29, 2018, the disclosure of which is hereby incorporated by reference herein in its entirety.

BACKGROUND

1. Technical Field

The present disclosure relates to a liquid droplet ejecting apparatus such as an ink jet type printer and a maintenance method for a liquid droplet ejecting apparatus.

2. Related Art

JP-A-2003-39701 describes a printer including a head ejecting an ink which is a kind of a liquid as a liquid droplet, a cap capping the head. Thickening of the liquid in the nozzle is suppressed by the cap capping the head.

In the printer, even if the cap caps the head, the liquid in the nozzle is thickened. If the liquid may be thickened, a liquid droplet cannot be ejected favorably from the nozzle.

SUMMARY

According to an aspect of the present disclosure, there is provided a liquid droplet ejecting apparatus including: a liquid droplet ejecting portion that includes a plurality of nozzles ejecting liquids as liquid droplets; a cap configured to be in a capping state in which a space in which the plurality of nozzles are open is formed and a non-capping state in which the cap is separated from the liquid droplet ejecting portion; a detection portion configured to detect an abnormality of an ejecting state of the liquid droplets from the nozzles; and a control portion that estimates that a malfunction of the cap causes the abnormality of the ejecting state when the abnormality of the ejecting state occurs in the capping state, in which the control portion causes a notification portion to perform a display corresponding to the malfunction of the cap when the control portion estimates that the malfunction of the cap causes the abnormality of the ejecting state.

According to another aspect of the present disclosure, there is provided a maintenance method for a liquid droplet ejecting apparatus which includes a liquid droplet ejecting portion including a plurality of nozzles ejecting liquids as liquid droplets, a cap configured to be in a capping state in which a space in which the plurality of nozzles are open is formed and a non-capping state in which the cap is separated from the liquid droplet ejecting portion, and a detection portion configured to detect an abnormality of an ejecting state of the liquid droplets from the nozzles, the method including: estimating that a malfunction of the cap causes the abnormality of the ejecting state when the abnormality of the ejecting state occurs in the capping state, and causing a notification portion to perform a display corresponding to the malfunction of the cap.

DESCRIPTION OF EXEMPLARY EMBODIMENTS

Hereinafter, an embodiment of a liquid droplet ejecting apparatus will be described with reference to the drawings. The liquid droplet ejecting apparatus of the present embodiment is an ink jet printer that prints an image such as a character and a photograph on a medium such as recording paper by ejecting an ink that is an example of a liquid.

Figure 1:
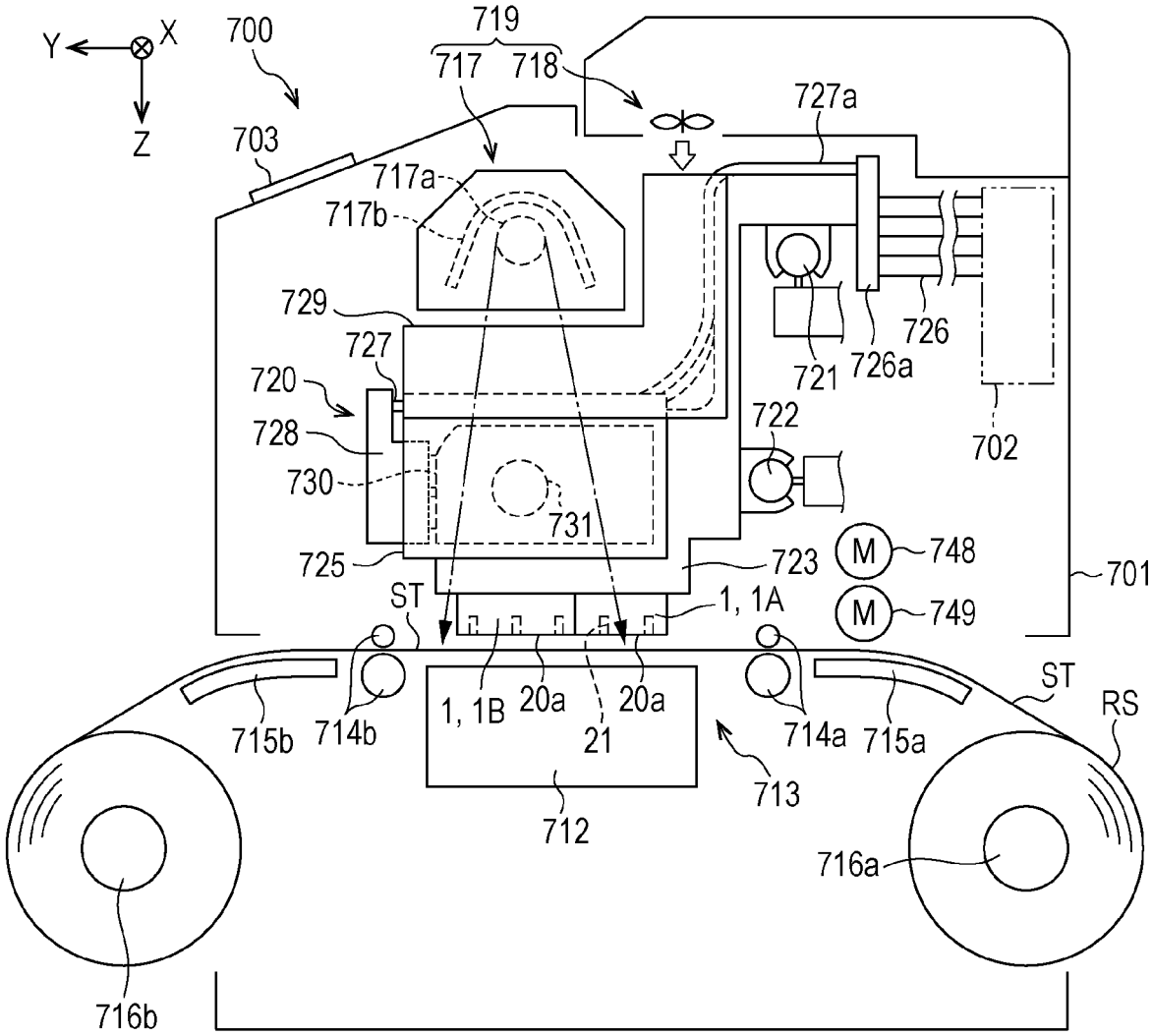
FIG. 1 is a schematic diagram illustrating an embodiment of a liquid droplet ejecting apparatus.

As illustrated in FIG. 1, a liquid droplet ejecting apparatus 700 includes a housing 701, a support table 712, a transporting unit 713, a drying unit 719, a printing unit 720, a guide shaft 721, a guide shaft 722. The housing 701 accommodates components such as the support table 712, the drying unit 719, and the printing unit 720. The support table 712, the guide shaft 721, and the guide shaft 722 extend in an X-axis direction which is a width direction of a medium ST.

The liquid droplet ejecting apparatus 700 according to the present embodiment includes a notification portion 703 configured to display an operation state of the liquid droplet ejecting apparatus 700. The notification portion 703 notifies a user of the operation state of the liquid droplet ejecting apparatus 700 by displaying the operation of the liquid droplet ejecting apparatus 700. The notification portion 703 according to the present embodiment is attached to the housing 701. The notification portion 703 may be configured to enable a user to operate the liquid droplet ejecting apparatus 700 via a screen displaying the operation state. For example, the notification portion 703 is configured to include a display screen for displaying information and a button for operation.

The support table 712 supports the medium ST. The transporting unit 713 transports the sheet-like medium ST. The printing unit 720 performs printing on the medium ST using the liquid. The printing unit 720 ejects a liquid droplet toward the medium ST being transported at a printing position set on the support table 712. A Y-axis direction is a transport direction of the medium ST at the printing position. The drying unit 719 promotes drying of the liquid attached onto medium ST. The X-axis and the Y-axis intersect with a Z-axis. The Z-axis direction of the present embodiment is a direction of gravity and is a direction of ejecting of liquid.

The transporting unit 713 of the present embodiment includes a pair of transporting rollers 714*a*, a guide plate 715*a*, and a supply reel 716*a* which are disposed at the upstream of the support table 712 in the transporting direction. The transporting unit 713 of the present embodiment includes a pair of transporting rollers 714*b*, a guide plate 715*b*, and a winding reel 716*b* which are disposed at the downstream of the support table 712 in the transporting direction. The transporting unit 713 includes a transporting motor 749 that rotates the pair of transporting rollers 714*a* and the pair of transporting rollers 714*b*.

In the present embodiment, the medium ST is drawn out from a roll sheet RS wound on a roll on the supply reel 716*a*. When the pair of transporting rollers 714*a* and the pair of transporting rollers 714*b* rotate with the medium ST interposed therebetween, the medium ST is transported along the surfaces of the guide plate 715*a*, the support table 712, and the guide plate 715*b*. The printed medium ST is wound on the winding reel 716*b*. The medium ST is not limited to the medium ST drawn out from the roll sheet RS, and may be a single sheet medium ST.

The printing unit 720 of the present embodiment includes a carriage 723 and a carriage motor 748. The carriage 723 is supported by the guide shaft 721 and the guide shaft 722. Driven by the carriage motor 748, the carriage 723 reciprocates above the support table 712 along the guide shaft 721 and the guide shaft 722.

The liquid droplet ejecting apparatus 700 includes a plurality of supply tubes 726 deformable as the supply tubes 726 follow the carriage 723 being reciprocating and a connection portion 726*a* attached to the carriage 723. An upstream end of the supply tube 726 is coupled to the liquid supply source 702. A downstream end of the supply tube 726 is coupled to the connection portion 726*a*. The liquid supply source 702 may be a tank that can be replenished with the liquid, or a cartridge detachable from the housing 701.

The printing unit 720 includes the liquid droplet ejecting portion 1 having a plurality of nozzles 21 that eject the liquid as the liquid droplet. The liquid droplet ejecting portion 1 is held by the carriage 723. In the present embodiment, two liquid droplet ejecting portions 1 are provided. Therefore, in the present embodiment, the respective two liquid droplet ejecting portions 1 are referred to as a liquid droplet ejecting portion 1A and a liquid droplet ejecting portion 1B.

The printing unit 720 includes a liquid supply path 727, a storage portion 730, a storage portion holder 725 that holds the storage portion 730, and a flow path adapter 728 coupled to the storage portion 730, as constituent elements held by the carriage 723. The liquid droplet ejecting portion 1A and the liquid droplet ejecting portion 1B are held at the lower portion of the carriage 723. The storage portion 730 is held above the carriage 723. The liquid supply path 727 supplies the liquid supplied from the liquid supply source 702 to the liquid droplet ejecting portions 1A and 1B.

The storage portion 730 temporarily stores the liquid between the liquid supply path 727 and the liquid droplet ejecting portion 1. The storage portion 730 is provided for at least each kind of the liquid. The liquid droplet ejecting apparatus 700 may include a plurality of storage portions 730. When the plurality of storage portions 730 store different kinds of color ink, it is possible to perform color printing.

Examples of ink colors include cyan, magenta, yellow, black, white and the like. Color printing may be performed using four colors of cyan, magenta, yellow, and black, or may be performed using three colors of cyan, magenta, and yellow. Furthermore, at least one of light cyan, light magenta, light yellow, orange, green, gray and the like may be added to three colors of cyan, magenta and yellow to perform the color printing. Each ink may contain a preservative.

The white ink can be used for background printing before performing color printing when printing on a medium ST which is a transparent or translucent film or a dark color medium ST. The background printing may also be referred to as a solid printing or a completely covering printing.

The storage portion 730 has a differential pressure valve 731. The differential pressure valve 731 is so-called a pressure reducing valve. That is, the differential pressure valve 731 opens when a liquid pressure between the differential pressure valve 731 and the liquid droplet ejecting portion 1 is lower than the predetermined negative pressure lower than an atmospheric pressure by the liquid being consumed by the liquid droplet ejecting portion 1. At this time, the differential pressure valve 731 allows the liquid to flow from the storage portion 730 to the liquid droplet ejecting portion 1.

The differential pressure valve 731 is closed when the liquid pressure between the differential pressure valve 731 and the liquid droplet ejecting portion 1 returns to the predetermined negative pressure by the liquid flowing from the storage portion 730 to the liquid droplet ejecting portion 1. At this time, the differential pressure valve 731 stops the flow of the liquid from the storage portion 730 to the liquid droplet ejecting portion 1. The differential pressure valve 731 does not open even when the liquid pressure between the differential pressure valve 731 and the liquid droplet ejecting portion 1 becomes high. Therefore, the differential pressure valve 731 functions as a one-way valve, or a so-called check valve, which allows the liquid to flow from the storage portion 730 to the liquid droplet ejecting portion 1 and suppresses the flow of the liquid from the liquid droplet ejecting portion 1 to the storage portion 730.

The liquid supply path 727 includes a supply tube 727*a* of which the upstream end is coupled to the connection portion 726*a*. A downstream end of the supply tube 727*a* is coupled to the flow path adapter 728 at a position higher than the storage portion 730. The liquid sequentially passes through the supply tube 726, the supply tube 727*a* and the flow path adapter 728 and is supplied to the storage portion 730.

The drying unit 719 of the present embodiment includes a heat generating mechanism 717 and a blower mechanism 718. The heat generating mechanism 717 is positioned above the carriage 723. When the carriage 723 reciprocates between the heat generating mechanism 717 and the support table 712, the liquid droplet ejecting portion 1 ejects the liquid droplet onto the medium ST stopped on the support table 712.

The heat generating mechanism 717 includes a heat generating member 717*a* and a reflecting plate 717*b* which extend in the X-axis direction. The heat generating member 717*a* is, for example, an infrared heater. The heat generating mechanism 717 emits radiant heat such as heat of an infrared ray from the heat generating member 717*a*, and heats the medium ST in the area indicated by the one-dot chain line arrow in FIG. 1. The blower mechanism 718 blows air to the area heated by the heat generating mechanism 717 to promote the drying of the medium ST.

The carriage 723 may include a heat shield member 729 for shielding heat transfer from the heat generating mechanism 717 between the storage portion 730 and the heat generating mechanism 717. The heat shield member 729 is formed of a metal material with a good thermal conductivity such as stainless steel and aluminum, for example. It is preferable that the heat shield member 729 covers at least an upper surface of the storage portion 730.

Figure 2:
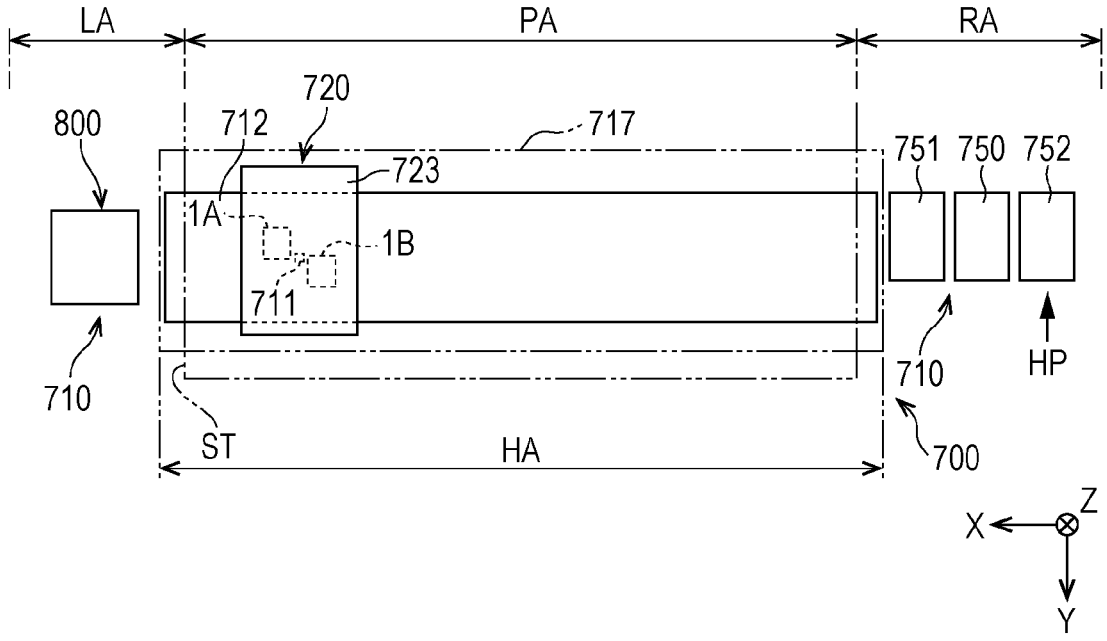
FIG. 2 is a plan view illustrating an arrangement of constituent elements of the liquid droplet ejecting apparatus in FIG. 1.

As illustrated in FIG. 2, the liquid droplet ejecting portions 1A and 1B are arranged under the carriage 723 so as to be separated from each other by a predetermined distance in the X-axis direction and to be shifted by a predetermined distance in the Y-axis direction. The carriage 723 holds a temperature sensor 711 at a position between the liquid droplet ejecting portions 1A and 1B in the X-axis direction.

The movement area in which the liquid droplet ejecting portions 1A and 1B are movable in the X-axis direction includes a print area PA in which printing is performed on the medium ST, and non-printing areas RA and LA outside the printing area PA. The non-printing areas RA and LA are positioned on both outer sides of the printing area PA in the X-axis direction. The printing area PA is an area where the liquid droplet ejecting portions 1A and 1B can eject the liquid droplet onto the medium ST having the maximum width. When the printing unit 720 includes a borderless printing function, the printing area PA is an area which is slightly broader in the X-axis direction than the medium ST having the maximum width. The heating area HA in which the heat generating mechanism 717 heats the medium ST overlaps the printing area PA.

The liquid droplet ejecting apparatus 700 includes a maintenance unit 710 for performing maintenance of the liquid droplet ejecting portion 1. The maintenance unit 710 has a cap device 800 in the non-printing area LA. The maintenance unit 710 has a wiping mechanism 750, a liquid receiving mechanism 751, and a cap mechanism 752 in the non-printing area RA. A home position HP of the liquid droplet ejecting portion 1 is positioned above the cap mechanism 752. The home position HP is a starting point of the movement of the liquid droplet ejecting portion 1.

Regarding Configuration of Head Unit

Next, the configuration of a head unit 2 will be described.

One liquid droplet ejecting portion 1 has a plurality of head units 2. The liquid droplet ejecting portion 1 of the present embodiment has four head units 2. The head unit 2 is provided for each kind of the liquid.

Figure 3:
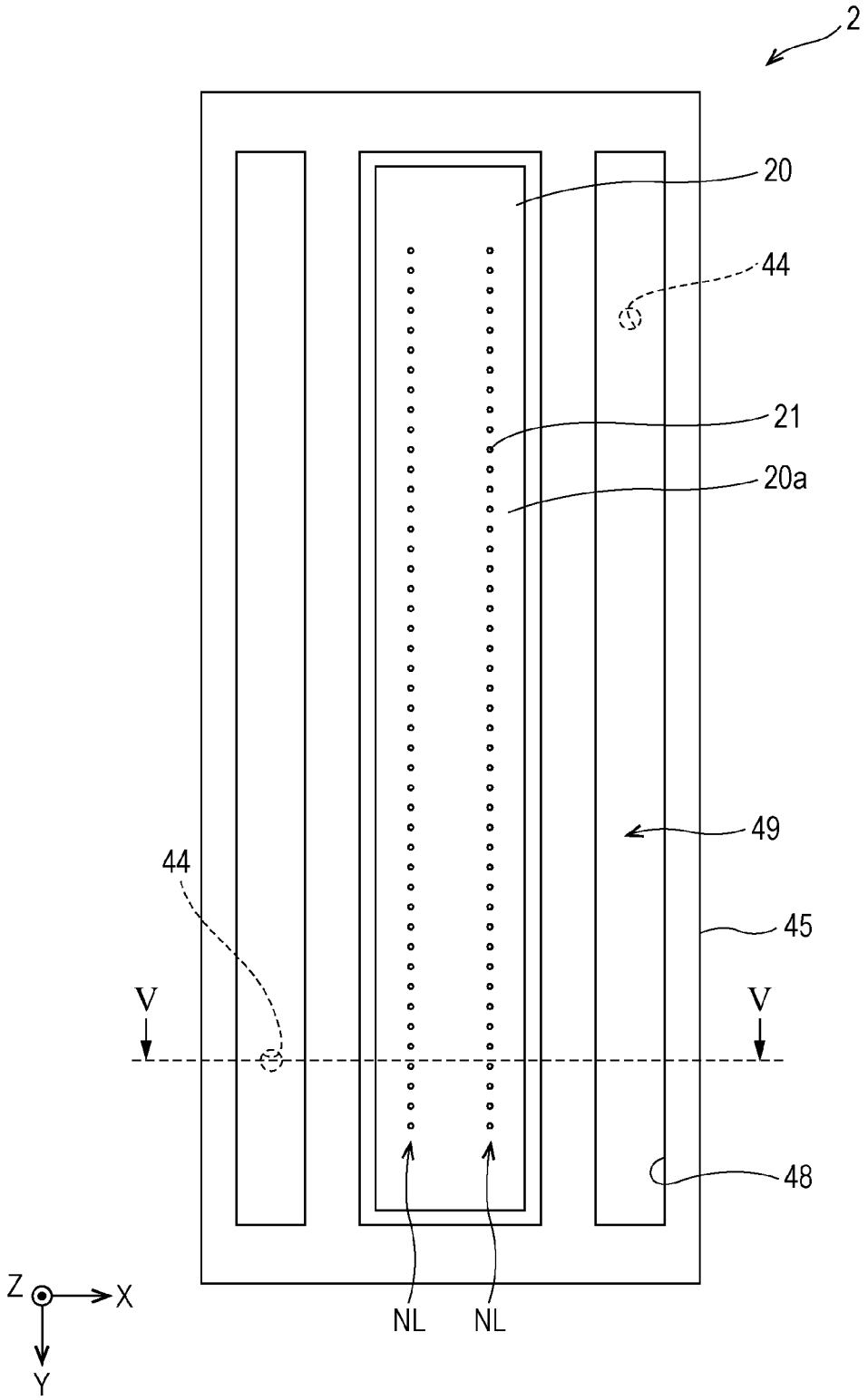
FIG. 3 is a bottom view of a head unit of the liquid droplet ejecting apparatus in FIG. 1.

As illustrated in FIG. 3, in one head unit 2, a large number of openings of the nozzles 21 for ejecting the liquid droplets are arranged at regular intervals in one direction. In the present embodiment, the openings of the nozzles 21 are arranged in the Y-axis direction. The nozzles 21 arranged in one direction configure a nozzle row NL. The nozzle row NL is configured of, for example, 180 nozzles 21. In the present embodiment, two nozzle rows NL arranged in the X-axis direction are provided in one liquid droplet ejecting portion 1. In the present embodiment, the two nozzle rows NL arranged close to each other are called a nozzle group.

In one liquid droplet ejecting portion 1, four nozzle groups are arranged at regular intervals in the X-axis direction. Therefore, one liquid droplet ejecting portion 1 is provided with a total of eight nozzle rows NL. In two liquid droplet ejecting portions 1, the positions in the Y-axis direction are adjusted such that the nozzles 21 at the extreme ends of the respective nozzle rows NL are arranged at the same intervals as those of the nozzles 21 constituting one nozzle row NL when the positions of the nozzles 21 are projected in the X-axis direction.

Figure 4:
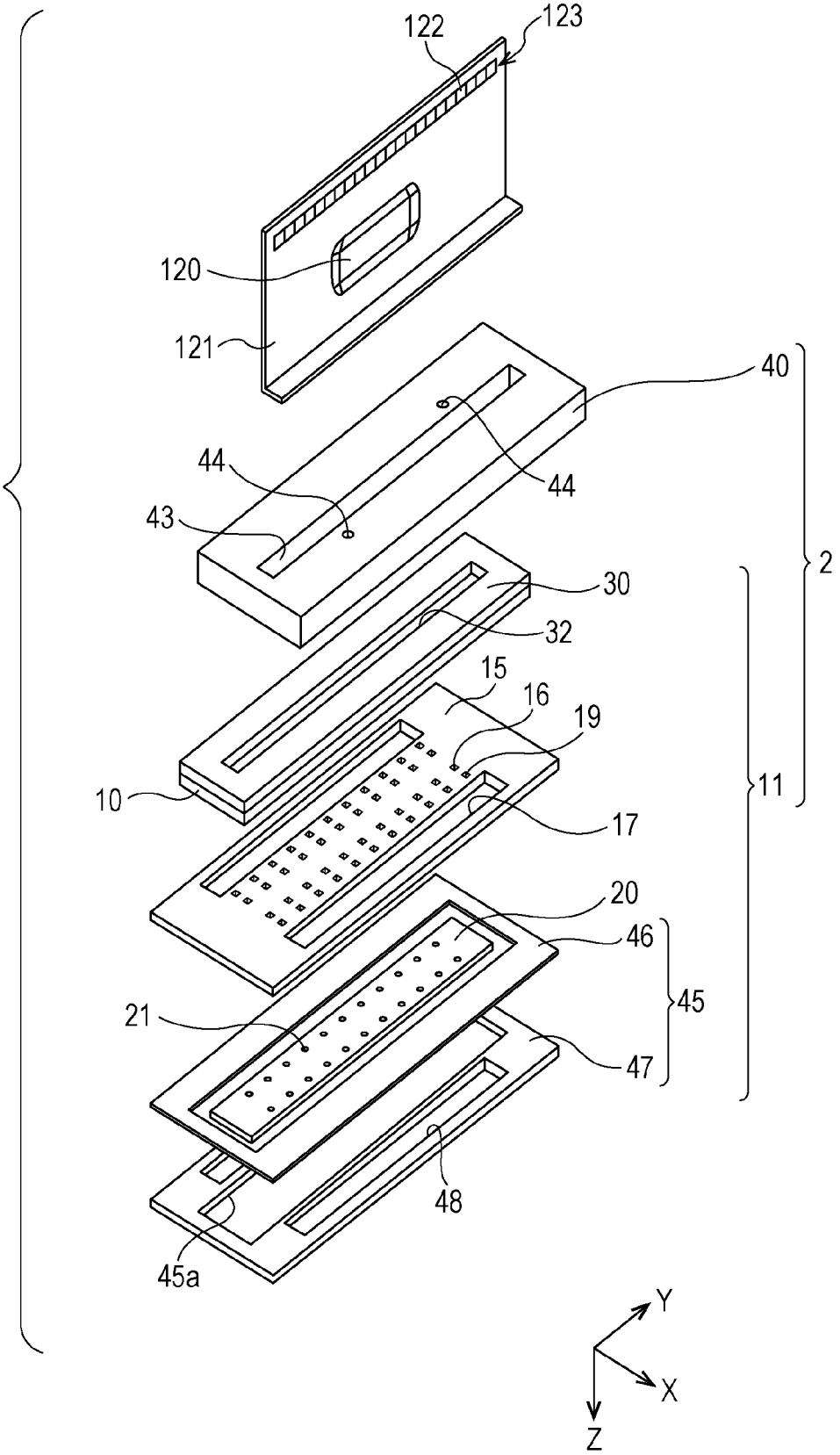
FIG. 4 is an exploded perspective view of the head unit in FIG. 3.

As illustrated in FIG. 4, the head unit 2 includes a head main body 11 and a flow path forming member 40 fixed to an upper surface side of the head main body 11. The head main body 11 includes a protective substrate 30, a flow path forming substrate 10, a communicating plate 15, a nozzle plate 20, and a compliance substrate 45 stacked in order from the side close to the flow path forming member 40. The communicating plate 15 is provided on a lower surface side of the flow path forming substrate 10. The protective substrate 30 is provided on an upper surface side of the flow path forming substrate 10. The nozzle plate 20 is provided on a lower surface side of the communicating plate 15. The compliance substrate 45 is provided on the lower surface side of the communicating plate 15, that is, a surface side on which the nozzle plate 20 is provided.

In order to configure the flow path forming substrate 10, a metal such as stainless steel and nickel, a ceramic material typified by $ZrO_2$ or $Al_2O_3$, a glass ceramic material, an oxide such as MgO and $LaAlO_3$ can be used. In the present embodiment, the flow path forming substrate 10 is formed of a silicon single crystal substrate.

Figure 5:
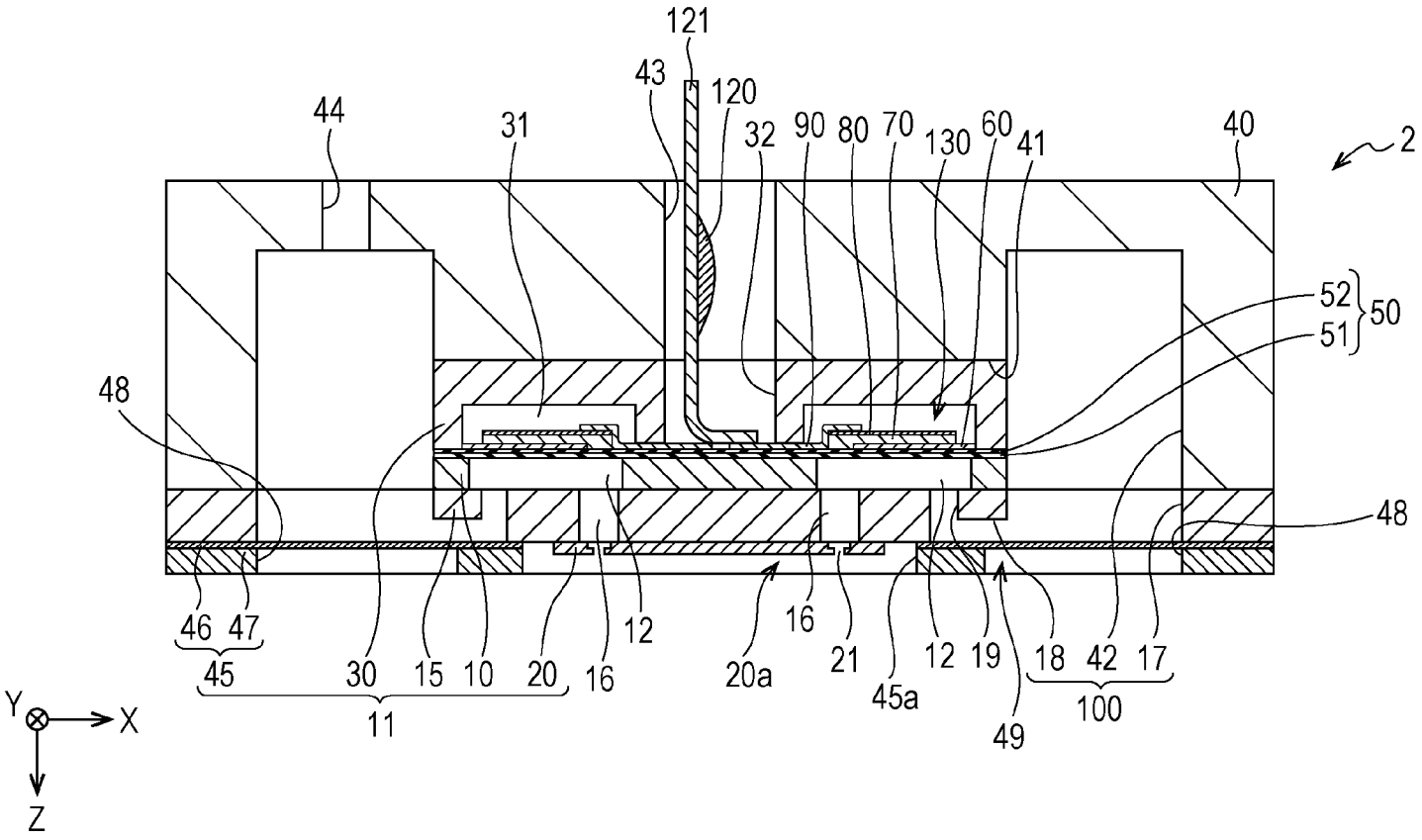
FIG. 5 is a sectional view taken along line V-V in FIG. 3.

As illustrated in FIG. 5, in the flow path forming substrate 10, a plurality of pressure chambers 12 partitioned by partition walls are formed. The pressure chamber 12 is disposed above the nozzle 21. On the flow path forming substrate 10, a supply path or the like, which has an opening area smaller than that of the pressure chamber 12, for providing a flow path resistance of the liquid flowing into the pressure chamber 12 may be provided at one end portion of the pressure chamber 12 in the Y-axis direction.

The nozzle plate 20 includes holes forming the nozzles 21. The downstream end of the nozzle 21 is open on a nozzle surface 20*a* which is a lower surface of the nozzle plate 20.

The communicating plate 15 is provided with a nozzle communicating path 16 which connecting the pressure chamber 12 and the nozzle 21. The communication plate 15 is provided such that the planar area becomes larger than that of the flow path forming substrate 10. The nozzle plate 20 is provided so as to have a planar area smaller than that of the flow path forming substrate 10. The distance between the nozzle 21 of the nozzle plate 20 and the pressure chamber 12 is increased by providing the communication plate 15 therebetween. Therefore, the liquid in the pressure chamber 12 can be prevented from being thickened by the evaporation of the moisture from the nozzle 21. Since the nozzle plate 20 only has to cover the opening of the nozzle communicating path 16 that connects the pressure chamber 12 and the nozzle 21, it is possible to make the area of the nozzle plate 20 relatively small and to reduce cost.

A first manifold portion 17 and a second manifold portion 18 configuring a common liquid chamber 100 are provided in the communicating plate 15. The first manifold portion 17 penetrates the communicating plate 15 in the thickness direction. The thickness direction is, for example, the Z-axis direction which is a stacking direction of the communicating plate 15 and the flow path forming substrate 10. The second manifold portion 18 is open to the nozzle plate 20 side of the communicating plate 15 without penetrating the communicating plate 15 in the thickness direction. The second manifold portion 18 is also referred to as a throttle channel or an orifice channel.

A supply communication path 19 communicating with one end portion of the pressure chamber 12 in the Y-axis direction is independently provided for each pressure chamber 12 in the communicating plate 15. The supply communication path 19 connects the second manifold portion 18 and the pressure chamber 12.

A metal such as stainless steel and nickel, ceramics such as zirconium, and the like can be used to configure the communicating plate 15. The communicating plate 15 is preferably formed of a material having a linear expansion coefficient equal to that of the flow path forming substrate 10. When the communicating plate 15 is formed of a material having a greatly different linear expansion coefficient from the flow path forming substrate 10, warping may occur in the flow path forming substrate 10 and the communicating plate 15 by being heated or cooled. In the present embodiment, warping due to heat, cracking or peeling due to heat or the like is suppressed by using the same material as the flow path forming substrate 10, that is, a silicon single crystal substrate as the communicating plate 15.

In order to configure the nozzle plate 20, for example, a metal such as stainless steel, an organic material such as a polyimide resin and a silicon single crystal substrate can be used. When the silicon single crystal substrate is used as the nozzle plate 20, the linear expansion coefficients of the nozzle plate 20 and the communicating plate 15 become equal. As a result, warping due to heat, cracking or peeling due to heat or the like can be suppressed.

A vibrating plate 50 is disposed on a side of the flow path forming substrate 10 opposite to the communicating plate 15. In the present embodiment, as the vibrating plate 50, an elastic film 51 which is provided on the flow path forming substrate 10 side and is formed of silicon oxide and an insulating film 52 which is provided on the elastic film 51 and is formed of zirconium oxide are provided. The liquid flow path such as the pressure chamber 12 is formed by anisotropically etching the flow path forming substrate 10 from one surface, that is, the surface to which the nozzle plate 20 is joined. The other surface of the liquid flow path such as the pressure chamber 12 is formed by the elastic film 51.

An actuator 130 which is a pressure generating unit of the present embodiment is provided on the vibrating plate 50 of the flow path forming substrate 10. The actuator 130 is, for example, a piezoelectric actuator. The actuator 130 includes a first electrode 60, a piezoelectric layer 70, and a second electrode 80.

Generally, one of the electrodes of the actuator 130 is used as a common electrode, and the other electrode is patterned for each pressure chamber 12. In the present embodiment, first electrodes 60 are provided continuously over a plurality of actuators 130 to form the common electrode, and the second electrodes 80 are provided independently for the respective actuators 130, thereby each forming an individual electrode. There is no problem even if this is reversed for convenience of the drive circuit or wiring.

In the above example, the vibrating plate 50 is configured of the elastic film 51 and the insulating film 52, but it is of course not limited thereto. For example, either the elastic film 51 or the insulating film 52 may be provided as the vibrating plate 50. For example, without providing the elastic film 51 and the insulating film 52 as the vibrating plate 50, only the first electrode 60 may function as the vibrating plate. In addition, the actuator 130 itself may also substantially function as the vibrating plate.

The piezoelectric layer 70 is formed of an oxide piezoelectric material having a polarization structure. The piezoelectric layer 70 can be formed of, for example, a perovskite-type oxide represented by a general formula $ABO_3$. As the piezoelectric layer 70, a lead-based piezoelectric material containing lead, a lead-free piezoelectric material not containing lead or the like can be used.

A distal end of a lead electrode 90 is coupled to the second electrode 80 which is an individual electrode of the actuator 130. The lead electrode 90 is drawn out from the vicinity of an end portion on a side opposite to the supply communication path 19 and extends to a position above the vibrating plate 50. The lead electrode 90 is formed of, for example, gold or the like.

A wiring substrate 121 is coupled to the other end portion of the lead electrode 90. As the wiring substrate 121, a flexible sheet-like material, for example, a COF substrate or the like can be used. The wiring substrate 121 is provided with a drive circuit 120 for driving the actuator 130.

Figure 6:
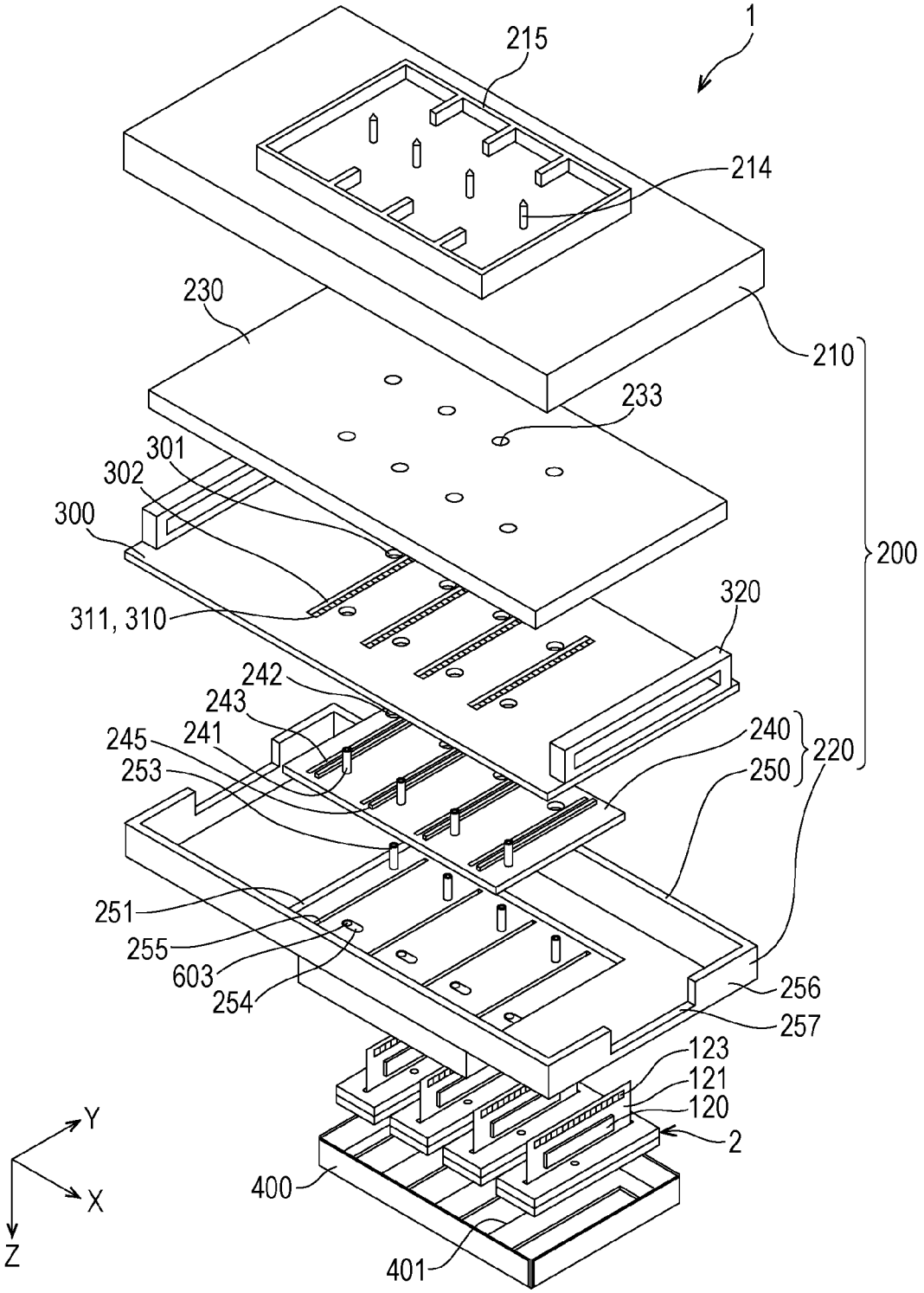
FIG. 6 is an exploded perspective view of a liquid droplet ejecting portion of the liquid droplet ejecting apparatus of FIG. 1.

As illustrated in FIGS. 4 and 6, a second terminal row 123 is formed on one surface of the wiring substrate 121. The second terminal row 123 includes a plurality of second terminals 122, as wiring terminals, arranged in the Y-axis direction. The wiring substrate 121 is not limited to the COF substrate, and may be FFC, FPC or the like.

As illustrated in FIG. 5, the protective substrate 30 having substantially the same size as the flow path forming substrate 10 is joined to a surface of the flow path forming substrate 10 on a side of the actuator 130. The protective substrate 30 includes a holding portion 31 which is a space for protecting the actuator 130.

The holding portion 31 has a concave shape which is open to the flow path forming substrate 10 side without penetrating the protective substrate 30 in the Z-axis direction which is the thickness direction. The holding portion 31 is independently provided for each column of the actuators 130 arranged in the X-axis direction. The holding portion 31 is provided so as to accommodate the actuators 130 in a column arranged in the X-axis direction. Therefore, two holding portions 31 are provided side by side in the Y-axis direction. The holding portion 31 configured as such may have a space to the extent that does not hinder movement of the actuator 130, and the space may be sealed or not sealed.

The protective substrate 30 has a through-hole 32 penetrating in the Z-axis direction which is the thickness direction. The through-hole 32 is provided between the two holding portions 31 in the X-axis direction. The through-hole 32 is provided to extend in the Y-axis direction. In other words, the through-hole 32 is an opening having a long side in the Y-axis direction in which the plurality of actuators 130 are arranged. A base end of the lead electrode 90 is provided to be exposed in the through-hole 32. The lead electrode 90 and the wiring substrate 121 are electrically coupled in the through-hole 32.

In order to configure the protective substrate 30, a material having substantially the same thermal expansion coefficient as that of the flow path forming substrate 10, for example, glass, ceramic material or the like may be used. In the present embodiment, the protective substrate 30 is formed using a silicon single crystal substrate formed of the same material as the flow path forming substrate 10. The method of joining the flow path forming substrate 10 and the protective substrate 30 is not particularly limited. In the present embodiment, for example, the flow path forming substrate 10 and the protective substrate 30 are joined using an adhesive.

The head unit 2 includes the flow path forming member 40. The flow path forming member 40 forms the common liquid chamber 100 communicating with the plurality of pressure chambers 12 in cooperation with the head main body 11. The flow path forming member 40 has substantially the same shape as the communicating plate 15 described above in plan view, and is joined to the protective substrate 30 and also to the above-described communicating plate 15. Specifically, the flow path forming member 40 has a concave portion 41 having a depth in which the flow path forming substrate 10 and the protective substrate 30 can be accommodated on the protective substrate 30 side.

The concave portion 41 has an opening area larger than the surface of the protective substrate 30 joined to the flow path forming substrate 10. With the flow path forming substrate 10 or the like accommodated in the concave portion 41, the opening surface of the concave portion 41 on a side of the nozzle plate 20 is sealed by the communicating plate 15. Accordingly, a third manifold portion 42 is formed on the outer peripheral portion of the flow path forming substrate 10 by the flow path forming member 40 and the head main body 11. The common liquid chamber 100 of the present embodiment is configured by the first manifold portion 17 and the second manifold portion 18 provided in the communicating plate 15 and the third manifold portion 42 formed by the flow path forming member 40 and the head main body 11.

That is, the common liquid chamber 100 includes the first manifold portion 17, the second manifold portion 18, and the third manifold portion 42. The common liquid chamber 100 of the present embodiment is disposed on both outer sides of two rows of the pressure chambers 12 in the X-axis direction. Two common liquid chambers 100 provided on the both outer sides of the two rows of the pressure chambers 12 are independently provided so as not to be connected in the head unit 2. That is, one common liquid chamber 100 is provided for each row of the pressure chambers 12 of the present embodiment. In other words, the common liquid chamber 100 is provided for each nozzle row NL. Two common liquid chambers 100 may be coupled to each other.

The flow path forming member 40 is a member forming the common liquid chamber 100, and has an introduction port 44 communicating with the common liquid chamber 100. That is, the introduction port 44 is an opening serving as an entrance for introducing the liquid supplied to the head main body 11 into the common liquid chamber 100. As the material of the flow path forming member 40, for example, a resin, a metal or the like can be used. If the material of the flow path forming member 40 is a resin material, the flow path forming member 40 can be mass-produced at low cost.

The flow path forming member 40 is provided with a connection port 43 communicating with the through-hole 32 of the protective substrate 30. The wiring substrate 121 is inserted through the connection port 43. The upper end portion of the wiring substrate 121 is provided so as to extend to a side opposite to the direction in which the liquid droplet is ejected in the Z-axis direction which is the penetrating direction of the through-hole 32 and the connection port 43.

The compliance substrate 45 is provided on a surface of the communicating plate 15 on which the first manifold portion 17 and the second manifold portion 18 are open. The compliance substrate 45 has substantially the same size as the communicating plate 15 described above in plan view. The compliance substrate 45 is provided with a first exposure opening 45*a* through which the nozzle plate 20 is exposed. In the compliance substrate 45, the opening of the first manifold portion 17 and the second manifold portion 18 on the nozzle surface 20*a* side is sealed in a state in which the nozzle plate 20 is exposed through the first exposure opening 45*a*. That is, the compliance substrate 45 forms a part of the common liquid chamber 100.

The compliance substrate 45 includes a sealing film 46 and a fixed substrate 47. The sealing film 46 is formed of a filmy thin film having flexibility, for example, a thin film formed of polyphenylene sulfide or the like and having a thickness of 20 μm or less. The fixed substrate 47 is formed of a hard material such as a metal such as a stainless steel. A region of the fixed substrate 47 facing the common liquid chamber 100 is an opening 48 completely removed in the thickness direction. Therefore, one surface of the common liquid chamber 100 is a compliance portion 49 which is a flexible portion sealed only by the flexible sealing film 46. In the present embodiment, one compliance portion 49 is provided corresponding to one common liquid chamber 100. That is, in the present embodiment, since two common liquid chambers 100 are provided, two compliance portions 49 are provided on both sides in the X-axis direction with the nozzle plate 20 interposed therebetween.

When ejecting the liquid droplets, the head unit 2 takes in the liquid via the introduction port 44 and fills an inside of the flow path from the common liquid chamber 100 to the nozzle 21 with the liquid. Thereafter, according to a signal from the drive circuit 120, a voltage is applied to the actuator 130 corresponding to the pressure chamber 12, thereby bending the vibrating plate 50 together with the actuator 130. As a result, the pressure in the pressure chamber 12 increases and the liquid droplet is ejected from the nozzle 21 communicating with the pressure chamber 12.

Regarding Configuration of Liquid Droplet Ejecting Portion

Next, the liquid droplet ejecting portion 1 will be described in detail.

As illustrated in FIG. 6, the liquid droplet ejecting portion 1 includes four head units 2, a flow path member 200 that holds the head unit 2, a head substrate 300 held by the flow path member 200, the wiring substrate 121 which is an example of a flexible wiring substrate. The flow path member 200 includes a holder member for supplying the liquid to the head unit 2.

Figure 7:
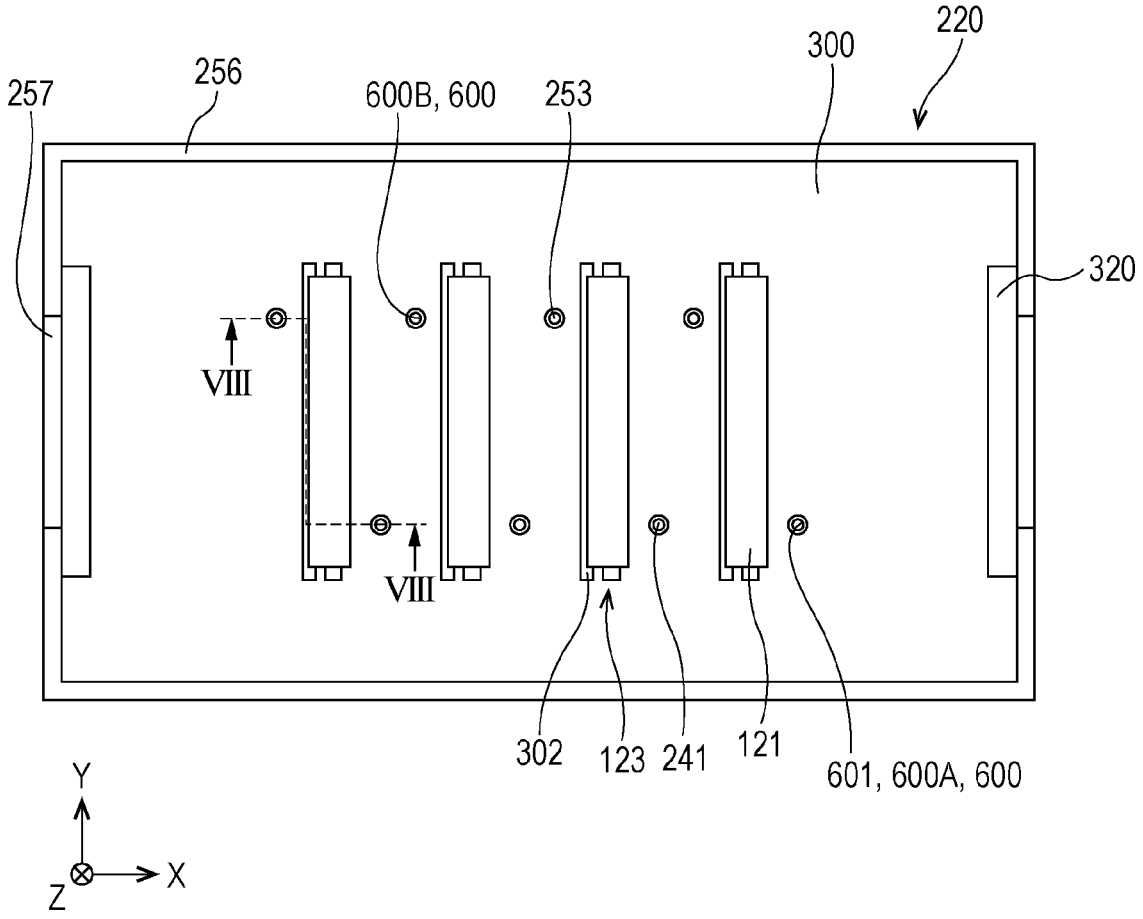
FIG. 7 is a plan view of the liquid droplet ejecting portion in FIG. 6.

FIG. 7 is a plan view of the liquid droplet ejecting portion 1 in which a sealing member 230 and an upstream flow path member 210 are not shown.

Figure 8:
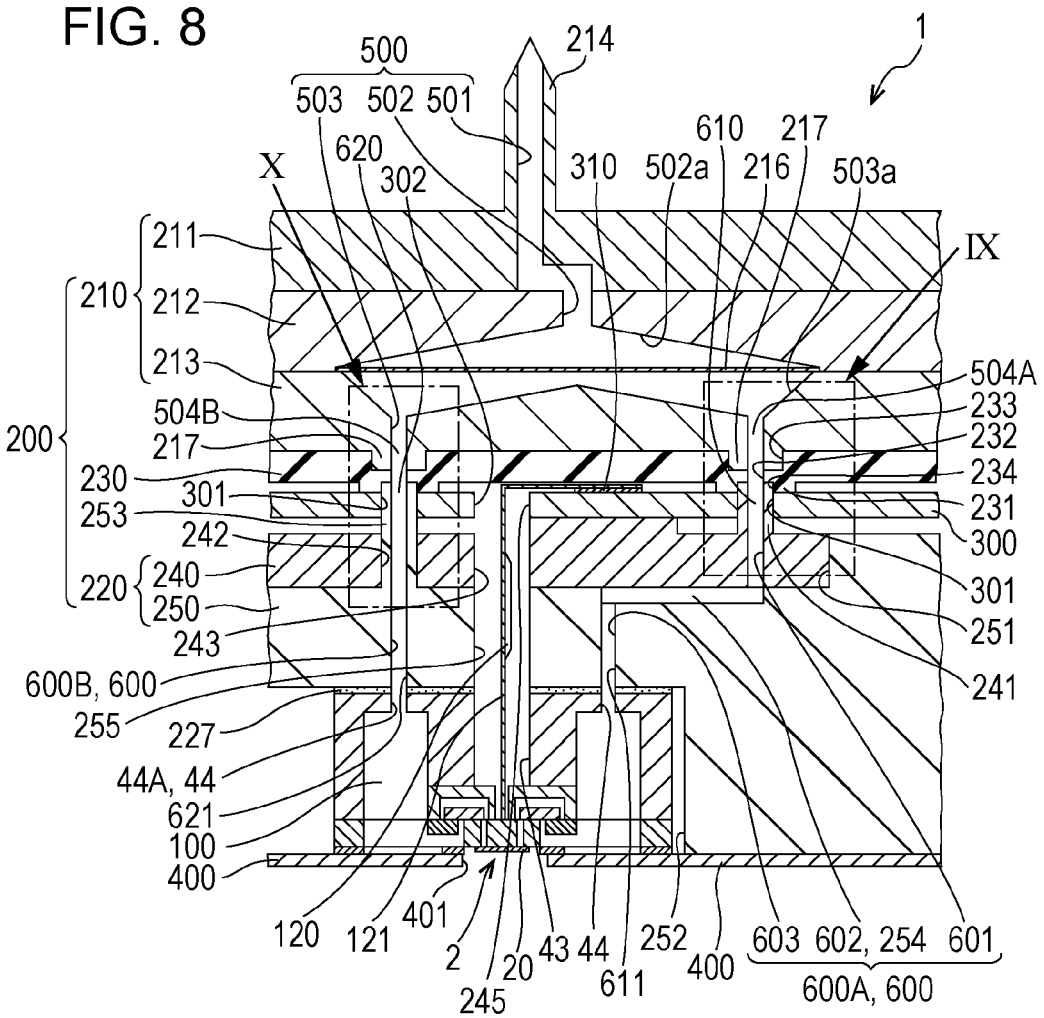
FIG. 8 is a cross-sectional view taken along line VIII-VIII in FIG. 7.

As illustrated in FIG. 8, the flow path member 200 includes the upstream flow path member 210, a downstream flow path member 220 that is an example of a holder member, and the sealing member 230 that is disposed between the upstream flow path member 210 and the downstream flow path member 220.

The upstream flow path member 210 includes an upstream flow path 500 serving as a liquid flow path. In the present embodiment, the upstream flow path member 210 is configured by stacking a first upstream flow path member 211, a second upstream flow path member 212, and a third upstream flow path member 213 in the Z-axis direction. A first upstream flow path 501, a second upstream flow path 502, and a third upstream flow path 503 are provided in the first upstream flow path member 211, the second upstream flow path member 212, and the third upstream flow path member 213, respectively. The upstream flow path 500 is configured by connecting the first upstream flow path member 211, the second upstream flow path member 212, and the third upstream flow path member 213. The upstream flow path member 210 is not limited to this, and may be a single member or two or more members. A stacking direction of the plurality of members configuring the upstream flow path member 210 is also not particularly limited, and may be the X-axis direction or the Y-axis direction.

The first upstream flow path member 211 includes a connection portion 214 coupled to the storage portion 730 that stores the liquid, on a side opposite to the downstream flow path member 220. In the present embodiment, the connection portion 214 protrudes like a needle. The connection portion 214 may be directly coupled to the storage portion 730 such as a cartridge and may be coupled to the storage portion 730 such as an ink tank via a supply pipe such as a tube.

The first upstream flow path member 211 is provided with a first upstream flow path 501. The first upstream flow path 501 is open at the top surface of the connection portion 214. The first upstream flow path 501 is configured of a flow path extending in the Z-axis direction and a flow path in a direction orthogonal to the Z-axis direction, that is, a flow path extending in a plane including the X-axis direction and the Y-axis direction according to a position of the second upstream flow path 502 to be described below. As illustrated in FIG. 6, a guide wall 215 for positioning the storage portion 730 is provided around the connection portion 214 of the first upstream flow path member 211.

As illustrated in FIG. 8, the second upstream flow path member 212 is fixed to a side opposite to the connection portion 214 of the first upstream flow path member 211. The second upstream flow path member 212 includes the second upstream flow path 502 communicating with the first upstream flow path 501. A first liquid reservoir portion 502*a* which has an inner diameter larger than that of the second upstream flow path 502 and is widened is provided on the third upstream flow path member 213 side which is the downstream of the second upstream flow path 502.

The third upstream flow path member 213 is provided on a side of the second upstream flow path member 212 opposite to the first upstream flow path member 211. The third upstream flow path member 213 is provided with the third upstream flow path 503. An opening portion of the third upstream flow path 503 on the second upstream flow path 502 side is a second liquid reservoir portion 503*a* which is widened according to the first liquid reservoir portion 502*a*.

A filter 216 for removing foreign matters such as air bubbles contained in the liquid is provided at the opening portion of the second liquid reservoir portion 503*a*, that is, between the first liquid reservoir portion 502*a* and the second liquid reservoir portion 503*a*. Accordingly, the liquid supplied from the second upstream flow path 502 is supplied to the third upstream flow path 503 via the filter 216.

In order to configure the filter 216, for example, a net-like body such as a wire mesh and a resin net, a porous body, and a metal plate having a fine through-hole formed therein can be used. Specific examples of the net-like body include a metal mesh filter and a metal fiber, for example, a thin wire of SUS made into a felt shape. As the filter 216, a metal sintered filter subjected to compressing and sintering, an electroformed metal filter, an electron beam processed metal filter, a laser beam processed metal filter or the like can be used.

As a property of the filter 216, it is preferable that the bubble point pressure do not vary. Therefore, a filter having a highly accurate hole diameter is suitable as the filter 216. The bubble point pressure refers to the pressure at which a meniscus formed with a filter pore breaks. The filtration particle size of the filter 216 is preferably smaller than the diameter of the nozzle opening when, for example, the nozzle opening is circular, in order to prevent the foreign matters in the liquid from reaching the nozzle opening.

When a mesh filter of stainless steel is adopted as the filter 216, the foreign matters in the liquid should not reach the nozzle opening. In order to do this, when the nozzle opening is circular and diameter thereof is 20 μm, a twilled weave mesh filter with a filtration particle size of 10 μm may be adopted. In this case, the bubble point pressure generated in the liquid having a surface tension of 28 mN/m is 3 to 5 kPa. When the twilled weave mesh filter with a filtration particle size of 5 μm is adopted, the bubble point pressure generated in the liquid having a surface tension of 28 mN/m is 0 to 15 kPa.

The third upstream flow path 503 is branched into two at the downstream of the second liquid reservoir portion 503*a* which is opposite to the second upstream flow path 502. The third upstream flow path 503 is open in a surface of the third upstream flow path member 213 on the downstream flow path member 220 side as a first discharge port 504A and a second discharge port 504B. Hereinafter, when the first discharge port 504A and the second discharge port 504B are not distinguished from each other, they are referred to as a discharge port 504.

The upstream flow path 500 corresponding to one connection portion 214 includes the first upstream flow path 501, the second upstream flow path 502, and the third upstream flow path 503. The upstream flow path 500 is open on the downstream flow path member 220 side as a first discharge port 504A and a second discharge port 504B which are two discharge ports 504. In other words, the first discharge port 504A and the second discharge port 504B, which are the two discharge ports 504, are provided to communicate with a common flow path.

A third protrusion 217 protruding toward the downstream flow path member 220 side is provided on the downstream flow path member 220 side of the third upstream flow path member 213. The third protrusion 217 is provided for each of the third upstream flow paths 503. The discharge port 504 is open and is provided on a distal end surface of the third protrusion 217.

The first upstream flow path member 211, the second upstream flow path member 212, and the third upstream flow path member 213 provided with the upstream flow path 500 are integrally stacked by, for example, an adhesive, welding or the like. The first upstream flow path member 211, the second upstream flow path member 212, and the third upstream flow path member 213 can be fixed by screws, clamps or the like. In order to prevent the liquid from leaking out from the connection portion from the first upstream flow path 501 to the third upstream flow path 503, it is preferable to join the members by an adhesive, welding or the like.

In the present embodiment, four connection portions 214 are provided in one upstream flow path member 210. Therefore, four independent upstream flow paths 500 are provided in one upstream flow path member 210. The liquid corresponding to each of four head units 2 is supplied to each upstream flow path 500. One upstream flow path 500 is branched into two and is coupled to each of two introduction ports 44 of the head unit 2 communicating with a downstream flow path 600 to be described later.

In the present embodiment, the configuration in which the upstream flow path 500 is branched into two at the downstream of the filter 216, that is, the downstream flow path member 220 side is exemplified, but is not particularly limited thereto. The upstream flow path 500 may be branched into three or more at the downstream of the filter 216. Only one upstream flow path 500 among the plurality of upstream flow paths 500 may not be branched at the downstream of the filter 216.

The downstream flow path member 220 is joined to the upstream flow path member 210. The downstream flow path member 220 is an example of a holder member having the downstream flow path 600 communicating with the upstream flow path 500. The downstream flow path member 220 according to the present embodiment includes a first downstream flow path member 240 which is an example of a first member and a second downstream flow path member 250 which is an example of a second member.

The downstream flow path member 220 has the downstream flow path 600 that is a liquid flow path. The downstream flow path 600 of the present embodiment includes two types of downstream flow paths 600A and 600B having different shapes.

The first downstream flow path member 240 is a member formed in a substantially flat plate shape. The second downstream flow path member 250 is provided with a first accommodating portion 251 as a concave portion on the surface of the side of the upstream flow path member 210 and a second accommodating portion 252 as a concave portion on the surface of a side opposite to the upstream flow path member 210.

The first accommodating portion 251 has a size to accommodate the first downstream flow path member 240. The second accommodating portion 252 has a size to accommodate four head units 2. The second accommodating portion 252 of the present embodiment can accommodate four head units 2.

A plurality of first protrusions 241 are formed on a surface of the first downstream flow path member 240 on a side of the upstream flow path member 210. Each of the first protrusions 241 is provided to face the third protrusion 217 provided with the first discharge port 504A among the third protrusions 217 provided in the upstream flow path member 210. In the present embodiment, four first protrusions 241 are provided.

The first downstream flow path member 240 is provided with a first flow path 601 penetrating in the Z-axis direction and being open on the top surface of the first protrusion 241, the surface facing the upstream flow path member 210. The third protrusion 217 and the first protrusion 241 are joined via the sealing member 230. The first discharge port 504A and the first flow path 601 communicate with each other.

A plurality of second through-holes 242 penetrating in the Z-axis direction are formed in the first downstream flow path member 240. Each of the second through-holes 242 is formed at a position where the second protrusion 253 formed in the second downstream flow path member 250 is inserted. In the present embodiment, four second through-holes 242 are provided.

A plurality of first insertion holes 243, through which the wiring substrate 121 electrically coupled to the head unit 2 is inserted, is formed in the first downstream flow path member 240. Specifically, each of the first insertion holes 243 penetrates in the Z-axis direction and is formed to connect a second insertion hole 255 of the second downstream flow path member 250 and a third insertion hole 302 of the head substrate 300. In the present embodiment, four first insertion holes 243 are provided corresponding to each of the wiring substrates 121 provided in four head units 2. The first downstream flow path member 240 is provided with a support portion 245 which protrudes toward the head substrate 300 and has a receiving surface.

In the second downstream flow path member 250, a plurality of second protrusions 253 are formed on a bottom surface of the first accommodating portion 251. Each of the second protrusions 253 is provided to face the third protrusion 217 provided with the second discharge port 504B of the third protrusion 217 provided in the upstream flow path member 210. In the present embodiment, four second protrusions 253 are provided. The second downstream flow path member 250 is provided with a downstream flow path 600B that penetrates in the Z-axis direction and is open to a top surface of the second protrusion 253 and a bottom surface of the second accommodating portion 252, the surface facing the head unit 2. The third protrusion 217 and the second protrusion 253 are joined via the sealing member 230. The second discharge port 504B and the downstream flow path 600B communicate with each other.

A plurality of third flow paths 603 penetrating in the Z-axis direction are formed in the second downstream flow path member 250. Each of the third flow paths 603 is open to the bottom surfaces of the first accommodating portion 251 and the second accommodating portion 252. In the present embodiment, four third flow paths 603 are provided.

A plurality of groove portions 254 continuing with the third flow path 603 are formed in the bottom surface of the first accommodating portion 251 of the second downstream flow path member 250. The groove portion 254 forms a second flow path 602 by being sealed in the first downstream flow path member 240 accommodated in the first accommodating portion 251. That is, the second flow path 602 is a flow path formed by the groove portion 254 and a surface of the first downstream flow path member 240 on a side of the second downstream flow path member 250. The second flow path 602 corresponds to a flow path provided between the first member and the second member.

A plurality of second insertion holes 255, through which the wiring substrate 121 electrically coupled to the head unit 2 is inserted, is formed in the second downstream flow path member 250. Specifically, each of the second insertion holes 255 penetrates in the Z-axis direction and is formed to connect the first insertion hole 243 of the first downstream flow path member 240 and the connection port 43 of the head unit 2. In the present embodiment, four second insertion holes 255 are provided corresponding to each of wiring substrates 121 provided in four head units 2.

The downstream flow path 600A is formed by causing the above-described first flow path 601, second flow path 602, and third flow path 603 to communicate with one another. The second flow path 602 is formed by sealing a groove formed on one surface of the first downstream flow path member 240 with the second downstream flow path member 250. By joining the first downstream flow path member 240 and the second downstream flow path member 250 as described above, it is possible to easily form the second flow path 602 in the downstream flow path member 220.

The second flow path 602 is an example of a flow path extending in the horizontal direction. The matter that the second flow path 602 extends in the horizontal direction means that a component (vector) in the X-axis direction or the Y-axis direction is included in the extending direction of the second flow path 602. Since the second flow path 602 extends in the horizontal direction, it is possible to reduce the height of the liquid droplet ejecting portion 1 in the Z-axis direction. If the second flow path 602 is inclined with respect to the horizontal direction, the height dimension of the liquid droplet ejecting portion 1 is increased.

The extending direction of the second flow path 602 is the direction in which the liquid in the second flow path 602 flows. Therefore, the second flow path 602 includes one provided in the horizontal direction and the other one provided to intersect the horizontal plane extending in the horizontal direction. In the present embodiment, the first flow path 601 and the third flow path 603 are arranged in the Z-axis direction, and the second flow path 602 is arranged in the horizontal direction. The first flow path 601 and the third flow path 603 may be arranged in the horizontal direction. The downstream flow path 600A is not limited to this, and flow paths other than the first flow path 601, the second flow path 602, and the third flow path 603 may exist. The downstream flow path 600A may not include the first flow path 601, the second flow path 602, and the third flow path 603, and may be configured with one flow path.

As described above, the downstream flow path 600B is formed as a through-hole penetrating the second downstream flow path member 250 in the Z-axis direction. The downstream flow path 600B is not limited to this, and, for example, may be formed to extend in the horizontal direction or may be formed of a plurality of flow paths such as the downstream flow path 600A.

One downstream flow path 600A and one downstream flow path 600B are formed for each head unit 2. That is, in the downstream flow path member 220, a total of four pairs of the downstream flow path 600A and the downstream flow path 600B are provided.

Among the openings at both ends of the downstream flow path 600A, the opening of the first flow path 601 with which the first discharge port 504A communicates is set as a first inflow port 610, and the opening of the third flow path 603 that is open to the second accommodating portion 252 is set as a first outflow port 611.

The opening of the downstream flow path 600B communicating with the second discharge port 504B among the openings at both ends of the downstream flow path 600B is set as a second inflow port 620 and the opening of the downstream flow path 600B that is open to the second accommodating portion 252 is set as a second outflow port 621. Hereinafter, when the downstream flow path 600A and the downstream flow path 600B are not distinguished, they are referred to as a downstream flow path 600.

The downstream flow path member 220 which is a holder member holds the head unit 2 on the lower side. Specifically, a plurality of head units 2 are accommodated in the second accommodating portion 252 of the downstream flow path member 220. In the present embodiment, four head units 2 are accommodated in the second accommodating portion 252 of the downstream flow path member 220.

Two introduction ports 44 are provided in the head unit 2. The first outflow port 611 and the second outflow port 621 of the downstream flow path 600A and the downstream flow path 600B are provided in the downstream flow path member 220 in accordance with the positions where the introduction ports 44 are open.

Each of the introduction ports 44 of the head unit 2 are positioned so as to connect the first outflow port 611 and the second outflow port 621 of the downstream flow path 600 that is open to the bottom surface portion of the second accommodating portion 252. The head unit 2 is fixed to the second accommodating portion 252 by an adhesive 227 provided around each introduction port 44. By fixing the head unit 2 to the second accommodating portion 252, the first outflow port 611 and the second outflow port 621 of the downstream flow path 600 communicate with the introduction port 44, and the liquid is supplied to the head unit 2.

In the downstream flow path member 220, the head substrate 300 is mounted in an upper side. Specifically, the head substrate 300 is mounted on a surface of the downstream flow path member 220 on a side of the upstream flow path member 210. The head substrate 300 is a member to which the wiring substrate 121 is coupled and on which a circuit for controlling the ejecting operation or the like of the liquid droplet ejecting portion 1 or an electrical component such as a resistor is mounted via the wiring substrate 121.

As illustrated in FIG. 6, on a surface of the upstream flow path member 210 side of the head substrate 300, a first terminal row 310 in which a plurality of first terminals 311 which are electrode terminals to which the second terminal row 123 of the wiring substrate 121 is are formed in parallel is formed. In the present embodiment, the first terminal row 310 is an example of a mounting region electrically coupled to the wiring substrate 121.

A plurality of third insertion holes 302 through which the wiring substrate 121 electrically coupled to the head unit 2 is inserted are formed in the head substrate 300. Specifically, each third insertion hole 302 penetrates in the Z-axis direction and is formed to communicate with the first insertion hole 243 of the first downstream flow path member 240. In the present embodiment, four third insertion holes 302 are provided corresponding to each of the wiring substrates 121 provided in four head units 2.

The head substrate 300 is provided with a third through-hole 301 penetrating in the Z-axis direction. The third through-hole 301 is a hole through which the first protrusion 241 of the first downstream flow path member 240 and the second protrusion 253 of the second downstream flow path member 250 are inserted. In the present embodiment, a total of eight third through-holes 301 are provided to face the first protrusion 241 and the second protrusion 253.

The shape of the third through-hole 301 formed in the head substrate 300 is not limited to the above-described aspect. For example, a common through-hole through which the first protrusion 241 and the second protrusion 253 are inserted may be used as the insertion hole. That is, the insertion holes, notches or the like may be formed on the head substrate 300 so as not to obstruct connection between the downstream flow path 600 of the downstream flow path member 220 and the upstream flow path 500 of the upstream flow path member 210.

Figure 9:
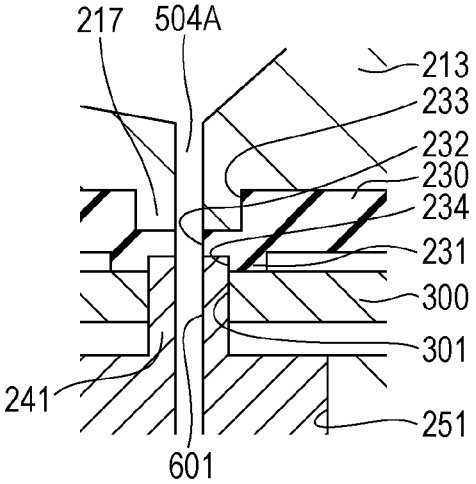
FIG. 9 is an enlarged view of a right-side one-dot chain line frame in FIG. 8.
Figure 10:
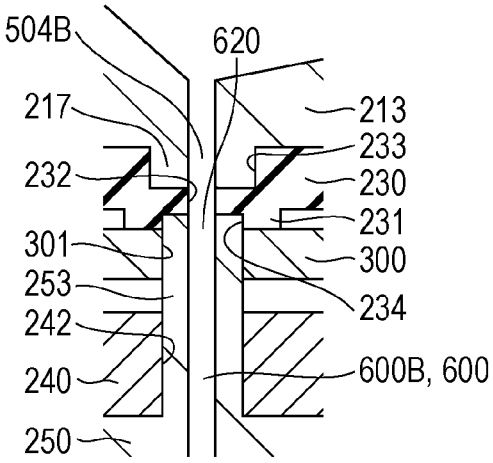
FIG. 10 is an enlarged view of a left-side one-dot chain line frame in FIG. 8.

As illustrated in FIGS. 8, 9, and 10, the sealing member 230 is provided between the head substrate 300 and the upstream flow path member 210. In order to configure the sealing member 230, it is possible to use an elastic material having liquid resistance against a liquid such as ink used for the liquid droplet ejecting portion 1 and being elastically deformable, for example, rubber, elastomer or the like.

The sealing member 230 is a plate-like member in which a communication path 232 penetrating in the Z-axis direction and a fourth protrusion 231 protruding toward the downstream flow path member 220 side are formed. In the present embodiment, eight communication paths 232 and fourth protrusions 231 are formed corresponding to each of the upstream flow path 500 and the downstream flow path 600.

An annular first concave portion 233 into which the third protrusion 217 is inserted is provided on the upstream flow path member 210 side of the sealing member 230. The first concave portion 233 is provided at a position facing the fourth protrusion 231.

The fourth protrusion 231 protrudes toward the downstream flow path member 220 and is provided at a position facing the first protrusion 241 and the second protrusion 253 of the downstream flow path member 220. A second concave portion 234 into which the first protrusion 241 and the second protrusion 253 are inserted is provided on the top surface of the fourth protrusion 231, the surface facing the downstream flow path member 220.

The communication path 232 penetrates the sealing member 230 in the Z-axis direction, one end thereof is open to the first concave portion 233, and the other end thereof is open to a second concave portion 234. The fourth protrusion 231 is held in a state where a predetermined pressure is applied in the Z-axis direction between the distal end surface of the third protrusion 217 inserted into the first concave portion 233 and distal end surfaces of the first protrusion 241 and the second protrusion 253 inserted into the second concave portion 234. Therefore, the upstream flow path 500 and the downstream flow path 600 are connected via the communication path 232 in a state where the upstream flow path 500 and the downstream flow path 600 are sealed.

As illustrated in FIG. 8, a cover head 400 is attached to a lower side of the liquid droplet ejecting portion, which is the second accommodating portion 252 side of the downstream flow path member 220. The cover head 400 is a member to which the head unit 2 is fixed and which is fixed to the downstream flow path member 220. The cover head 400 is provided with a second exposure opening 401 through which the nozzle 21 is exposed. In the present embodiment, the second exposure opening 401 has a size to expose the nozzle plate 20, that is, an opening substantially the same as the first exposure opening 45*a* of the compliance substrate 45.

The cover head 400 is joined to a side of the compliance substrate 45 opposite to the communication plate 15. The space on a side opposite to the common liquid chamber 100, which is the flow path of the compliance portion 49, is sealed. By covering the compliance portion 49 with the cover head 400 as described above, it is possible to reduce problems to damage the compliance portion 49 due to the contact of the medium ST. The adhesion of the liquid to the compliance portion 49 is suppressed. The liquid adhering to the surface of the cover head 400 can be wiped with, for example, a wiper blade or the like. Thus, the contamination of the medium ST by the liquid adhering to the cover head 400 can be suppressed. Although it is not shown, the space between the cover head 400 and the compliance portion 49 is open to the atmosphere. The cover head 400 may be independently provided for each head unit 2.

Regarding Electrical Configuration of Liquid Droplet Ejecting Apparatus

Next, the electrical configuration of the liquid droplet ejecting apparatus 700 will be described.

Figure 11:
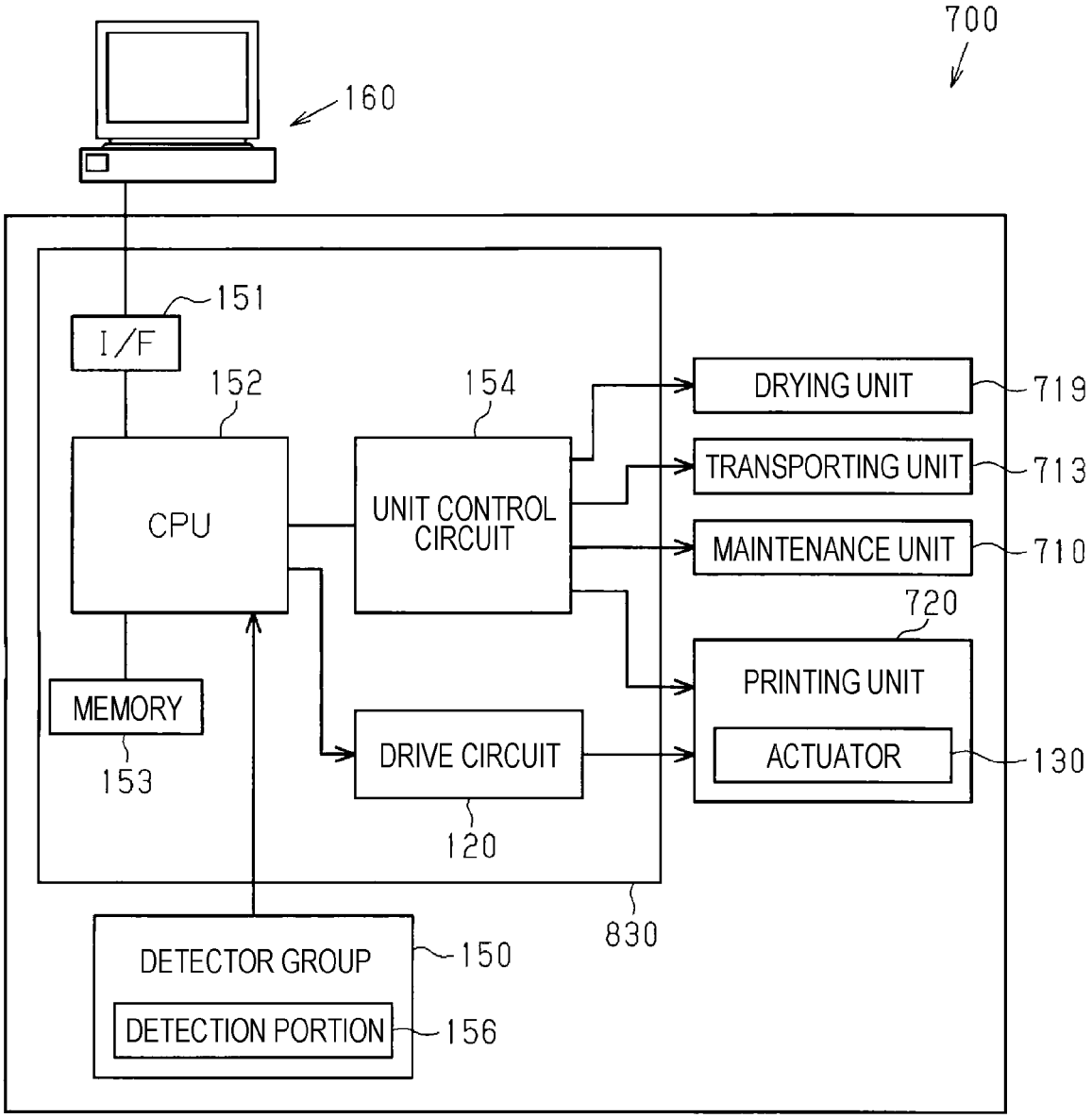
FIG. 11 is a block diagram illustrating an electrical configuration of the liquid droplet ejecting apparatus in FIG. 1.

As illustrated in FIG. 11, the liquid droplet ejecting apparatus 700 includes a control portion 830 that comprehensively controls the components of the liquid droplet ejecting apparatus 700, and a detector group 150 that monitors a status in the liquid droplet ejecting apparatus 700. The detector group 150 outputs the detection result to the control portion 830.

The control portion 830 includes an interface portion 151, a CPU 152, a memory 153, a unit control circuit 154, and the drive circuit 120. The interface portion 151 transmits and receives data between a computer 160 which is an external device and the liquid droplet ejecting apparatus 700. The drive circuit 120 generates a driving signal for driving the actuator 130.

The CPU 152 is an arithmetic processing unit. The memory 153 is a storage device for securing an area for storing a program of the CPU 152, or a work area, and includes a storage element such as RAM and EEPROM. The CPU 152 controls the drying unit 719, the transporting unit 713, the maintenance unit 710, and the printing unit 720 via the unit control circuit 154 in accordance with a program stored in the memory 153.

The detector group 150 includes a detection portion 156 configured to detect an abnormality in an ejecting state of the liquid droplet from the nozzle 21. The detection portion 156 of the present embodiment is a circuit that detects a residual vibration of the pressure chamber 12. The detection portion 156 may include a piezoelectric element configuring the actuator 130. The detector group 150 includes, for example, a linear encoder for detecting a movement status of the carriage 723, and a medium detection sensor for detecting the medium ST in addition to the detection portion 156.

The control portion 830 estimates a cause of the abnormality of the ejecting state of the liquid droplet from the nozzle 21. The control portion 830 of the present embodiment performs a nozzle inspection to be described later based on the detection result of the detection portion 156. The control portion 830 estimates a cause of the abnormality of the ejecting state of the nozzle 21 by performing the nozzle inspection.

Regarding Nozzle Inspection

When a signal from the drive circuit 120 is received and a voltage is applied to the actuator 130, the vibrating plate 50 flexibly deforms. As a result, a pressure fluctuation occurs in the pressure chamber 12, and the vibrating plate 50 vibrates for a while due to the fluctuation. This vibration is referred to as a residual vibration, and detection of states of the pressure chamber 12 and the nozzle 21 communicating with the pressure chamber 12 from a state of the residual vibration is referred to as a nozzle inspection.

Figure 12:
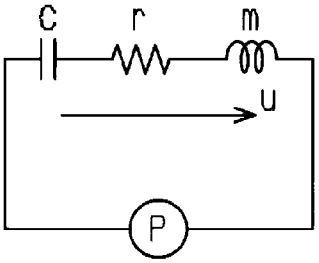
FIG. 12 is a diagram illustrating a calculation model of a simple vibration in which a residual vibration of a vibrating plate is taken into consideration.

FIG. 12 is a diagram illustrating a calculation model of a simple vibration in which a residual vibration of the vibrating plate 50 is taken into consideration.

When the drive circuit 120 applies a drive signal to the actuator 130, the actuator 130 expands or contracts according to a voltage of the drive signal. The vibrating plate 50 bends according to expansion and contraction of the actuator 130, whereby a volume of the pressure chamber 12 expands and then contracts. At this time, a part of the liquid filling the pressure chamber 12 is ejected as the liquid droplet from the nozzle 21 by the pressure generated in the pressure chamber 12.

When a series of vibrating plates 50 are operated, the vibrating plate 50 freely vibrates at the natural vibration frequency determined by a flow path resistance r due to a shape of the flow path through which the liquid flows, liquid thickening or the like, an inertance m due to the liquid weight in the flow path, and a compliance C of the vibrating plate 50. The free vibration of the vibrating plate 50 is a residual vibration.

The calculation model of the residual vibration of the vibrating plate 50 can be expressed by a pressure P, the inertance m, the compliance C, and a flow path resistance r described above. When a step response on applying pressure P to the circuit in FIG. 12 is calculated with respect to a volumetric velocity u, the following equation is obtained.

$$u = \frac{P}{\omega \cdot m} e^{-\omega t} \cdot \sin \omega t \tag{1}$$

$$\omega = \sqrt{\frac{1}{m \cdot C} - \alpha^2} \tag{2}$$

$$\alpha = \frac{r}{2m} \tag{3}$$

Figure 13:
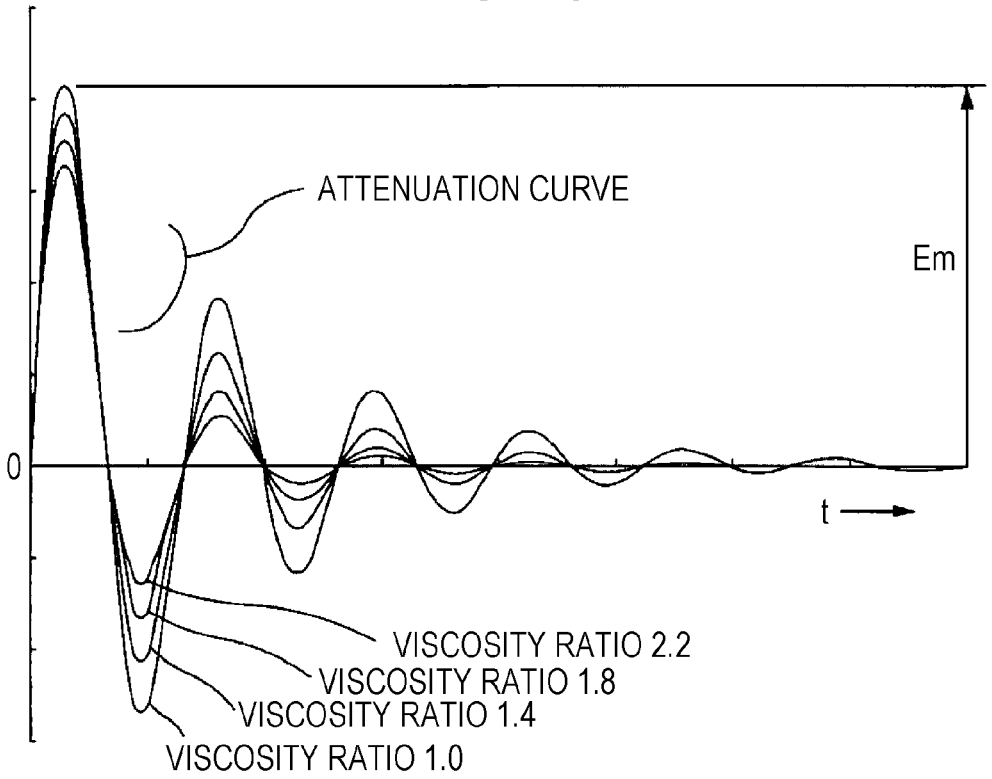
FIG. 13 is an explanatory view for illustrating a relationship between thickening of a liquid and a residual vibration waveform.

FIG. 13 is an explanatory view for illustrating a relationship between thickening of a liquid and a residual vibration waveform. In FIG. 13, a horizontal axis represents time and a vertical axis represents a magnitude of the residual vibration. For example, when the liquid in the vicinity of the nozzle 21 is dried, the thickening of the liquid increases, that is, the liquid thickens. When the liquid thickens, since the flow path resistance r increases, the vibration period and damping of residual vibration increases.

Figure 14:
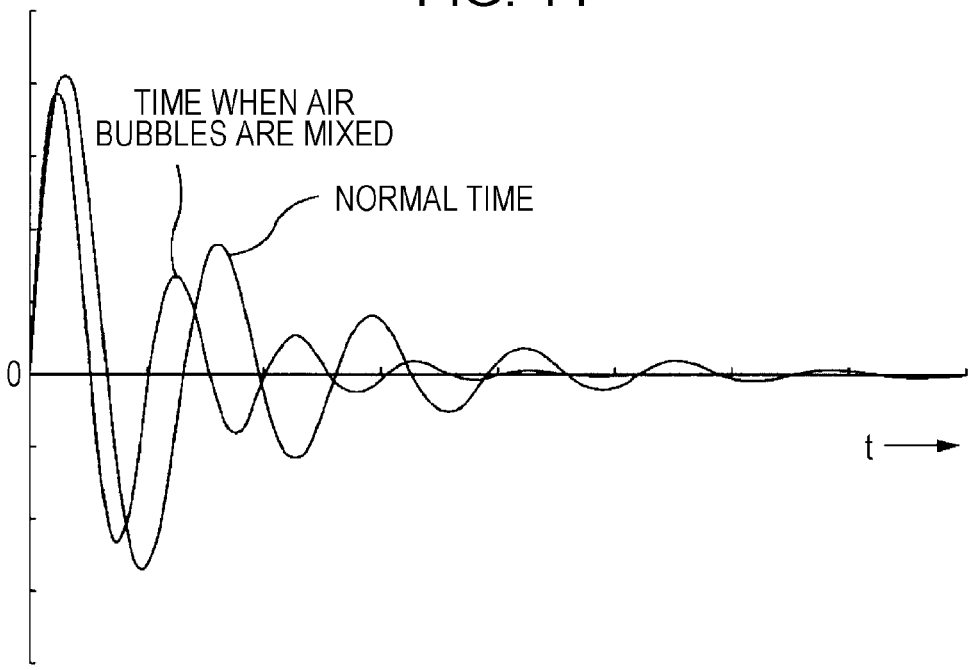
FIG. 14 is an explanatory view for illustrating a relationship between air bubbles inclusion and a residual vibration waveform.

FIG. 14 is an explanatory view for illustrating a relationship between air bubbles inclusion and a residual vibration waveform. In FIG. 14, a horizontal axis represents time and a vertical axis represents a magnitude of the residual vibration. For example, when air bubbles are mixed in the flow path of the liquid or a distal end of the nozzle 21, a liquid weight, that is, an inertance m decreases by the amount of the air bubbles mixed as compared with the state of the nozzle 21 in a normal state. When m decreases in Equation (2), the angular velocity co becomes large, so that the vibration cycle becomes short. That is, the vibration frequency increases.

In addition to this, when the foreign matters such as paper dust sticks to the vicinity of the opening of the nozzle 21, it is considered that the inertance m increases because the liquid in the pressure chamber 12 as seen from the vibrating plate 50 and the liquid oozing out increases more than in the normal state. In addition, it is also considered that the flow path resistance r increases due to the fibers of the paper dust adhering to the vicinity of the outlet of the nozzle 21. Therefore, when the paper dust adheres to the vicinity of the opening of the nozzle 21, the frequency is lower than that at the time of normal ejecting, and the frequency of the residual vibration is higher than the case of liquid thickening.

When the thickening of the liquid, mixing of air bubbles, sticking of the foreign matters or the like occurs, since the state in the nozzle 21 or the pressure chamber 12 is not normal, the liquid is not typically ejected from the nozzle 21. Therefore, dot missing occurs in an image printed on the medium ST. Even when the liquid droplet is ejected from the nozzle 21, the amount of the liquid droplet may be small, or the flight direction of the liquid droplet may deviate and may not land on a target position in some cases. The nozzle 21 in which the abnormality of the ejecting state of the liquid droplet occurs is referred to as an abnormal nozzle.

As described above, the residual vibration of the pressure chamber 12 communicating with the abnormal nozzle is different from the residual vibration of the pressure chamber 12 communicating with the normal nozzle 21. The detection portion 156 detects the vibration waveform of the pressure chamber 12 to detect the state in the pressure chamber 12. The detection portion 156 detects the vibration waveform of the pressure chamber 12 to detect the abnormality of the ejecting state of the liquid droplet from the nozzle 21.

The control portion 830 estimates whether or not the abnormality of the ejecting state occurs in the nozzle 21 based on the vibration waveform detected by the detection portion 156. That is, the control portion 830 performs the nozzle inspection based on the vibration waveform detected by the detection portion 156. The control portion 830 estimates a cause of the abnormality of the ejecting state of the liquid droplet from the nozzle 21 based on the vibration waveform detected by the detection portion 156.

The maintenance unit 710 performs maintenance for eliminating the abnormality of the ejecting state based on the result of the nozzle inspection.

Regarding Configuration of Maintenance Unit

Next, the configuration of the maintenance unit 710 will be described.

Figure 15:
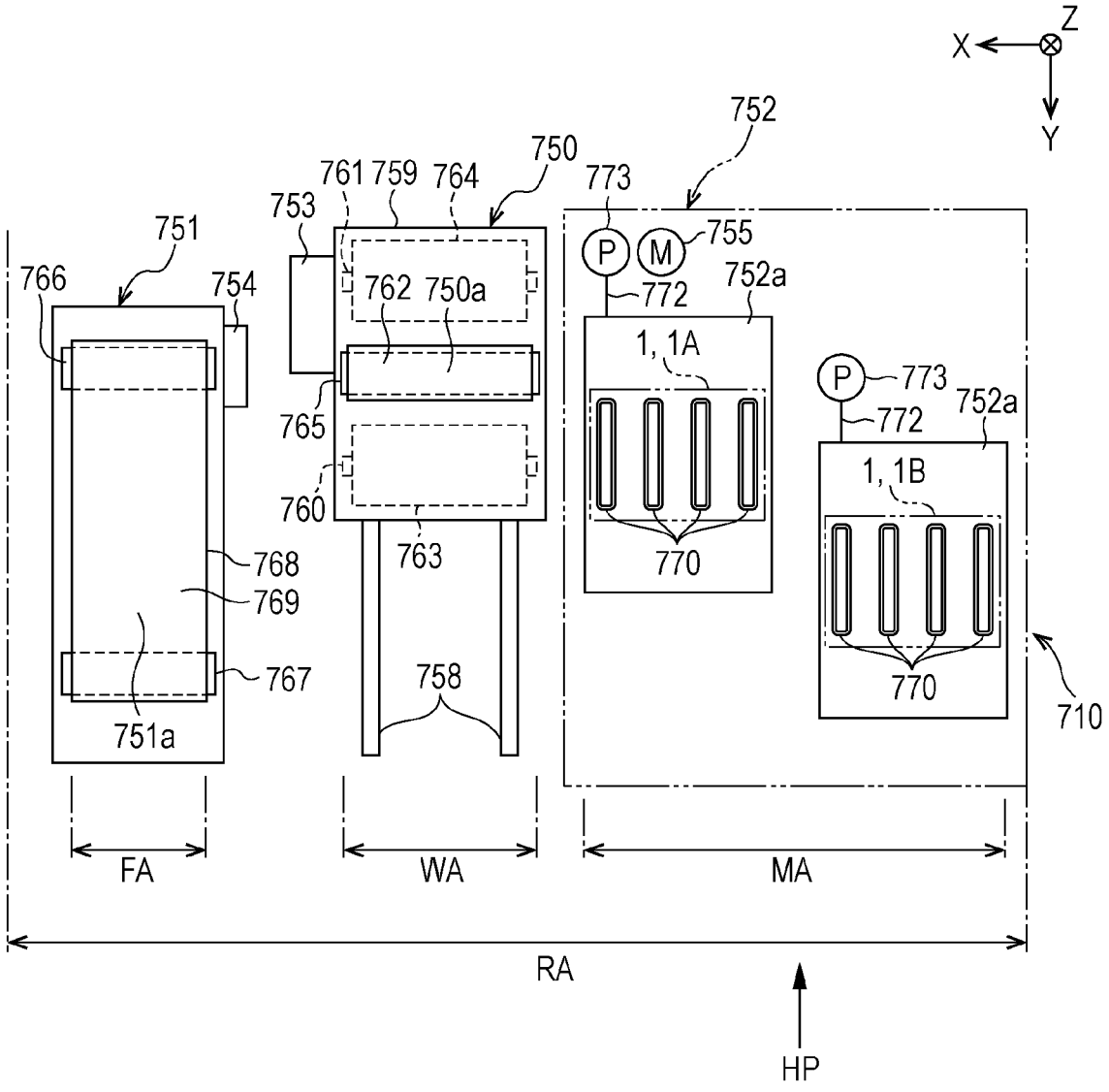
FIG. 15 is a plan view of a maintenance unit of the liquid droplet ejecting apparatus in FIG. 1.

As illustrated in FIG. 15, the non-printing area RA includes a receiving area FA in which the liquid receiving mechanism 751 is provided, a wiping area WA in which the wiping mechanism 750 is provided, and a maintenance area MA in which the cap mechanism 752 is provided. In the non-printing area RA, the receiving area FA is disposed at a position closest to the printing area PA, and the maintenance area MA is arranged at a position farthest from the printing area PA.

The wiping mechanism 750 includes a wiping member 750*a* for wiping the liquid droplet ejecting portion 1 and a wiping motor 753. The wiping member 750*a* of the present embodiment is movable, and wipes the liquid droplet ejecting portion 1 by moving with a power of the wiping motor 753. The maintenance by wiping is called wiping.

The wiping mechanism 750 includes a pair of rails 758 extending in the Y-axis direction and a movable case 759 supported by the rail 758. The case 759 is provided with a power transmission mechanism (not shown) for transmitting the power of the wiping motor 753. The power transmission mechanism is transmitted by, for example, a rack and pinion mechanism. The case 759 reciprocates on the rail 758 by the power of the wiping motor 753.

The case 759 rotatably supports a feeding shaft 760, a pressing roller 765, and a winding shaft 761 arranged at a predetermined interval in the Y-axis direction. The case 759 includes an opening above the pressing roller 765.

The feeding shaft 760 supports a feeding roll 763 on which an unused cloth sheet 762 is cylindrically wound. The winding shaft 761 supports a winding roll 764 formed of the used cloth sheet 762. The pressing roller 765 pushes up a cloth sheet 762 between the feeding roll 763 and the winding roll 764 to protrude from the opening of the case 759.

The case 759 moves in the Y-axis direction from a retract position illustrated in FIG. 15 by the normal rotation of the wiping motor 753, and reaches the wiping position. Thereafter, the case 759 moves from the wiping position to the retreat position by the reverse rotation of the wiping motor 753. In a process in which the case 759 moves from the retract position to the wiping position, the wiping member 750*a* wipes the liquid droplet ejecting portion 1. In a process in which the case 759 moves from the wiping position to the retract position, the wiping member 750*a* wipes the liquid droplet ejecting portion 1.

When the movement of the case 759 from the retract position to the wiping position is completed, the power transmission mechanism switches the output destination of a driving force of the wiping motor 753 to the winding shaft 761, and the movement of the case 759 from the wiping position to the retract position and the winding of the cloth sheet 762 may be performed by a power generated when the wiping motor 753 is driven in reverse. When the case 759 reciprocates once, the wiping mechanism 750 wipes one liquid droplet ejecting portion 1 and when the case 759 reciprocates twice, the wiping mechanism 750 wipes two liquid droplet ejecting portion 1.

The liquid receiving mechanism 751 includes a liquid receiving portion 751*a* for receiving the liquid droplet ejected by the liquid droplet ejecting portion 1 and a flushing motor 754. The term flushing refers to maintenance that the liquid droplet ejecting portion 1 ejects the liquid as a waste liquid for the purpose of preventing and eliminating clogging of the nozzle 21. The liquid receiving portion 751*a* of the present embodiment is configured of a belt 768. The liquid receiving mechanism 751 moves the belt 768 by a power of the flushing motor 754 at a time when it is considered that the amount of the contamination due to the flushing of the belt 768 exceeds a specified amount.

The liquid receiving mechanism 751 includes a driving roller 766, a driven roller 767, and an annular belt 768 wound on the driving roller 766, and the driven roller 767. The outer peripheral surface of the belt 768 becomes a liquid receiving surface 769 for receiving the liquid. In the driving roller 766 and the driven roller 767, the X-axis direction is an axial direction, and the driving roller 766 and the driven roller 767 are arranged to be separated from each other in the Y-axis direction. The belt 768 has a width dimension such that the waste liquid is received therein, the waste liquid being simultaneously ejected by all the nozzles 21 of one liquid droplet ejecting portion 1.

The liquid receiving mechanism 751 includes a moisturizing liquid supply portion capable of supplying a moisturizing liquid to the liquid receiving surface 769 and a liquid scraping portion for scraping the waste liquid or the like adhering to the liquid receiving surface 769 in the moisturizing state under the belt 768. When the belt 768 moves due to the rotation of the driving roller 766, the waste liquid received by the liquid receiving surface 769 is scraped by the liquid scraping portion from the belt 768. Accordingly, next, the liquid receiving surface 769 which receives the liquid droplet is updated to the portion without the waste liquid adhered.

The cap mechanism 752 includes two cap portions 752*a* and a capping motor 755. The two cap portions 752*a* move between the contact position and the retract position by the power of the capping motor 755. The contact position is a position at which the cap portion 752*a* contacts the liquid droplet ejecting portion 1. The retract position is a position at which the cap portion 752*a* contacts the liquid droplet ejecting portion 1.

The cap portion 752*a* contacts the liquid droplet ejecting portions 1A and 1B so as to surround the opening of the nozzle 21 when the cap portion 752*a* moves from the retreat position to the contact position in a case in which the liquid droplet ejecting portions 1A and 1B stop at the home position HP as indicated by the two-dot chain line in FIG. 15. Maintenance that the cap portion 752*a* surrounds the opening of the nozzle 21 is referred to as capping. A state in which the cap portion 752*a* is in contact with the liquid droplet ejecting portion 1 is referred to as a capping state.

One cap portion 752*a* includes four suction caps 770. The suction cap 770 contacts the liquid droplet ejecting portion 1 to form a space surrounding the nozzle group. Therefore, the suction cap 770 of the present embodiment forms a space surrounding two nozzle rows NL. The suction cap 770 is coupled to a suction pump 773 via a tube 772. When the suction pump 773 is driven at the time of capping, a negative pressure is generated in the suction cap 770, and the inside of the liquid droplet ejecting portion 1 is sucked. By this suction, the thickened liquid and the air bubbles in the liquid droplet ejecting portion 1 are discharged. Maintenance for discharging the liquid from the nozzle 21 by suction is called suction cleaning.

When the suction cleaning is performed, the liquid discharged from the nozzle 21 adheres to the liquid droplet ejecting portion 1. Therefore, the liquid droplet or the like adhered to the liquid droplet ejecting portion 1 may be removed by wiping after suction cleaning. At this time, due to wiping, there is a possibility that the foreign matters adhering to the liquid droplet ejecting portion 1 and air bubbles may be pushed into the nozzle 21 or the meniscus formed in gas-liquid interface in the nozzle 21 may be destroyed, and ejecting failure may occur. Therefore, mixed foreign matters may be discharged, and meniscus may be arranged by flushing after wiping.

Figure 16:
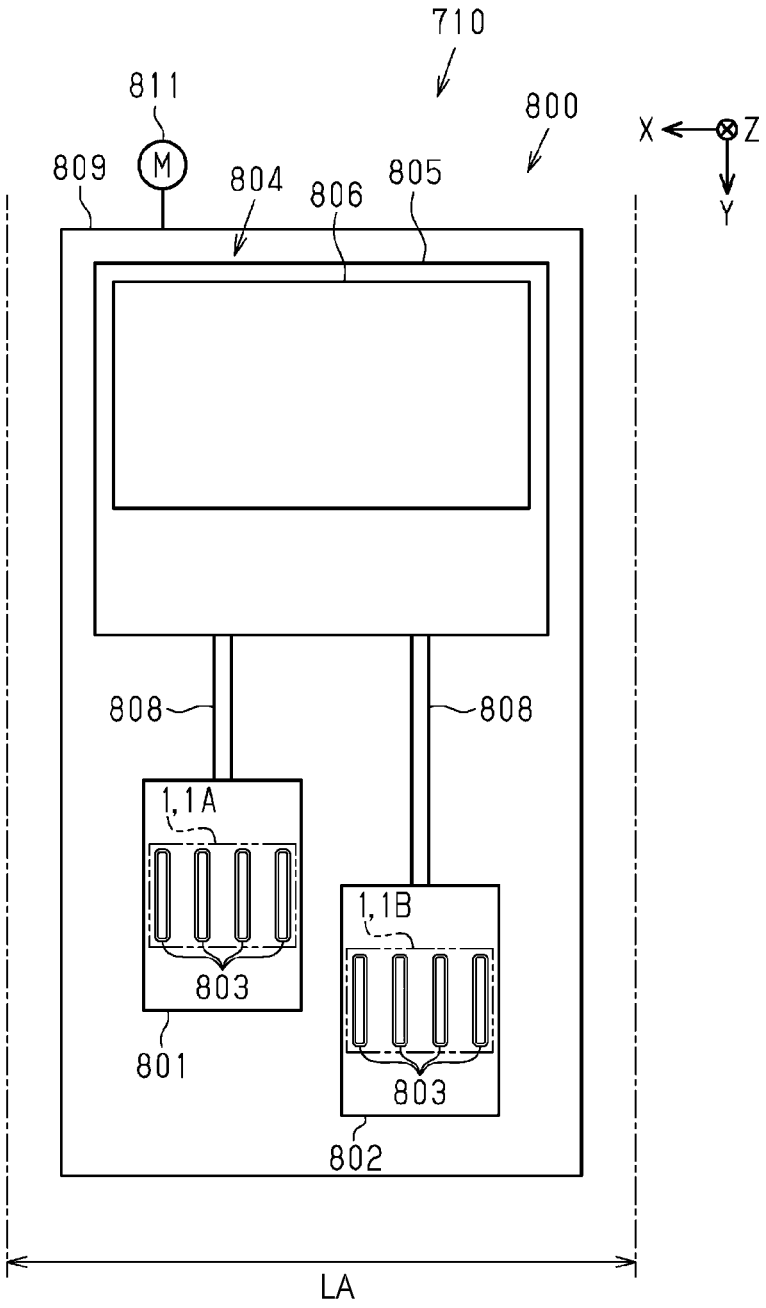
FIG. 16 is a plan view of a cap device of the liquid droplet ejecting apparatus in FIG. 1.

As illustrated in FIG. 16, the cap device 800 includes moisturizing cap portions 801 and 802 and a moisturizing liquid supply portion 804. The cap portions 801 and 802 contact the liquid droplet ejecting portions 1A and 1B so as to surround the opening of the nozzle 21 respectively when the liquid droplet ejecting portions 1A and 1B are stopped in the non-printing area LA. The maintenance that the cap portions 801 and 802 surround the opening of the nozzle 21 is referred to as moisturization capping. The moisturization capping is a kind of capping. Drying of the nozzle 21 is suppressed by the moisturization capping. The cap portions 801 and 802 each have four moisturizing caps 803. The four caps 803 are arranged in the X-axis direction corresponding to four nozzle groups of the liquid droplet ejecting portion 1.

The cap device 800 includes a connection flow path 808 that connects the cap 803 and a moisturizing liquid storage portion 805. In FIG. 16, one connection flow path 808 is illustrated in each of the cap portions 801 and 802. However, actually, four connection flow paths 808 are provided so as to correspond to the number of the cap 803. Therefore, a total of eight connection flow paths 808 extend from the moisturizing liquid storage portion 805.

The cap device 800 includes a holder 809 that holds the cap portions 801 and 802 and the moisturizing liquid storage portion 805, and a moisturizing motor 811 that moves the holder 809 vertically. When the holder 809 is moved vertically by the moisturizing motor 811, the cap 803 and the moisturizing liquid storage portion 805 move vertically. By this vertical movement, the cap 803 moves to the contact position at which the cap 803 contacts the liquid droplet ejecting portion 1 and the retreat position away from the liquid droplet ejecting portion 1.

Figure 17:
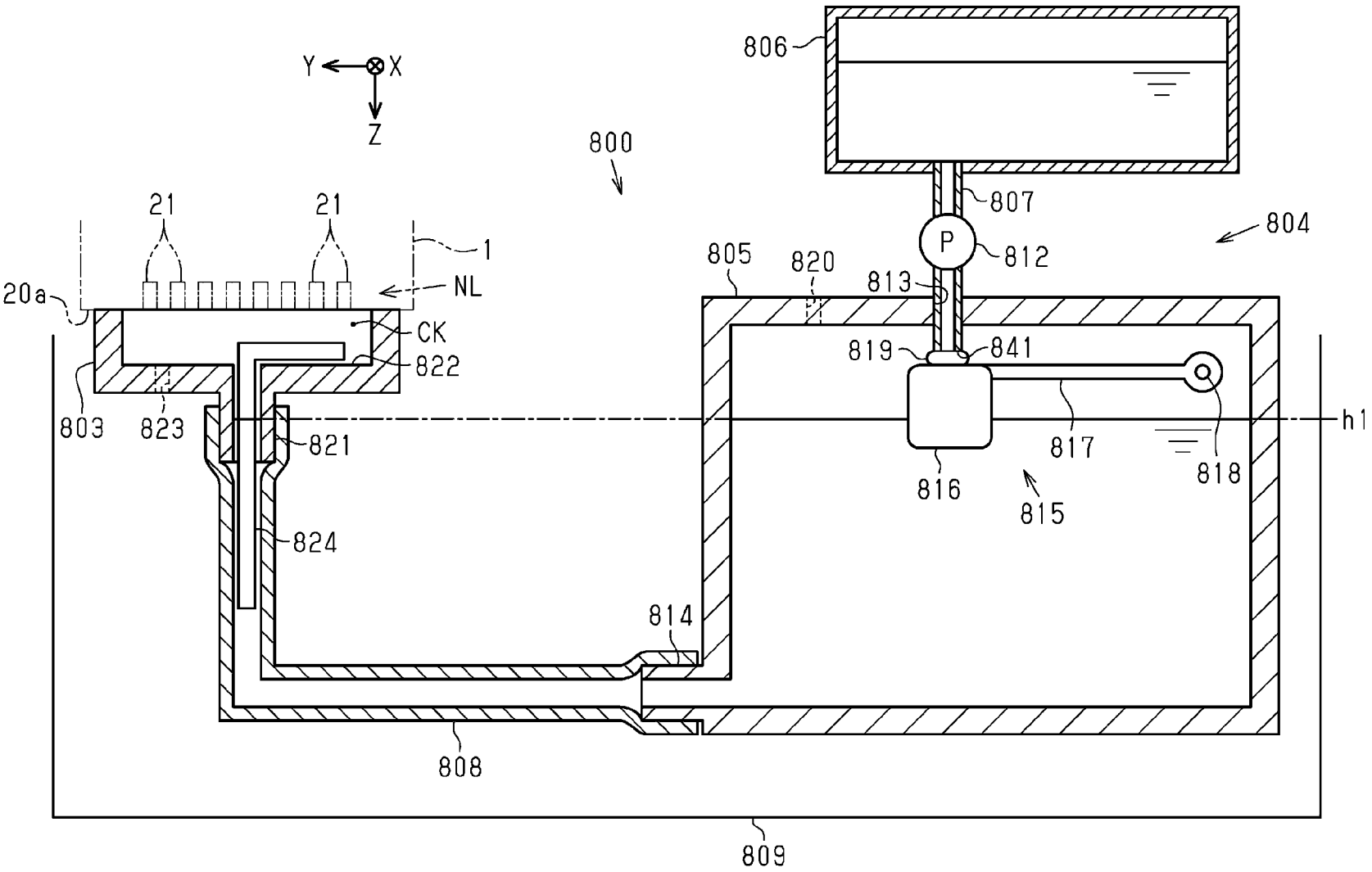
FIG. 17 is a cross-sectional view schematically illustrating a configuration of the cap device in FIG. 16.

As shown in FIG. 17, the cap 803 is positioned at the contact position to form a space CK in which the plurality of nozzles 21 are open. That is, the cap 803 is configured to make a capping state in which a space CK in which the plurality of nozzles 21 are open is formed and a non-capping state in which the cap is separated from the liquid droplet ejecting portion 1. The cap 803 is in the capping state when the cap is positioned at the contact position, and is in the non-capping state when the cap is positioned at the retract position.

The moisturizing liquid supply portion 804 includes a moisturizing liquid storage portion 805 for storing the moisturizing liquid, a moisturizing liquid accommodating portion 806 disposed above the moisturizing liquid storage portion 805, and a supply flow path 807 that connects the moisturizing liquid storage portion 805 and the moisturizing liquid accommodating portion 806. The supply flow path 807 is a flow path for supplying the moisturizing liquid from the moisturizing liquid accommodating portion 806 to the moisturizing liquid storage portion 805. The upstream end of the supply flow path 807 is coupled to the moisturizing liquid accommodating portion 806, and the downstream end thereof extends to be accommodated in the moisturizing liquid storage portion 805.

A hole 813 through which the supply flow path 807 passes is provided in the upper part of the moisturizing liquid storage portion 805. In the middle of the supply flow path 807, a moisturizing liquid pump 812 for sending the moisturizing liquid in the moisturizing liquid accommodating portion 806 toward the moisturizing liquid storage portion 805 is disposed. The moisturizing liquid pump 812 continues to send the moisturizing liquid with a constant pressure while the liquid droplet ejecting apparatus 700 is turned on.

The moisturizing liquid supply portion 804 is configured to replace the moisturizing liquid accommodating portion 806 by separately forming the moisturizing liquid storage portion 805, the moisturizing liquid accommodating portion 806, and the supply flow path 807. In this case, by replacing the moisturizing liquid accommodating portion 806, the moisturizing liquid can be replenished. The moisturizing liquid supply portion 804 may be configured by integrally forming the moisturizing liquid storage portion 805, the moisturizing liquid accommodating portion 806, and the supply flow path 807. In this case, it is preferable to provide a replenishing port for replenishing the moisturizing liquid to the moisturizing liquid accommodating portion 806.

A float 815 is accommodated in the moisturizing liquid storage portion 805. The float 815 includes a buoyant body 816 floating on the moisturizing liquid, an arm 817 having a buoyant body 816 fixed to a distal end thereof, a shaft 818 for rotatably holding the base end of the arm 817, and a valve portion 819 attached to an upper part of the buoyant body 816. The buoyant body 816 moves in the moisturizing liquid storage portion 805 so as to draw an arc around the shaft 818 as the liquid level of the moisturizing liquid changes.

When the liquid level of the moisturizing liquid in the moisturizing liquid storage portion 805 reaches a first position hl indicated by one-dot chain line in FIG. 17, due to the buoyancy of the buoyant body 816, the valve portion 819 is pushed to the downstream end 841 of the supply flow path 807. At this time, since the valve portion 819 closes the supply flow path 807, the supply of the moisturizing liquid from the moisturizing liquid accommodating portion 806 is stopped. When the liquid level of the moisturizing liquid in the moisturizing liquid storage portion 805 falls below the first position hl, the valve portion 819 separates from the downstream end 841 of the supply flow path 807. Therefore, the supply flow path 807 is open. In this manner, the moisturizing liquid supply portion 804 supplies the moisturizing liquid from the moisturizing liquid accommodating portion 806 such that the liquid level of the moisturizing liquid stored in the moisturizing liquid storage portion 805 is maintained at the first position hl.

The moisturizing liquid storage portion 805 includes a communicating portion 820 for allowing the interior of the moisturizing liquid storage portion 805 to communicate with the atmosphere. The communicating portion 820 is provided at the upper part of the moisturizing liquid storage portion 805. The communicating portion 820 is formed of an elongated hole which is extended to meander. The communicating portion 820 prevents the evaporated moisture liquid in the moisturizing liquid storage portion 805 from being released to the outside and is open the interior of the moisturizing liquid storage portion 805 to the atmosphere.

The moisturizing liquid storage portion 805 has a supply port 814 for supplying the stored moisturizing liquid toward the cap 803. The upstream end of the connection flow path 808 is coupled to the supply port 814 and the downstream end thereof is coupled to the cap 803. The moisturizing liquid stored in the moisturizing liquid storage portion 805 is supplied into the cap 803 via the connection flow path 808 due to a water head difference.

The cap 803 forms a space CK including the nozzle 21 in the moisturization capping. The cap 803 includes an inner bottom surface 822 of the cap 803 opposed to the nozzle 21 in the moisturization capping, an introduction port 821 opening to the inner bottom surface 822, and an atmosphere communicating portion 823. The downstream end of the connection flow path 808 is coupled to the introduction port 821. The atmosphere communicating portion 823 is provided on the inner bottom surface 822 of the cap 803 and opens the space CK formed by the moisturization capping to the atmosphere.

A capillary member 824 having a capillary force is disposed in a downstream portion in the connection flow path 808. The capillary member 824 of the present embodiment is formed of a thin cord-like member. A lower end portion of the capillary member 824 is disposed in the connection flow path 808, and an upper end portion thereof is disposed along the inner bottom surface 822 of the cap 803. The capillary member 824 of the present embodiment is provided so as to be bent to the side opposite to the side on which the atmosphere communicating portion 823 is provided on the inner bottom surface 822 of the cap 803. The capillary member 824 may be provided to be bent to the side opposite to the side on which the atmosphere communicating portion 823 is provided on the inner bottom surface 822 of the cap 803.

The capillary member 824 is, for example, a sponge-like member having open cells of several μm to several hundred μm. In order to form the capillary member 824, for example, a polyolefin such as EVA and polyethylene can be adopted. The capillary member 824 uses the capillary force of the capillary member 824 itself and supplies the moisturizing liquid toward the cap 803 via the inside of the capillary member 824. When the capillary member 824 has high liquid repellency, the capillary force generated in the gap between the surface of the capillary member 824 and the inner surface of the connection flow path 808 is used, and the capillary member 824 supplies the moisturizing liquid toward the cap 803 via the outside of the capillary member 824. In this case, air in the connection flow path 808 is discharged to the cap 803 side via the inside of the capillary member 824. When the capillary member 824 is disposed in the connection flow path 808, since the moisturizing liquid can be easily guided toward the cap 803, the moisturizing effect in the space CK is enhanced.

Figure 18:
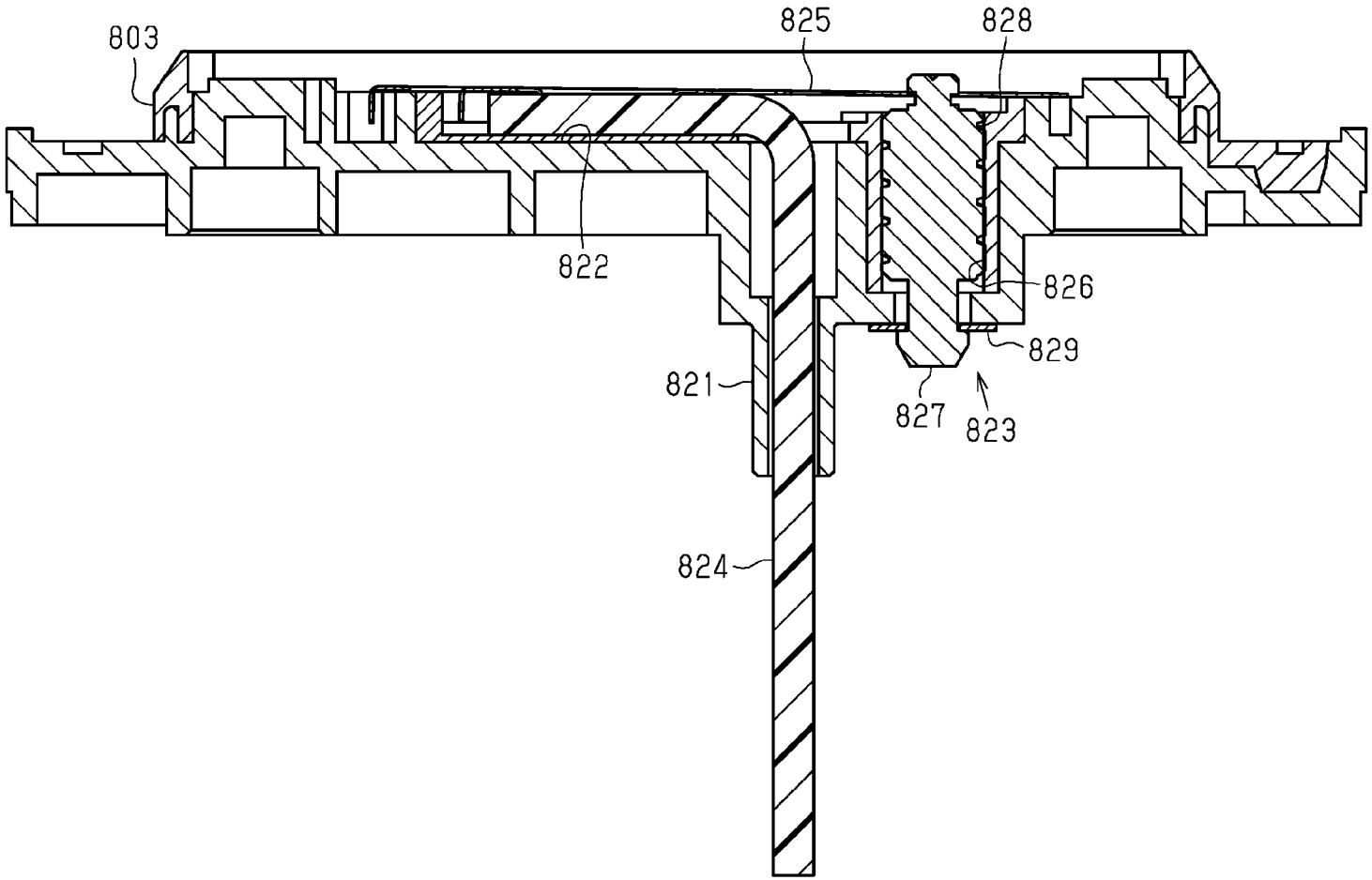
FIG. 18 is a cross-sectional view of a cap of the cap device in FIG. 17.
Figure 19:
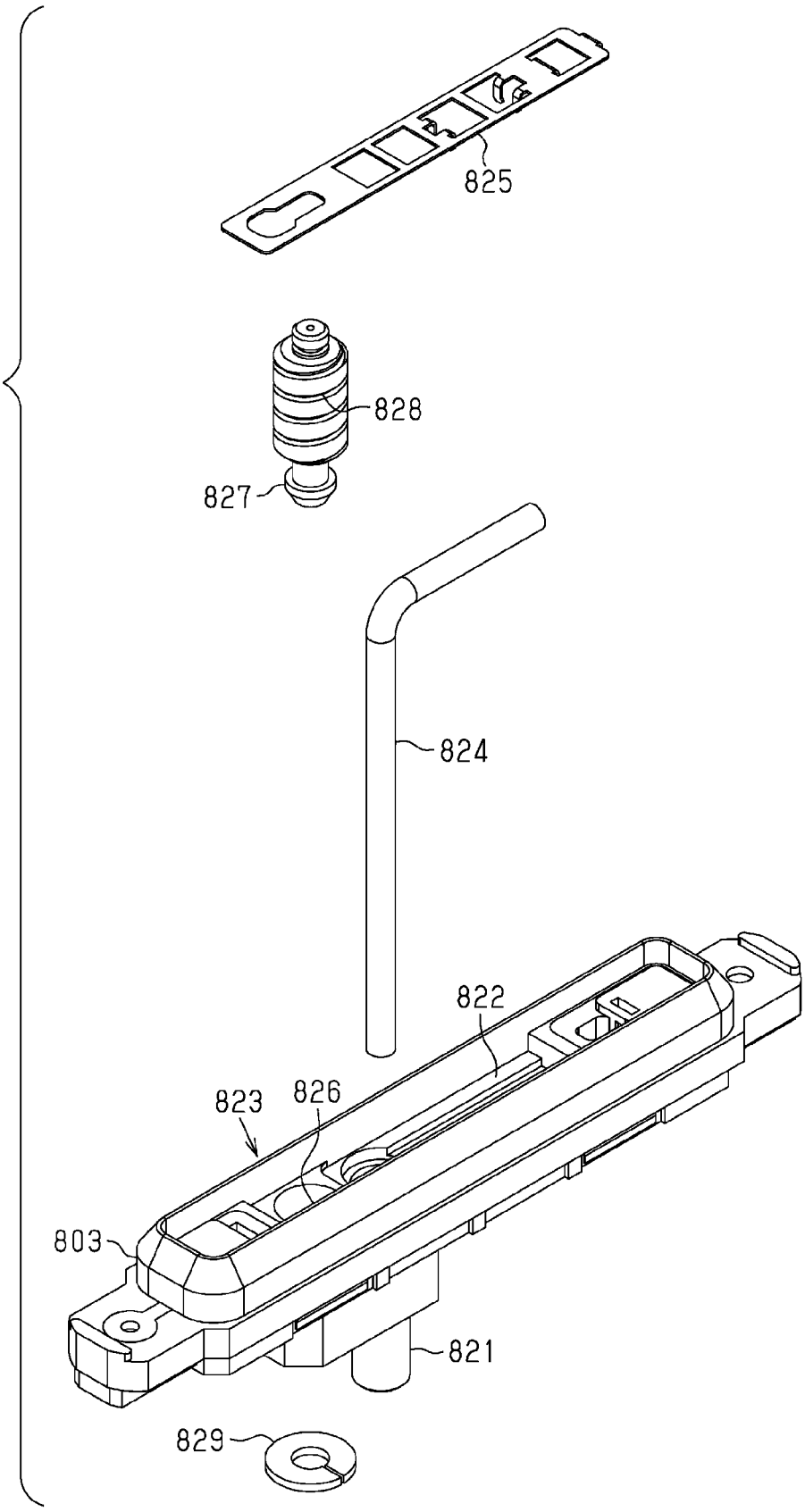
FIG. 19 is an exploded perspective view of the cap in FIG. 18.

As illustrated in FIGS. 18 and 19, a plate member 825 for pressing the capillary member 824 from above is arranged along the inner bottom surface 822 in the cap 803. When the capillary member 824 is pressed by the plate member 825, the capillary member 824 can be made to follow the inner bottom surface 822 of the cap 803.

The atmosphere communicating portion 823 may be configured by a through-hole 826 penetrating the inner bottom surface 822 and a pin 827 pressed into the through-hole 826. On the outer periphery of the pin 827, a narrow groove 828 extending in a spiral shape may be formed. The groove 828 forms a spiral gap between the inner peripheral surface of the through-hole 826 and the outer peripheral surface of the pin 827. The space CK can communicate with the atmosphere through the gap. A distal end positioned on the inner bottom surface 822 of the pin 827 may be pressed by the plate member 825. The base end of the pin 827 may be fastened by a washer 829. In the moisturization capping, the atmosphere communicating portion 823 opens the space CK of the cap 803 to the atmosphere while preventing the moisturizing liquid evaporated in the space CK from coming out to the outside in the spiral gap.

As illustrated in FIG. 17, the moisturizing liquid stored in the moisturizing liquid storage portion 805 is supplied toward the cap 803 due to the water head difference through the connection flow path 808. Therefore, the connection flow path 808 is filled with the moisturizing liquid to the same height as the liquid level of the moisturizing liquid in the moisturizing liquid storage portion 805. That is, the moisturizing liquid flows into the connection flow path 808 to the first position hl. The first position hl may be set such that the lower end portion of the capillary member 824 is immersed in the inflowing moisturizing liquid in the connection flow path 808.

The first position hl may be set to the position lower than the inner bottom surface 822 of the cap 803. In this way, the space CK is formed at a position higher than the first position hl. The moisturizing liquid that is flown to the first position hl in the connection flow path 808 is evaporated and the evaporated moisturizing liquid fills the space CK of the cap 803 to suppress the drying of the nozzle 21. When the liquid level of the moisturizing liquid is lowered by the evaporation, since the moisturizing liquid supply portion 804 supplies the moisturizing liquid, the moisturizing effect in the space CK is maintained.

It is preferable that the moisturizing liquid used in the cap device 800 is the same as the main solvent of the liquid used by the liquid droplet ejecting portion 1. For example, when the liquid used by the liquid droplet ejecting portion 1 is an aqueous resin ink, since the solvent is water, it is preferable to use pure water as the moisturizing liquid. When the solvent of the liquid used by liquid droplet ejecting portion 1 is a solvent, it is preferable to use the same solvent as the liquid as the moisturizing liquid. As the moisturizing liquid, a liquid containing a preservative in pure water may be used.

The preservative contained in the moisturizing liquid is preferably the same as the preservative contained in the liquid used by the liquid droplet ejecting portion 1. Examples of the preservative contained in the moisturizing liquid include aromatic halogen compounds, methylene dithiocyanate, halogen-containing nitrogen sulfur compounds, 1,2-benzisothiazolin-3-one and the like. The aromatic halogen compound is, for example, Preventol CMK. 1,2-benzisothiazolin-3-one is, for example, PROXELGXL. When PROXEL is used as a preservative from the viewpoint of poor foamability, it is preferable to set the content of the moisturizing liquid to 0.05% by mass or less.

Regarding Abnormality of Ejecting State Occuring in Capping State

In general, when the cap 803 is in the capping state, the space CK in which the plurality of nozzles 21 are open is formed to suppress the thickening of the liquid in the nozzles 21. However, when the function of the cap 803 is impaired for some reason, the thickening of the liquid in the nozzle 21 may not be suppressed even if the cap 803 is in a capping state. Therefore, when the cap 803 does not function properly, the abnormality may occur in the ejecting state of liquid droplet from the nozzle 21 in the capping state.

As described above, when the abnormality of the ejecting state occurs in the capping state, a malfunction of the cap 803 is suspected of causing the abnormality of the ejecting state. Therefore, when the abnormality of the ejecting state occurs in the capping state, the control portion 830 estimates that the malfunction of the cap 803 causes the abnormality of the ejecting state.

The malfunction of the cap 803 may occur, for example, due to the contamination of the cap 803 by the liquid. When the liquid used by the liquid droplet ejecting portion 1 adheres to the inside of the cap 803, the liquid contaminates the cap 803. In this state, when the cap 803 is in the capping state, the thickening of the liquid in the nozzle 21 may be promoted by the liquid adhered to the inside of the cap 803.

For example, glycerin contained in the liquid may absorb moisture in the nozzle 21 when the liquid adheres to the inside of the cap 803 in a case in which the liquid used in the liquid droplet ejecting portion 1 contains the glycerin as a humectant. Therefore, the thickening of the liquid in the nozzle 21 may be promoted in the capping state.

The malfunction of the cap 803 includes a case where the cap 803 is not in a normal capping state. When the cap 803 is not in the normal capping state, the space CK in which the plurality of nozzles 21 are open is not properly formed. For example, when a distal end of the cap 803 is damaged or the foreign matters or the thickened liquid is adhered, the cap 803 may not be in close contact with the liquid droplet ejecting portion 1 in the capping state. In this case, the space CK in the cap 803 is a space communicating with the atmosphere outside the cap 803. Therefore, when the cap 803 is not in the normal capping state, the thickening of the liquid in the nozzle 21 may not be suppressed.

In the present embodiment, for example, even when the atmosphere communicating portion 823 is broken, the cap 803 may not be in the normal capping state. When the atmosphere communicating portion 823 is broken, the moisturizing liquid evaporated in the space CK cannot be appropriately prevented from coming out to the outside, and the space CK in the cap 803 may not be appropriately moisturized. In this case, the thickening of the liquid in the nozzle 21 may not be suppressed. In the present embodiment, the thickening of the liquid in the nozzle 21 may not be suppressed also when the supply of the moisturizing liquid to the cap 803 is stopped.

Next, a relationship between the thickening of the liquid and the malfunction of the cap 803 will be described with reference to FIG. 20.

Figure 20:
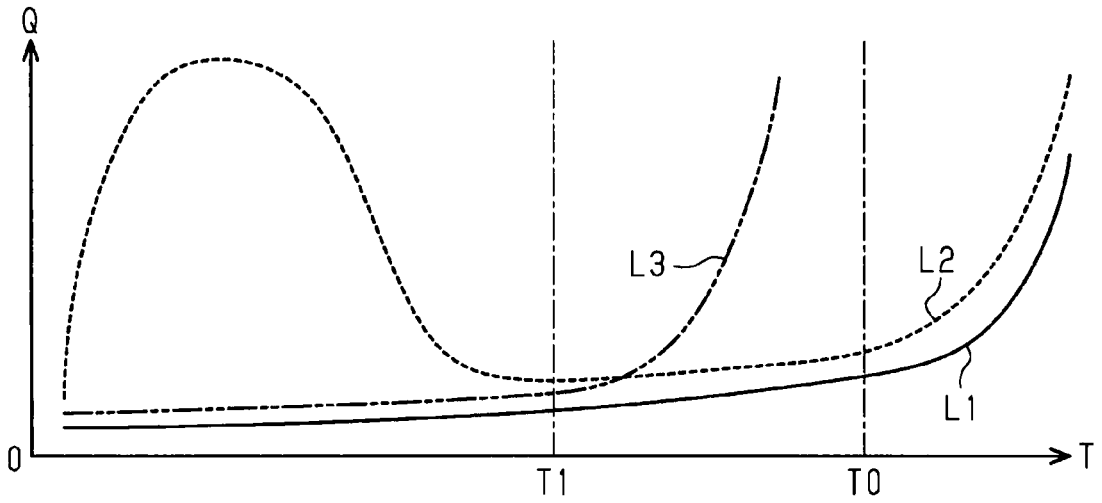
FIG. 20 is an explanatory view for illustrating a relationship between thickening of a liquid and a malfunction of a cap.

The vertical axis in FIG. 20 indicates the number Q of abnormal nozzles, which is the number of the abnormal nozzles in which the abnormality of the ejecting state occurs by the thickening of the liquid. The horizontal axis in FIG. 20 indicates an elapsed time T which is a time elapsed after the cap 803 is in the capping state. Graphs L1, L2 and L3 shown in FIG. 20 show changes in the number of the abnormal nozzles in time caused by the thickening of the liquid in the capping state.

The graph L1 is a graph when the malfunction of the cap 803 does not occur. The graphs L2 and L3 are graphs when the malfunction of the cap 803 occurs. The graph L2 is a graph when the cap 803 is contaminated by the liquid used by the liquid droplet ejecting portion 1. The graph L3 is a graph when the cap 803 is not in the normal capping state. In the graph L2, the cap 803 is in the normal capping state. In the graph L3, the cap 803 is not contaminated by the liquid.

In the graph L1, the number Q of the abnormal nozzles does not greatly fluctuate until the elapsed time T passes a predetermined time T0. This is because the thickening of the liquid in the nozzle 21 is suppressed by moisturization by the cap 803.

In the graph L1, the number Q of the abnormal nozzles rapidly increases when the elapsed time T passes the predetermined time T0. For example, even in the capping state, since the thickening of the liquid in the nozzles 21 cannot be completely prevented, the number Q of the abnormal nozzles starts to increase rapidly when the elapsed time T passes the predetermined time T0.

In the graph L2, the number Q of the abnormal nozzles rapidly increases immediately after being in the capping state. This is because the thickening of the liquid in the nozzle 21 is promoted by the liquid adhering to the inside of the cap 803.

In the graph L2, the number Q of the abnormal nozzles rapidly increases immediately after being in the capping state, and then decreases rapidly before the elapsed time T passes the predetermined time T0. The reason why the number Q of the abnormal nozzles rapidly increases and then decreases rapidly is that the thickened liquid in the nozzle 21 returns to the state of being wet again by the liquid, for example, in the pressure chamber 12 and the liquid in the common liquid chamber 100.

In the graph L2, the number Q of the abnormal nozzles increases in the same manner as the graph L1 when the elapsed time T passes the predetermined time T0. Therefore, it can be estimated that the abnormality of the nozzle occurs as time elapses when the elapsed time T is equal to or more than the predetermined time T0 in a case in which the abnormal nozzle due to the thickening of the liquid occurs in the capping state.

In the graph L3, the number Q of the abnormal nozzles rapidly increases before the elapsed time T passes the predetermined time T0. When the cap 803 is not in the normal capping state, the space CK in the cap 803 is not appropriately moisturized. Therefore, the thickening of the liquid in the nozzle 21 is promoted even before the elapsed time T passes the predetermined time T0.

In the graph L2 and the graph L3, timing when the number Q of the abnormal nozzles starts to increase rapidly differs. The number Q of the abnormal nozzles in the graph L2 fluctuates to rapidly increase and then rapidly decrease before the number Q of the abnormal nozzles in the graph L3 rapidly increases. That is, the timing when the number Q of the abnormal nozzles starts to increase is earlier in a case in which the cap 803 is contaminated by the liquid than in a case in which the cap 803 is not in the normal capping state. Therefore, when the abnormality of the ejecting state occurs in the capping state, a cause of the abnormal nozzle can be specified according to the timing when the number Q of the abnormal nozzles increases rapidly.

For example, a set time T1 may be set between the timing when the number Q of the abnormal nozzles starts to increase rapidly in the graph L2 and the timing when the number Q of the abnormal nozzles starts to increase rapidly in the graph L3. In this way, it can be estimated that the abnormality of the nozzle occurs due to the contamination of the cap 803 by the liquid when the elapsed time T is less than the set time T1 in a case in which the abnormality of the nozzle due to the thickening of the liquid occurs in the capping state. It can be estimated that since the cap 803 is not in the normal capping state, the abnormality of the nozzle occurs when the elapsed time T is equal to or more than the set time T1 in a case in which the abnormality of the nozzle due to the thickening of the liquid occurs in the capping state.

Regarding Operation when Abnormality of Ejecting State Occurs in Capping State

The control portion 830 causes the notification portion 703 to perform a display corresponding to the malfunction of the cap 803 when the control portion 830 estimates that the malfunction of the cap 803 causes the abnormality of the ejecting state. In this way, based on the display corresponding to the malfunction of the cap 803, appropriate measures can be taken to eliminate the malfunction of the cap 803. Therefore, appropriate maintenance can be performed with respect to the thickening of the liquid. At this time, the display corresponding to the malfunction of the cap 803 may be performed on an external terminal such as the computer 160 coupled to the liquid droplet ejecting apparatus 700. In this case, the external terminal coupled to the liquid droplet ejecting apparatus 700 functions as the notification portion that performs the display corresponding to the malfunction of the cap 803.

The control portion 830 may cause the notification portion 703 to perform a display, for example, to urge the user to clean the cap 803 when the control portion 830 can estimate that a cause of the abnormality of the ejecting state is the contamination of the cap 803 by the liquid. By cleaning the cap 803, the malfunction of the cap 803 due to the contamination of the liquid can be eliminated.

The control portion 830 may cause the notification portion 703 to perform a display, for example, to urge the user to replace the cap 803 when the control portion 830 can estimate that the malfunction of the cap 803, which is not recovered by cleaning the cap 803, causes the abnormality of the ejecting state. By replacing the cap 803, the malfunction of the cap 803 can be eliminated. The malfunction of the cap 803 which is not recovered by cleaning the cap 803 is, for example, a case where the cap 803 is not in the normal capping state.

The control portion 830 performs maintenance such as flushing and suction cleaning in order to recover the ejecting state of the nozzle 21 when the abnormality of the nozzle occurs due to the thickening of the liquid. When the malfunction of the cap 803 occurs, occurrence frequency of the abnormality of the nozzle caused by the thickening of the liquid increases. Therefore, when the abnormality of the ejecting state occurs in the capping state, it is estimated that a cause thereof is the malfunction of the cap 803, and frequency of the maintenance can be reduced by causing the notification portion 703 to perform the display corresponding to the malfunction of the cap 803. Therefore, consumption of the liquid can be reduced.

The control portion 830 may estimate that the contamination of the cap 803 by the liquid causes the abnormality of the ejecting state when the elapsed time Tin the capping state is less than the set time T1 in a case in which the abnormality of the ejecting state occurs in the capping state. In this way, appropriate measures can be taken to eliminate the contamination of the cap 803 by the liquid.

The control portion 830 may cause the notification portion 703 to perform the display to urge the user to clean the cap 803 when the control portion 830 estimates that a cause of the abnormality of the ejecting state is the contamination of the cap 803 by the liquid. In this way, for example, the user can be urged to clean the cap 803. Accordingly, the contamination of the cap 803 by the liquid can be eliminated. Therefore, appropriate maintenance can be performed with respect to the thickening of the liquid.

The control portion 830 may estimates that the malfunction of the cap 803, which is not recovered by cleaning the cap 803, causes the abnormality of the ejecting state when the elapsed time T in the capping state is equal to or more than the set time T1 in a case in which the abnormality of the ejecting state occurs in the capping state. In this way, appropriate measures can be taken to eliminate the malfunction of the cap 803 which is not recovered by cleaning the cap 803.

The control portion 830 may cause the notification portion 703 to perform the display to urge the user to replace the cap 803 when the control portion 830 estimates that the malfunction of the cap 803, which is not recovered by cleaning the cap 803, causes the abnormality of the ejecting state. In this way, for example, the user can be urged to clean the cap 803. Accordingly, the malfunction of the cap 803 which is not recovered by cleaning the cap 803 can be eliminated. Therefore, appropriate maintenance can be performed with respect to the thickening of the liquid.

When the control portion 830 estimates that the malfunction of the cap 803, which is not recovered by cleaning the cap 803, causes the abnormality of the ejecting state, the control portion 830 may cause the notification portion 703 to perform the display to urge the user to clean the cap 803 and then, when the abnormality of the ejecting state occurs in the capping state, the control portion 830 may estimate that the malfunction of the cap 803 causes the abnormality of the ejecting state and cause the notification portion 703 to perform a display to urge the user to replace the cap 803. In this case, even when a cause of the abnormality of the ejecting state is the malfunction of the cap 803 which is not recovered by cleaning of the cap 803, the cleaning of the cap 803 is performed once. When the malfunction of the cap 803 is eliminated by cleaning the cap 803, the cap 803 can be used continuously. Therefore, replacement frequency of the cap 803 can be reduced.

The control portion 830 may estimate a cause of the abnormality of the ejecting state based on the abnormality of the ejecting state detected by the detection portion 156 in timing when the cap 803 is switched from the capping state to the non-capping state. In this way, it can be appropriately estimated whether or not the abnormality of the ejecting state occurs in the capping state.

When the abnormality of the ejecting state caused by the thickening of the liquid occurs in two or more of the nozzles 21 in the capping state, the control portion 830 may estimate that the malfunction of the cap 803 causes the abnormality of the ejecting state. Since a plurality of nozzles 21 are provided, even if the malfunction of the cap 803 does not occur, the abnormality of the ejecting state caused by the thickening of the liquid in the capping state may occur in some of the nozzles 21. Therefore, when the abnormality of the ejecting state caused by the thickening of the liquid occurs in only one of the nozzles 21 in the capping state, it is highly possible that the malfunction of the cap 803 does not cause the abnormality of the ejecting state. Accordingly, when the abnormality of the ejecting state caused by the thickening of the liquid occurs in two or more of the nozzles 21 in the capping state, the malfunction of the cap 803 is appropriately estimated by estimation that the malfunction of the cap 803 causes the abnormality of the ejecting state.

Regarding Estimating Process

Next, an estimating process which is an example of a maintenance method for maintaining the liquid droplet ejecting apparatus 700 will be described with reference to FIG. 21. The estimating process is performed immediately after the cap 803 is switched from the capping state to the non-capping state.

Figure 21:
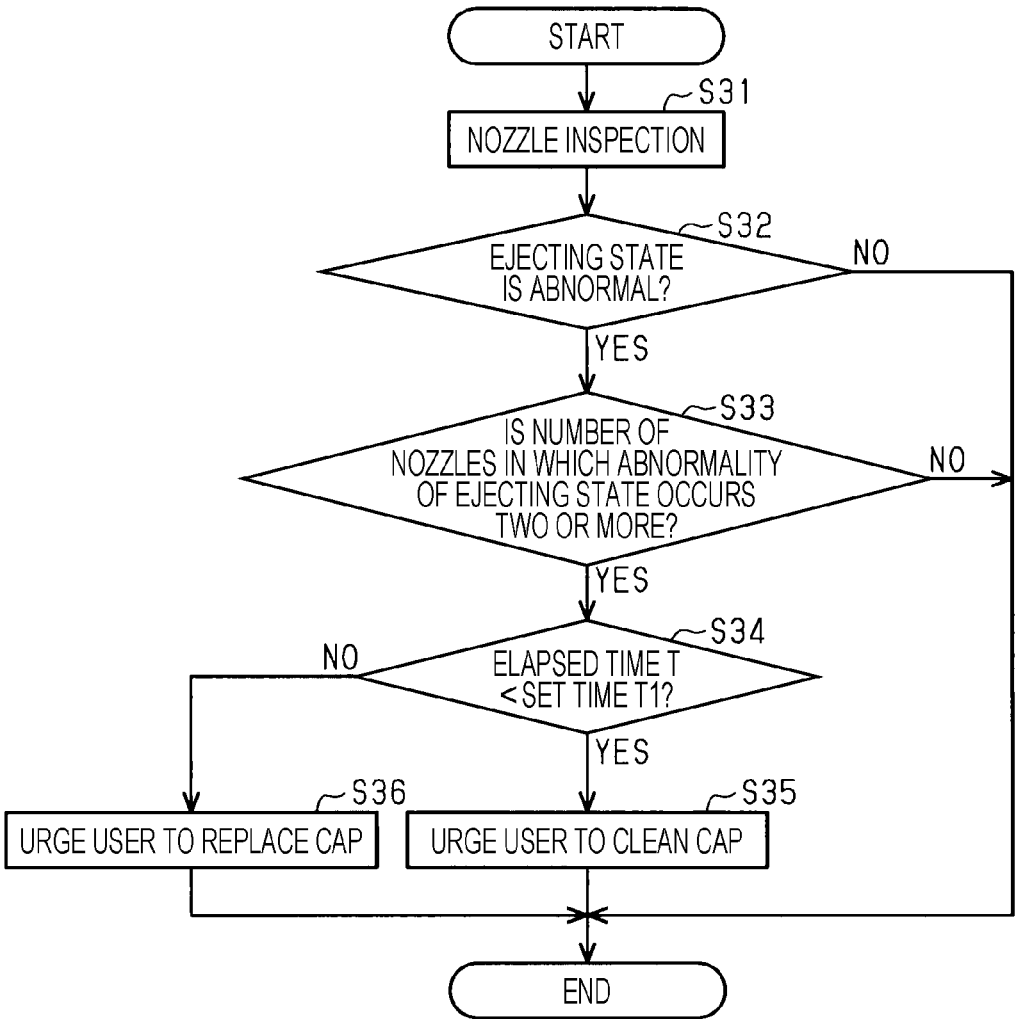
FIG. 21 is a flowchart illustrating an example of an estimating process.

As shown in FIG. 21, in step S31, the control portion 830 that performs the estimating process performs the nozzle inspection. At this time, the control portion 830 may vibrate the pressure chamber 12 to the extent that the liquid is not ejected from the nozzle 21, or may vibrate the pressure chamber 12 to the extent that the liquid is ejected from the nozzle 21.

In step S32, the control portion 830 estimates whether the abnormality of the ejecting state occurs. At this time, based on the vibration waveform detected by the detection portion 156 in step S31, the control portion 830 estimates whether or not the abnormality of the ejecting state caused by the thickening of the liquid occurs. In step S32, when the control portion 830 estimates that there is not the abnormality of the ejecting state, the estimating process ends. In step S32, when the control portion 830 estimates that there is the abnormality of the ejecting state, the process proceeds to step S33.

The process in step S31 is performed immediately after the cap 803 is switched from the capping state to the non-capping state. Therefore, when the control portion 830 estimates that the abnormality of the ejecting state occurs in step S32, the control portion 830 estimates that the abnormality of the ejecting state occurs in the capping state.

In step S33, the control portion 830 estimates whether or not the abnormality of the ejecting state occurs in two or more of the nozzles 21. At this time, based on the vibration waveform detected by the detection portion 156 in step S31, the control portion 830 estimates whether or not the abnormality of the ejecting state caused by the thickening of the liquid occurs in two or more of the nozzles 21. In step S33, when the abnormality of the ejecting state occurs in one nozzle 21, the control portion 830 estimates that the malfunction of the cap 803 does not occur, and the estimating process ends. In step S33, when the abnormality of the ejecting state occurs in two or more of the nozzles 21, the control portion 830 estimates that the malfunction of the cap 803 occurs, and the process proceeds to step S34.

In step S34, the control portion 830 estimates whether or not the elapsed time T is less than the set time T1. At this time, the control portion 830 compares the elapsed time T from a time when the cap 803 becomes in the capping state to a time when cap 803 becomes in the non-capping state, with the set time T1 which is set in advance. When the cap 803 is switched from the non-capping state to the capping state, the control portion 830 of the present embodiment resets the elapsed time T and starts measurement.

In step S34, when the elapsed time T is less than the set time T1, the control portion 830 estimates that the contamination of the cap 803 causes the abnormality of the ejecting state, and the process proceeds to step S35. In step S34, when the elapsed time T is not less than the set time T1, that is, when the elapsed time T is equal to or more than the set time T1, the control portion 830 estimates that the malfunction of the cap 803, which is not recovered by cleaning the cap 803, causes the abnormality of the ejecting state, and the process proceeds to step S36.

In step S35, the control portion 830 urges the user to clean the cap 803. At this time, the control portion 830 causes the notification portion 703 to perform the display to urge the user to clean the cap 803. When the cleaning of the cap 803 is completed, the control portion 830 ends the estimating process.

When the elapsed time T is equal to or more than the set time T1 in step S34, the control portion 830 urges the user to replace the cap 803 in step S36. At this time, the control portion 830 causes the notification portion 703 to perform the display to urge the user to replace the cap 803. When the replacement of the cap 803 is completed, the control portion 830 ends the estimating process.

In step S36, the control portion 830 may urge the user to clean the cap 803. In this way, even when the malfunction of the cap 803 which is not recovered by cleaning the cap 803 is estimated, the user is made to clean the cap 803. After the cap 803 is cleaned, when the abnormality of the ejecting state occurs again in the next estimating process, that is, when it is expected that the malfunction of the cap 803 will not be eliminated even if the cap 803 is cleaned, the user may be urged to replace the cap 803. In this way, the replacement frequency of the cap 803 can be reduced.

The estimating process may be performed in the capping state. The control portion 830 may estimate whether or not the abnormality of the ejecting state occurs in the capping state by performing the nozzle inspection in the capping state. In this case, a degree of progress of the thickening of the liquid can be grasped by periodically performing the nozzle inspection in the capping state. The control portion 830 may estimate the whether the abnormality of the ejecting state occurs based on the degree of progress in the thickening of the liquid. For example, when the progress of the thickening of the liquid is faster than usual in the capping state, the malfunction of the cap 803 is suspected.

Regarding Nozzle Inspection in Moisturization Capping

The moisturization capping is performed to suppress the drying of the nozzle 21 when the nozzle is not used, but the drying of the nozzle 21 cannot be completely prevented. When the foreign matters such as waste adhere to the distal end of the cap 803 and are not in close contact with the liquid droplet ejecting portion 1 at the time of capping, the nozzle 21 is easy to be dried.

When the moisturization capping time is lengthened, the liquid may be thickened by the evaporation of the solvent component of the liquid or pigment component may be precipitated. Therefore, the ejecting failure may occur in printing after the moisturization capping. The control portion 830 may perform the nozzle inspection at predetermined intervals in moisturization capping. In the nozzle inspection, when the cap 803 is in the capping state, the detection portion 156 detects the state in the pressure chamber 12. In the nozzle inspection in moisturization capping, the pressure chamber 12 may be vibrated to the extent that the liquid is not ejected from the nozzle 21, and the residual vibration may be detected.

While the moisturizing capping is continued, the actuator 130 is driven at regular time intervals, and the detection portion 156 may detect a driving waveform of the residual vibration of the pressure chamber 12 each time. In this way, appropriate measures can be taken according to the degree of progress of the thickening of the liquid.

The control portion 830 may estimate the degree of progress of the thickening of the liquid in the pressure chamber 12 by comparing the driving waveforms of the pressure chambers 12, which are detected at time intervals in the capping state. For example, the degree of progress of the thickening can be calculated, in a state where a viscosity of the liquid when the normal moisturization capping is performed for a certain period is set as a reference value, as a ratio to the reference value, that is, a viscosity ratio. For example, in the viscosity of liquid when the normal moisturization capping is performed for a certain time, the viscosity ratio is 1.0.

When the detection portion 156 detects that the state in the pressure chamber 12 is not normal in moisturization capping, that is, the abnormality of the ejecting state occurs in the capping state, the control portion 830 may perform the maintenance of the liquid droplet ejecting portion 1. In this case, the control portion 830 may select a type of the maintenance of the liquid droplet ejecting portion 1 according to the degree of the thickening of the liquid.

For example, when the result of estimating the progress of thickening exceeds a first reference set as the degree of progress, the maintenance of the liquid droplet ejecting portion 1 may be performed by discharging the liquid discharged from the nozzle 21. In this case, by detecting that the state in the pressure chamber 12 is not normal and maintaining the liquid droplet ejecting portion 1 before the state deteriorates, it is possible to maintain the liquid droplet ejecting portion 1 in a satisfactory state. The control portion 830 can maintain the liquid droplet ejecting portion 1 according to the degree of thickening of the liquid by estimating the degree of progress of the thickening.

In the first reference, the nozzle 21 in which the state of the pressure chamber 12 is not normal is present, but the degree is not severe. The liquid discharge may be changed according to a cause of an ejecting failure or degree of the failure. For example, if it is a minor failure, flushing, which ejects the liquid droplet from the nozzle 21, is performed by driving the actuator 130, and suction cleaning is performed if it is a moderate failure.

When the result of estimating the progress of the thickening does not exceed the first reference set as the degree of progress, for example, by driving the actuator 130, the pressure chamber 12 may be vibrated to the extent that the liquid is not ejected from the nozzle 21. The maintenance which slightly vibrates the pressure chamber 12 is called a micro-vibration. When the liquid droplet ejecting portion 1 is maintained by the micro-vibration, the actuator 130 may be driven a plurality of times with a single micro-vibration. When the pigment component is precipitated in the nozzle 21, the precipitated pigment component can be agitated by the micro-vibration. When the micro-vibration is employed as the maintenance, the liquid droplet ejecting portion 1 can be maintained without discharging the liquid.

When the result of estimating the progress of the thickening exceeds a second reference in which the thickening is increased more than the first reference, the control portion 830 may estimate that the state of the cap 803 is abnormal, that is, the malfunction of the cap 803 occurs. The abnormal state exceeding the second reference corresponds to a case where there are many nozzles 21 in which the state of the pressure chamber 12 is abnormal, a case where the thickening proceeds in a short time, or the like.

For example, when the supply of the moisturizing liquid to the inside of the cap 803 stops due to some factors, the drying of the nozzle 21 may occur suddenly thereafter. When the liquid contains glycerin as a humectant, when the liquid droplet falls into the cap 803, the glycerin contained in the liquid droplet absorbs moisture in the nozzle 21 to promote the drying of the nozzle 21.

When such an abnormality occurs in the cap 803, the thickening will excessively proceed, and recovery is difficult even if normal maintenance is repeated. In such a case, for example, the control portion 830 may notify the user of the abnormality by displaying the fact that an abnormality occurs on the notification portion 703. In this manner, the user can grasp that the thickening proceeds to the second reference, and take appropriate measures such as the cleaning of the cap 803, the replenishing of the moisturizing liquid, and the replacement of the cap 803. When the occurrence of the abnormality is displayed on the notification portion 703, the display may be performed together with a countermeasure corresponding to a conceivable factor or a factor. The countermeasure is, for example, the cleaning of the cap 803, confirmation of the remaining amount of the moisturizing liquid, or inspection of the cap 803.

Figure 22:
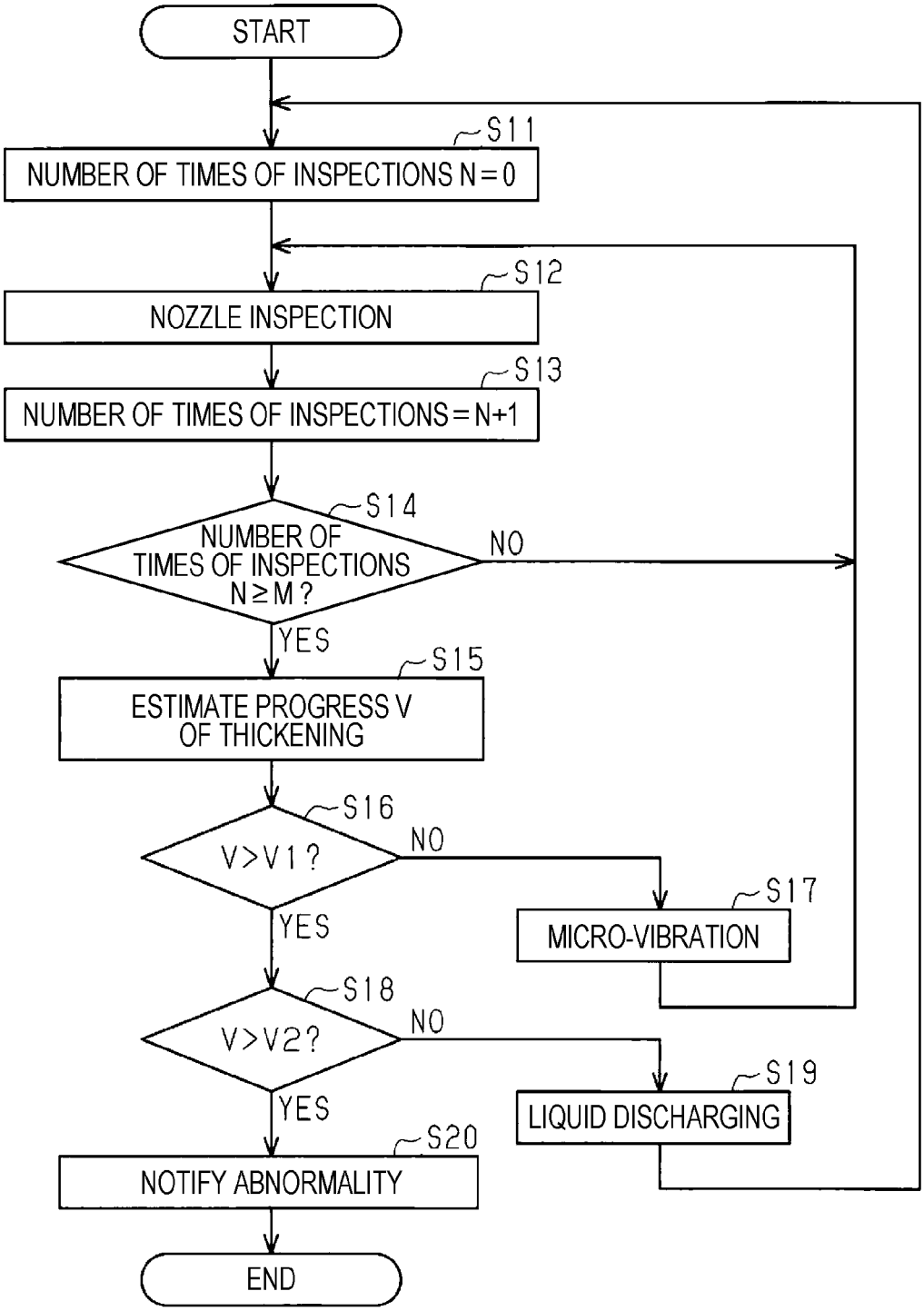
FIG. 22 is a flowchart of control performed by the liquid droplet ejecting apparatus in FIG. 1 in moisturization capping.

FIG. 22 illustrates an example of a process for the nozzle inspection performed by the control portion 830 in moisturization capping.

As illustrated in FIG. 22, when the moisturization capping is started, the control portion 830 resets the number of times of the nozzle inspections in step S11. The control portion 830 performs the nozzle inspection in step S12. In the nozzle inspection, the actuator 130 is driven and the detection portion 156 detects the driving waveform of the residual vibration of the pressure chamber 12.

The control portion 830 adds one to the number of times of the nozzle inspections N in step S13. In step S14, the control portion 830 estimates whether or not the number of times of the inspections N is equal to or more than M which is a specified number of times. When the number of times of the inspections N is less than M in step S14, the control portion 830 returns to step S12 and performs the next nozzle inspection. When the number of times of inspections N reaches M or more in step S14, the process of the control portion 830 proceeds to step S15.

The control portion 830 estimates the progress V of the thickening in step S15. In step S16, the control portion 830 estimates whether or not the progress V of the thickening exceeds the first reference V1. When the progress V of the thickening does not exceed the first reference V1 in step S16, the process of the control portion 830 proceeds to step S17. The control portion 830 performs the micro-vibration as a simple maintenance in step S17 and returns to step S12.

When the progress V of the thickening exceeds the first reference V1 in step S16, the process of the control portion 830 proceeds to step S18. In step S18, the control portion 830 estimates whether or not the progress V of the thickening exceeds the second reference V2. When the progress V of the thickening does not exceed the second reference V2 in step S18, the process of the control portion 830 proceeds to step S19.

The control portion 830 performs maintenance by discharging the liquid, for example, suction cleaning in step S19, and returns to step S11. Thereafter, the control portion 830 resets the number of times of the inspections in step S11, and the process proceeds to step S12 to perform the next nozzle inspection.

When the progress V of the thickening exceeds the second reference V2 in step S18, the control portion 830 estimates that the state of the cap 803 is abnormal, and the process proceeds to step S20. The control portion 830 notifies the user that the state of the cap 803 is abnormal in step S20, and the process ends. When the abnormality of the cap 803 does not occur, the process ends as the moisturization capping ends.

When the micro-vibration is repeated in moisturizing capping, the solvent component in the nozzle 21 may be evaporated by vibrating the gas-liquid interface in the nozzle 21. Particularly when the humidity of the space CK is low, evaporation due to the vibration of the gas-liquid interface is easy to occur. When, after the detection portion 156 performs the detection, the micro-vibration is performed until the next detection is performed, and thus the thickening of the liquid in the pressure chamber 12 proceeds faster than when the micro-vibration is not performed until the next detection is performed, the subsequent micro-vibration may be performed by reducing the driving energy of the actuator 130. Therefore, it possible to suppress the progress of the thickening due to the micro-vibration.

For example, the control portion 830 performs M times of the nozzle inspection at regular intervals without performing the micro-vibration at the regular intervals after the moisturization capping is started, as a negative control, and stores the degree Vn of progress of the thickening in the meantime. Thereafter, the control portion 830 performs M times of the nozzle inspections at regular intervals as a positive control while the micro-vibration is performed at the regular intervals, and stores the degree Vy of progress of the thickening in the meantime. When the degree Vy of progress of the thickening in the positive control is significantly faster than the degree Vn of progress of the thickening in the negative control, it is suspected that the evaporation of the solvent is promoted by the micro-vibration. Therefore, in this case, in order to reduce the adverse effect of the micro-vibration, the driving energy of the actuator 130 at the time of the micro-vibration thereafter is reduced. M is a positive integer.

As a variation of reducing the driving energy of the actuator 130 when performing the micro-vibration, for example, amplitude of the vibration may be reduced, the number of times of driving with one time of the micro-vibration may be reduced, and the time interval at which the micro-vibration is performed may be lengthened.

When the adverse effect of the micro-vibration is large and when the thickening proceeds even if the driving energy of the actuator 130 is made small, the subsequent micro-vibration may not be performed. Therefore, it possible to prevent the progress of the thickening due to the micro-vibration. Also, in this case, the inside of the nozzle 21 is agitated by vibrating the pressure chamber 12 for the nozzle inspection.

In the liquid droplet ejecting apparatus 700, since the nozzle inspection is performed in moisturization capping, even when the moisturization capping performs for a long time, the abnormality occurring in the pressure chamber 12 can be detected and the liquid droplet ejecting portion 1 can be appropriately maintained. In addition, even when some of the abnormality occurs in the cap device 800 and the thickening proceeds to the extent that it cannot be recovered by the maintenance, it can be detected and notified to the user. Therefore, consumption of the liquid due to wasteful maintenance can be avoided.

As described above, according to the above embodiment, it is possible to take measures to stabilize the ejecting of the liquid droplet from the nozzle 21 based on the state in the pressure chamber 12. Therefore, ejecting failure after capping can be suppressed, and a state in which the liquid droplet can be ejected satisfactorily can be maintained.

Next, the operation and effects of the above embodiment will be described.

(1) The control portion 830 causes the notification portion 703 to perform a display corresponding to the malfunction of the cap 803 when the control portion 830 estimates that the malfunction of the cap 803 causes the abnormality of the ejecting state. When the abnormality of the ejecting state occurs in the capping state, the malfunction of the cap 803 is suspected of causing the abnormality of the ejecting state. According to the above embodiment, based on the display corresponding to the malfunction of the cap 803, appropriate measures can be taken to eliminate the malfunction of the cap 803. Therefore, appropriate maintenance can be performed with respect to the thickening of the liquid.

(2) The control portion 830 estimates that the contamination of the cap 803 by the liquids causes the abnormality of the ejecting state when the elapsed time T in the capping state is less than the set time T1 in a case in which the abnormality of the ejecting state occurs in the capping state. When the abnormality of the ejection state occurs in the capping state even if the elapsed time T in the capping state is less than the set time T1, the contamination of the cap 803 by the liquid is suspected of causing the malfunction of the cap 803. When the cap 803 is contaminated by the liquid, the liquid may adsorb the solvent of the liquid in the nozzle 21. Therefore, the thickening of the liquid in the nozzle 21 is promoted. According to the above embodiment, appropriate measures can be taken to eliminate the contamination of the cap 803 by the liquid.

(3) The control portion 830 causes the notification portion 703 to perform the display to urge a user to clean the cap 803 when the control portion 830 estimates that the contamination of the cap 803 by the liquids causes the abnormality of the ejecting state. Accordingly, the contamination of the cap 803 by the liquid can be eliminated. Therefore, appropriate maintenance can be performed with respect to the thickening of the liquid.

(4) The control portion 830 estimate that the malfunction of the cap 803, which is not recovered by cleaning of the cap 803, causes the abnormality of the ejecting state when the elapsed time T in the capping state is equal to or more than the set time T1 in the case in which the abnormality of the ejecting state occurs in the capping state. It is suspected that the cap 803 is not in the normal capping state when the elapsed time T in the capping state is equal to or more than the set time T1 in the case in which the abnormality of the ejection state occurs in the capping state. The malfunction of the cap 803 is not recovered by cleaning of the cap 803 when the cap 803 is not in the normal capping state. According to the above embodiment, appropriate measures can be taken to eliminate the malfunction of the cap 803 which is not recovered by cleaning of the cap 803.

(5) The control portion 830 causes the notification portion 703 to perform the display to urge the user to replace the cap 803 when the control portion 830 estimates that the malfunction of the cap 803, which is not recovered by the cleaning of the cap 803, causes the abnormality of the ejecting state. Accordingly, the malfunction of the cap 803 which is not recovered by the cleaning of the cap 803 can be eliminated. Therefore, appropriate maintenance can be performed with respect to the thickening of the liquid.

(6) When the control portion 830 estimates that the malfunction of the cap 803, which is not recovered by the cleaning of the cap 803, causes the abnormality of the ejecting state, the control portion 830 causes the notification portion 703 to perform the display to urge the user to clean the cap 803, and when the abnormality of the ejecting state occurs in the capping state after the display, the control portion 830 estimates that the malfunction of the cap 803 causes the abnormality of the ejecting state and causes the notification portion 703 to perform a display to urge the user to replace the cap 803. In this case, even when the malfunction of the cap 803, which is not recovered by the cleaning of the cap 803, causes the abnormality of the ejecting state, the cleaning of the cap 803 is performed once. When the malfunction of the cap 803 is eliminated by cleaning the cap 803, the cap 803 can be used continuously. Therefore, replacement frequency of the cap 803 can be reduced.

(7) The control portion 830 estimates the cause of the abnormality of the ejecting state based on the abnormality of the ejecting state detected by the detection portion 156 in timing when the cap 803 is switched from the capping state to the non-capping state. Accordingly, it can be appropriately estimated whether or not the abnormality of the ejecting state occurs in the capping state.

(8) The detection portion 156 detects the vibration waveform of the pressure chamber 12 to detect the abnormality of the ejecting state of the liquid droplets from the nozzles 21. Accordingly, it is possible to appropriately detect the abnormality of the ejecting state of the nozzles 21 that eject the liquid droplets.

(9) When the abnormality of the ejecting state caused by the thickening of the liquids occurs in two or more of the nozzles 21 in the capping state, the control portion 830 may estimate that the malfunction of the cap 803 causes the abnormality of the ejecting state. Accordingly, the malfunction of the cap 803 can be appropriately estimated. Modification Example of Cap Device The cap device 800 of the liquid droplet ejecting apparatus 700 can be changed to a cap device 361 illustrated in FIG. 23.

Figure 23:
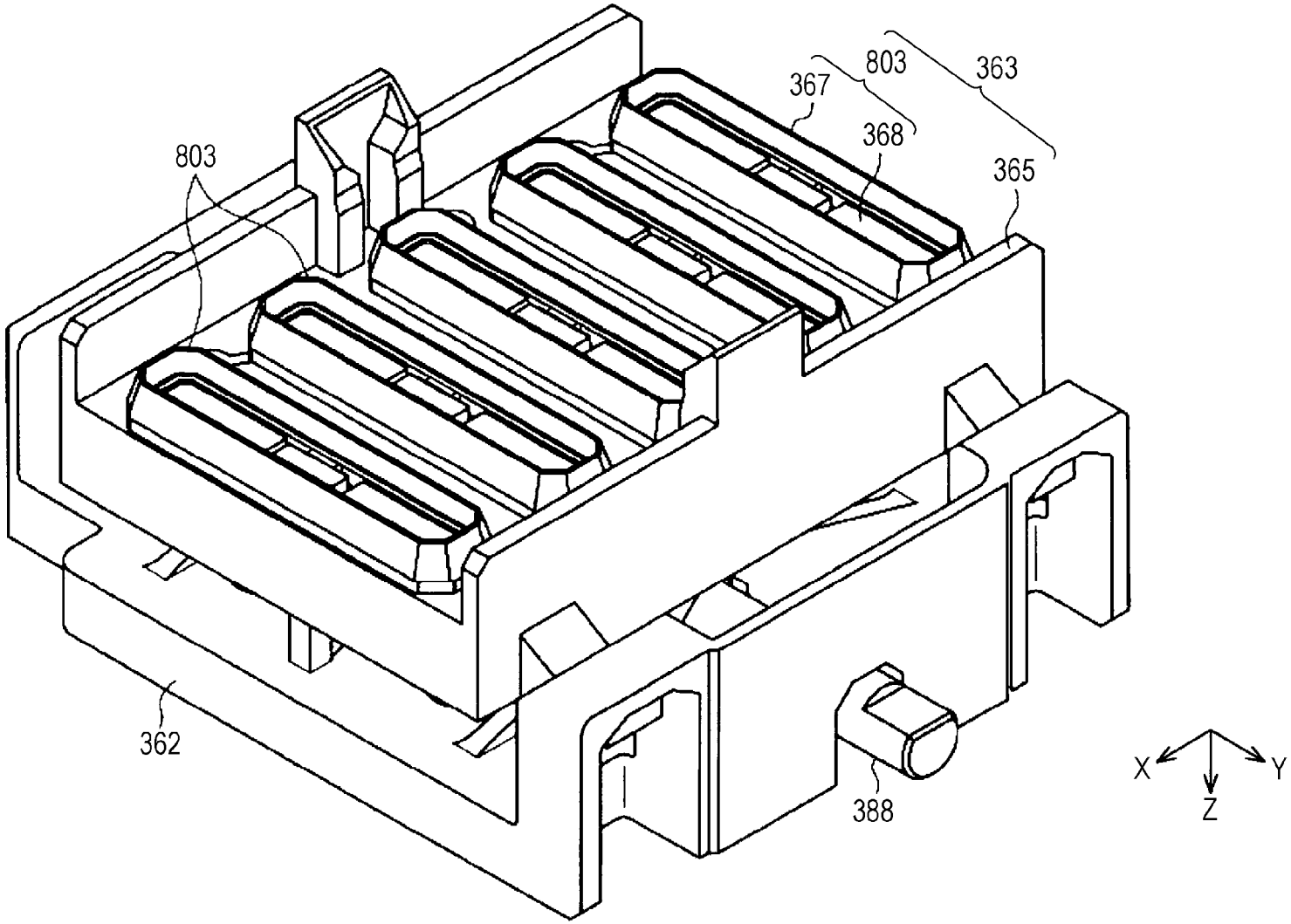
FIG. 23 is a perspective view illustrating a modification example of the cap device.

As illustrated in FIG. 23, the cap device 361 includes a cap holder 362 and a cap body 363 held by the cap holder 362. The cap body 363 includes a moisturizing cap 803 and a support portion 365 that supports at least one cap 803.

The cap holder 362 holds a plurality of caps 803. The cap 803 includes an annular frame portion 367 formed of an elastic member such as elastomer and a rigid member 368 fitted to the frame portion 367.

The rigid member 368 may be formed of a hard synthetic resin having high gas barrier properties such as polypropylene. As a material of the rigid member 368, any material can be adopted as long as it is a hard material having high gas barrier properties, and for example, polyethylene, polyethylene terephthalate, modified polyphenylene ether or the like may be adopted.

Figure 24:
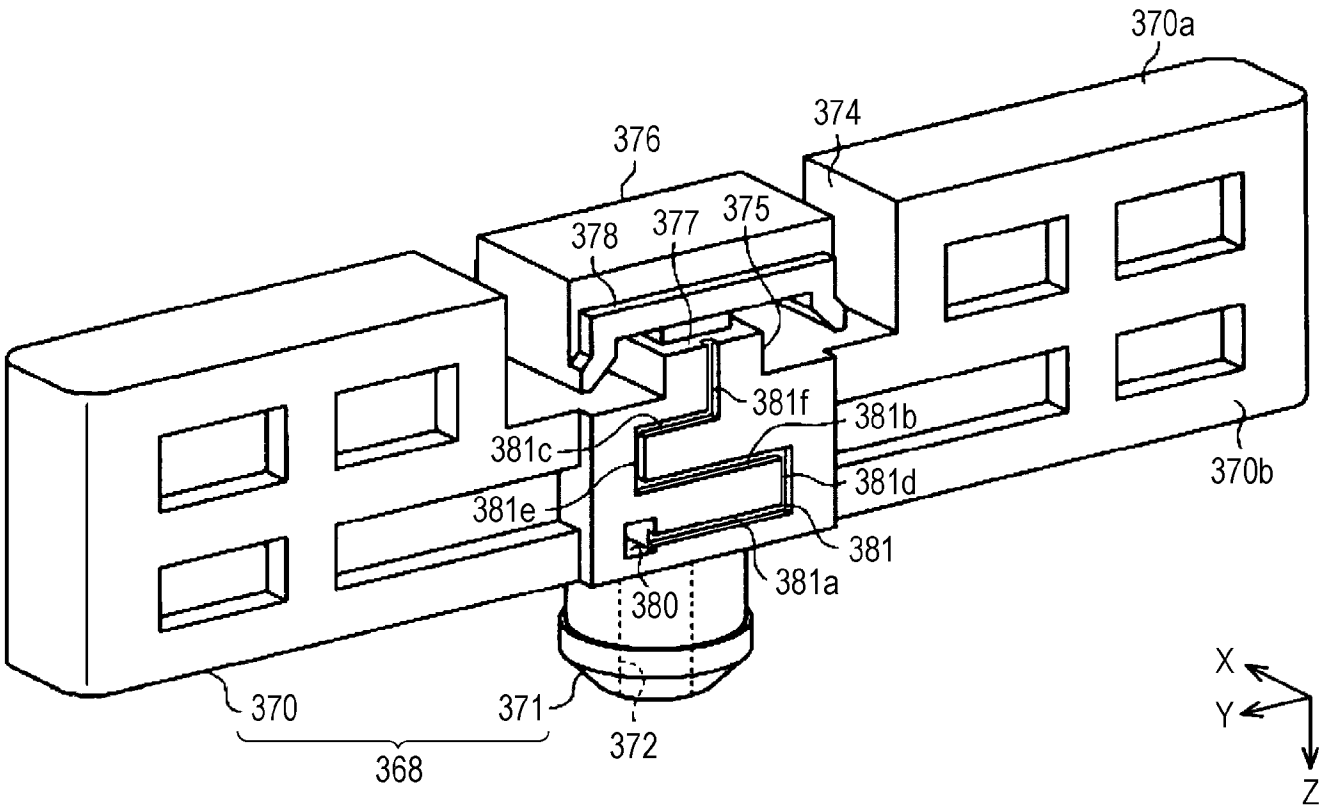
FIG. 24 is a perspective view of a rigidity member of the cap device in FIG. 23.

As illustrated in FIG. 24, the rigid member 368 includes a main body portion 370 having a rectangular parallelepiped outer shape, and a circular tubular protruding portion 371 protruding from the main body portion 370. The main body portion 370 has a first side surface 370*b* and a second side surface 370*c* which are side surfaces extending in the Y-axis direction and the Z-axis direction which are the longitudinal direction. The protruding portion 371 has a hollow portion 372 therein.

A surface of the main body portion 370 on which the protruding portion 371 is formed is defined as a lower surface, and a surface opposite to the lower surface is defined as an upper surface 370*a*. The upper surface 370*a* becomes an inner bottom surface of the cap 803 when the rigid member 368 is fitted to the frame portion 367.

A concave portion 374 is formed at the center position in the longitudinal direction on the upper surface 370*a* of the main body portion 370. On the inner bottom surface of the concave portion 374, a ridge 375 extending in the lateral direction and a cap portion 376 having a substantially rectangular plate shape in a plan view are integrally formed with the main body portion 370. An annular concave portion 377 is formed at the boundary between the ridge 375 and the cap portion 376.

On both side surfaces of the cap portion 376, stepped portions 378 are respectively formed. Both ends of each stepped portion 378 in the longitudinal direction is inclined so as to be bent at right angles downward and then diagonally downward.

A through-hole 380 is formed in the main body portion 370, the through-hole 380 penetrating therethrough in a lateral direction from the first side surface 370*b*. A first groove portion 381 is formed on the first side surface 370*b*, the first groove portion 381 formed by joining the through-hole 380 and the annular concave portion 377 in a meandering manner.

The first groove portion 381 is configured of a first longitudinal groove portion 381*a*, a second longitudinal groove portion 381*b* and a third longitudinal groove portion 381*c* which are extending in the Y-axis direction, and a first vertical groove portion 381*d*, a second vertical groove portion 381*e* and a third vertical groove portion 381*f* which are extending in the Z-axis direction. The first longitudinal groove portion 381*a*, the second longitudinal groove portion 381*b*, and the third longitudinal groove portion 381*c* are formed at different positions in the Z-axis direction. The first vertical groove portion 381*d*, the second vertical groove portion 381*e*, and the third vertical groove portion 381*f* are formed at different positions in the Y-axis direction and the Z-axis direction.

The first longitudinal groove portion 381*a* connects the through-hole 380 and a lower end of the first vertical groove portion 381*d*. The second longitudinal groove portion 381*b* connects an upper end of the first vertical groove portion 381*d* and a lower end of the second vertical groove portion 381*e*. The third longitudinal groove portion 381*c* connects an upper end of the second vertical groove portion 381*e* and a lower end of the third vertical groove portion 381*f*. An upper end of the third vertical groove portion 381*f* is opposed to a lower surface of the cap portion 376.

Figure 25:
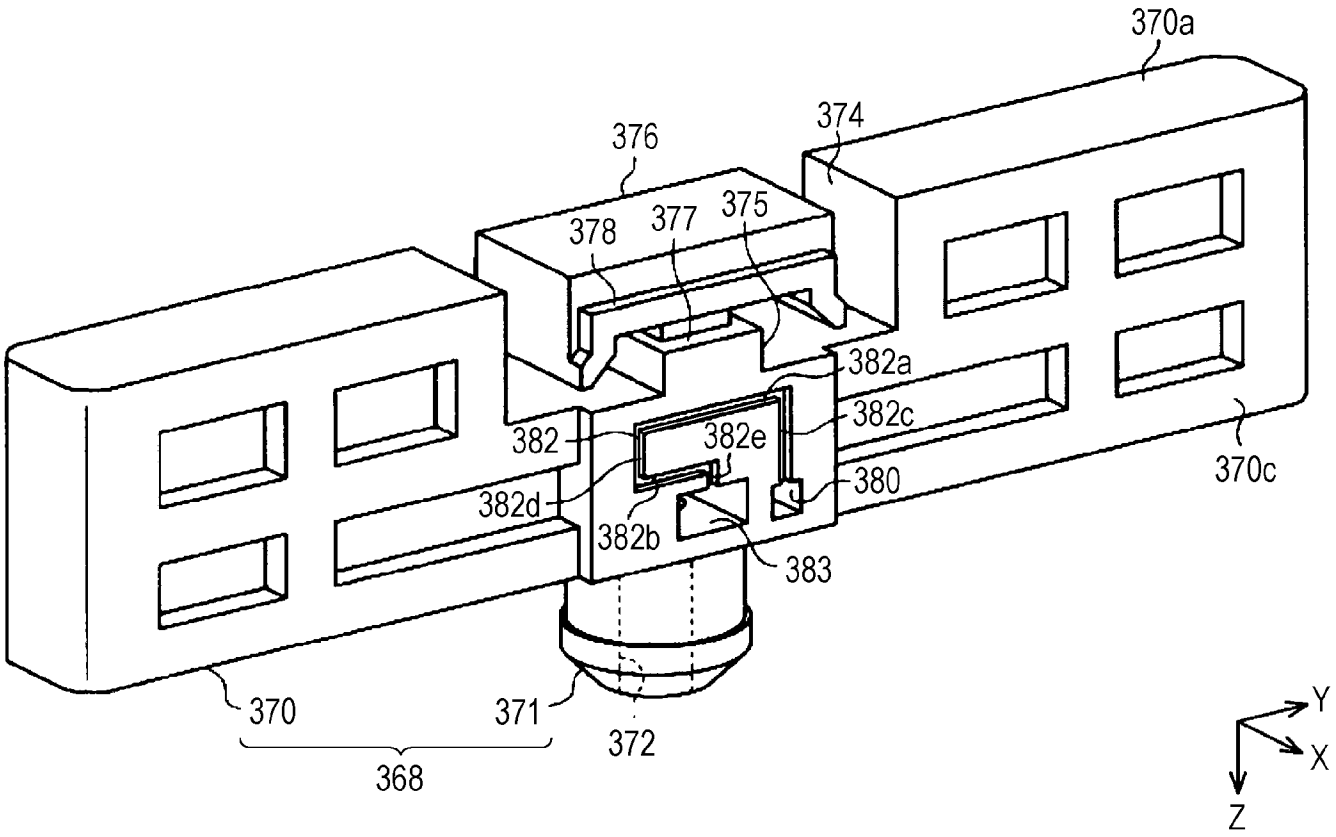
FIG. 25 is a perspective view of the rigidity member in FIG. 24 viewed from an opposite side.

As illustrated in FIG. 25, a second groove portion 382 of which one end is coupled to the through-hole 380, and a connection hole 383 that connects the other end of the second groove portion 382 and the hollow portion 372 are formed on the second side surface 370*c*. The second groove portion 382 meanders so as to connect the through-hole 380 and the connection hole 383.

The second groove portion 382 is configured of a fourth longitudinal groove portion 382*a* and a fifth longitudinal groove portion 382*b* which are extending in the Y-axis direction, and a fourth vertical groove portion 382*c*, a fifth vertical groove portion 382*d* and a sixth vertical groove portion 382*e* which are extending in the Z-axis direction. The fourth longitudinal groove portion 382*a* and the fifth longitudinal groove portion 382*b* are formed at different positions in the Z-axis direction. The fourth vertical groove portion 382*c*, the fifth vertical groove portion 382*d*, and the sixth vertical groove portion 382*e* are formed at different positions in the Y-axis direction.

A lower end of the fourth vertical groove portion 382*c* is coupled to the through-hole 380. The fourth longitudinal groove portion 382*a* connects an upper end of the fourth vertical groove portion 382*c* and an upper end of the fifth vertical groove portion 382*d*. The fifth longitudinal groove portion 382*b* connects a lower end of the fifth vertical groove portion 382*d* and an upper end of the sixth vertical groove portion 382*e*. A lower end of the sixth vertical groove portion 382*e* is coupled to the connection hole 383.

Figure 26:
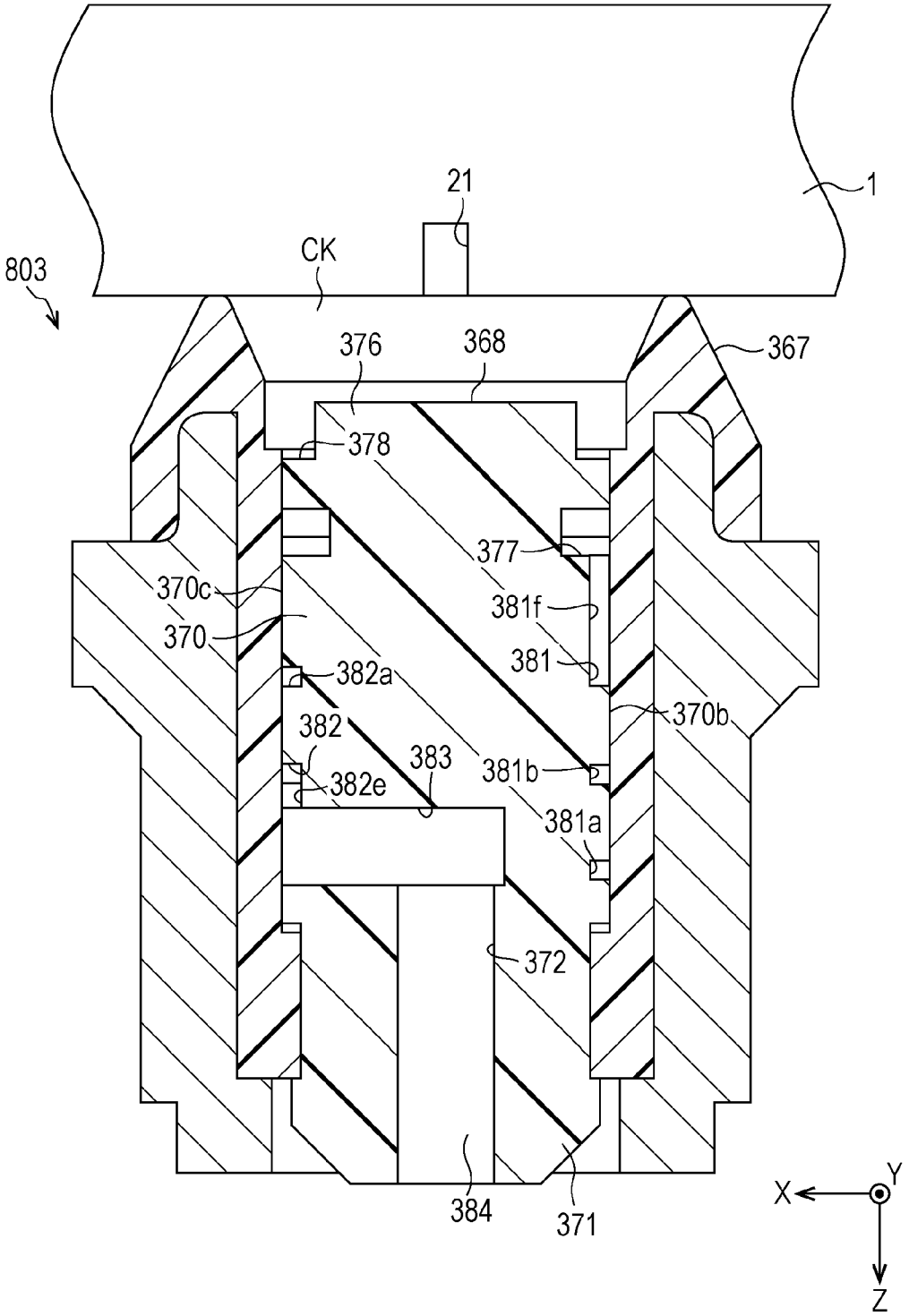
FIG. 26 is a cross-sectional view of the cap device in FIG. 23.

As illustrated in FIG. 26, when the rigid member 368 is mounted to the frame portion 367, the first side surface 370*b* and the second side surface 370*c* of the rigid member 368 are in close contact with the inner surface of the frame portion 367. Accordingly, the openings of the first groove portion 381, the second groove portion 382, the through-hole 380, and the connection hole 383 are covered with the inner surface of the frame portion 367, and each of the openings serves as a ventilation path. By mounting the rigid member 368 to the frame portion 367, a gap between the main body portion 370 and the cap portion 376 is the ventilation path. The ventilation path and the hollow portion 372 constitute an atmosphere communicating portion 384 which communicates the space CK in which the nozzle 21 is open with the atmosphere.

When the cap 803 contacts the liquid droplet ejecting portion 1, the space CK in which the nozzle 21 is open is formed. The cap body 363 is a consumable item of which function of sealing the space CK is deteriorated in a state where the space CK in which the nozzle 21 is open communicates with the atmosphere when the liquid sticks to the atmosphere communicating portion 384 and is dried.

Figure 27:
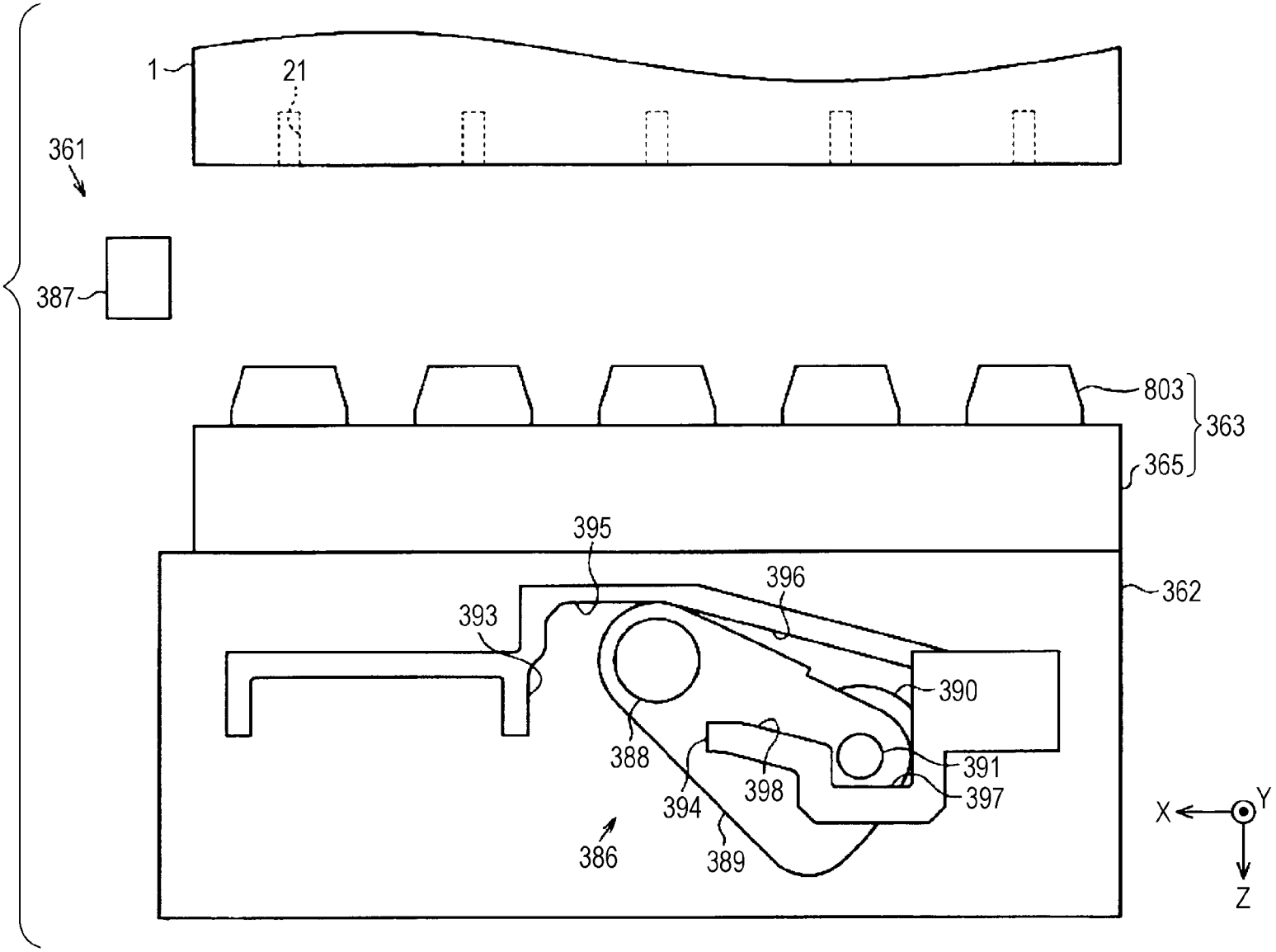
FIG. 27 is a front view of a cam mechanism of the cap device in FIG. 23.

As illustrated in FIG. 27, the cap device 361 includes a cam mechanism 386 that raises and lowers the cap holder 362. The cap body 363 and the cap holder 362 move up and down integrally by the operation of the cam mechanism 386. The cap device 361 includes a restricting portion 387 that contacts the raised cap holder 362 and restricts movement.

The cam mechanism 386 includes a rotating shaft 388 which is rotated by rotation driving of a motor (not shown), and a substantially triangular cam frame 389 of which a base end portion is fixed to the rotating shaft 388. A shaft portion 391 of a cam roller 390 is rotatably supported at a distal end portion of the cam frame 389. The shaft portion 391 of the cam roller 390 passes through the cam frame 389 and protrudes from both side surfaces of the cam frame 389. When the cam frame 389 rotates around the rotating shaft 388 as the rotating shaft 388 rotates, the cam roller 390 supported at the distal end portion of the cam frame 389 circulates around the rotating shaft 388.

A cam groove 393 is formed at a position corresponding to the cam mechanism 386 in the cap holder 362. The cam groove 393 has an opening 394 which is open downward, and the cam mechanism 386 is inserted from the opening 394, whereby supporting the cap holder 362 by the cam mechanism 386.

The cam groove 393 includes a flat portion 395 positioned above the opening 394 and a first inclined surface portion 396 extending obliquely downward from the flat portion 395. The cam groove 393 includes a concave surface portion 397 and a second inclined surface portion 398 extending obliquely downward from the concave surface portion 397 at positions that can come into contact with both ends of the shaft portion 391. The first inclined surface portion 396 and the second inclined surface portion 398 are substantially parallel.

Next, a process of detecting malfunction of the cap body 363 will be described. A malfunction detection process of the cap body 363 is executed periodically or based on an instruction from the user.

First, control portion 830 detects the vibration waveform of the pressure chamber 12 before performing capping by the cap 803 by using the detection portion 156 after performing the suction cleaning. Next, the control portion 830 moves the cap 803 upward so as to contact the liquid droplet ejecting portion 1.

Subsequently, the control portion 830 moves the cap 803 downward to release the capping. Thereafter, the control portion 830 uses the detection portion 156 to detect the vibration waveform of the pressure chamber 12 after capping. Subsequently, the control portion 830 compares the vibration waveforms before and after capping, and estimates whether or not air bubbles are mixed in the nozzle 21 and the pressure chamber 12. When the number of air bubbles in the nozzle 21 and the pressure chamber 12 are not increased, the control portion 830 ends the malfunction detection process of the cap 803.

When the number of the pressure chambers 12 in which air bubbles are mixed in the inspection after capping is increased as compared with the number of the pressure chambers 12 in which air bubbles are mixed in the inspection before capping, the control portion 830 estimates that the atmosphere communicating portion 384 is malfunctioning, notifies the user that replacement of the cap 803 is necessary, and ends the malfunction detection process of the cap 803. For example, notification to the user can be performed by displaying information to the notification portion 703.

Next, a method of estimating whether replacement of the liquid droplet ejecting portion 1 is necessary will be described with reference to the flowchart of FIG. 28. The control portion 830 of the liquid droplet ejecting apparatus 700 according to the present embodiment estimates whether the replacement of the liquid droplet ejecting portion 1 is necessary after confirming that the maintenance unit 710 is functioning normally.

Figure 28:
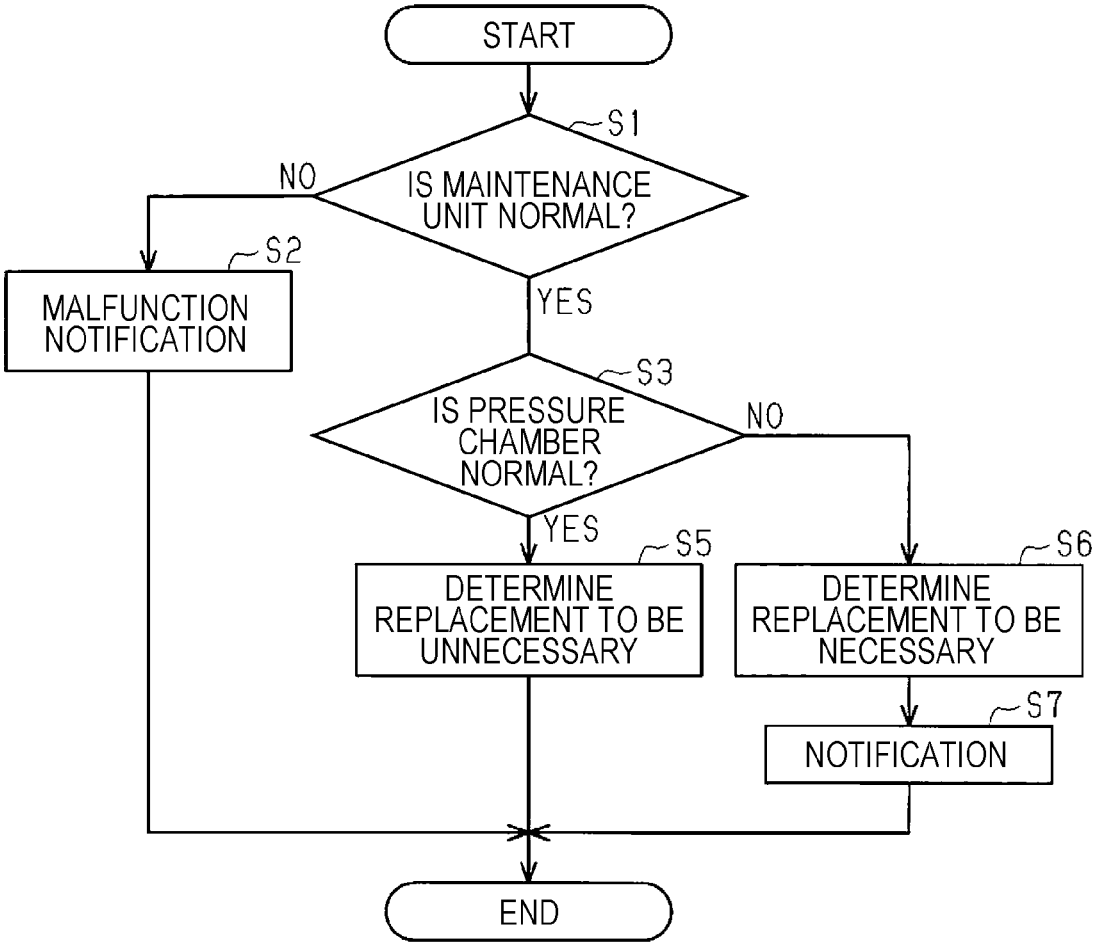
FIG. 28 is a flowchart illustrating a method of estimating whether a replacement of a liquid droplet ejecting portion is necessary.

As illustrated in FIG. 28, in step S1, the control portion 830 estimates whether or not air bubbles in the pressure chamber 12 is increased due to the maintenance. The process in step S1 is referred to as a maintenance unit normality determination step. At this time, the control portion 830 estimates whether or not air bubbles are increased by comparing the vibration waveform of the pressure chamber 12 detected by the detection portion 156 before the maintenance with the vibration waveform of the pressure chamber 12 detected at least one of during the maintenance or after the maintenance. In step S1, the control portion 830 can adopt the already described malfunction detection process of the cap 803.

When the control portion 830 estimates that air bubbles are increased in step S1, the process proceeds to step S2. In step S2, the control portion 830 estimates that the maintenance unit 710 is malfunctioning and notifies the user to the estimation result. The process in step S2 is referred to as a malfunction notifying step. After step S2, the control portion 830 ends the control.

When the control portion 830 estimates that air bubbles are not increased in step S1, the process proceeds to step S3. In step S3, the control portion 830 estimates whether or not the detection portion 156 detects that the state in the pressure chamber 12 is not normal a predetermined number of times. The process in step S3 is referred to as a pressure chamber abnormality determination step.

When the control portion 830 estimates that the state in the pressure chamber 12 is normal in step S3, the process proceeds to step S5. When the control portion 830 estimates that it is detected that the state in the pressure chamber 12 is not normal less than the predetermined number of times in step S3, the process also proceeds to step S5. In step S5, the control portion 830 estimates that the replacement of the liquid droplet ejecting portion 1 is unnecessary. The process in step S5 is referred to as a replacement unnecessity determination step. When the process in step S5 is completed, the control is ended.

When the control portion 830 estimates that it is detected that the state in the pressure chamber 12 is not normal the predetermined number of times in step S3, the process proceeds to step S6. In step S6, the control portion 830 estimates that the replacement of the liquid droplet ejecting portion 1 is necessary. The process in step S6 is referred to as a replacement necessity determination step. After step S6, the control portion 830 notifies the user that the replacement of the liquid droplet ejecting portion 1 is necessary by causing the notification portion 703 to perform a display in step S7. The process in step S7 is referred to as a replacement information display step. After step S7, the control portion 830 ends the control.

Figure 29:
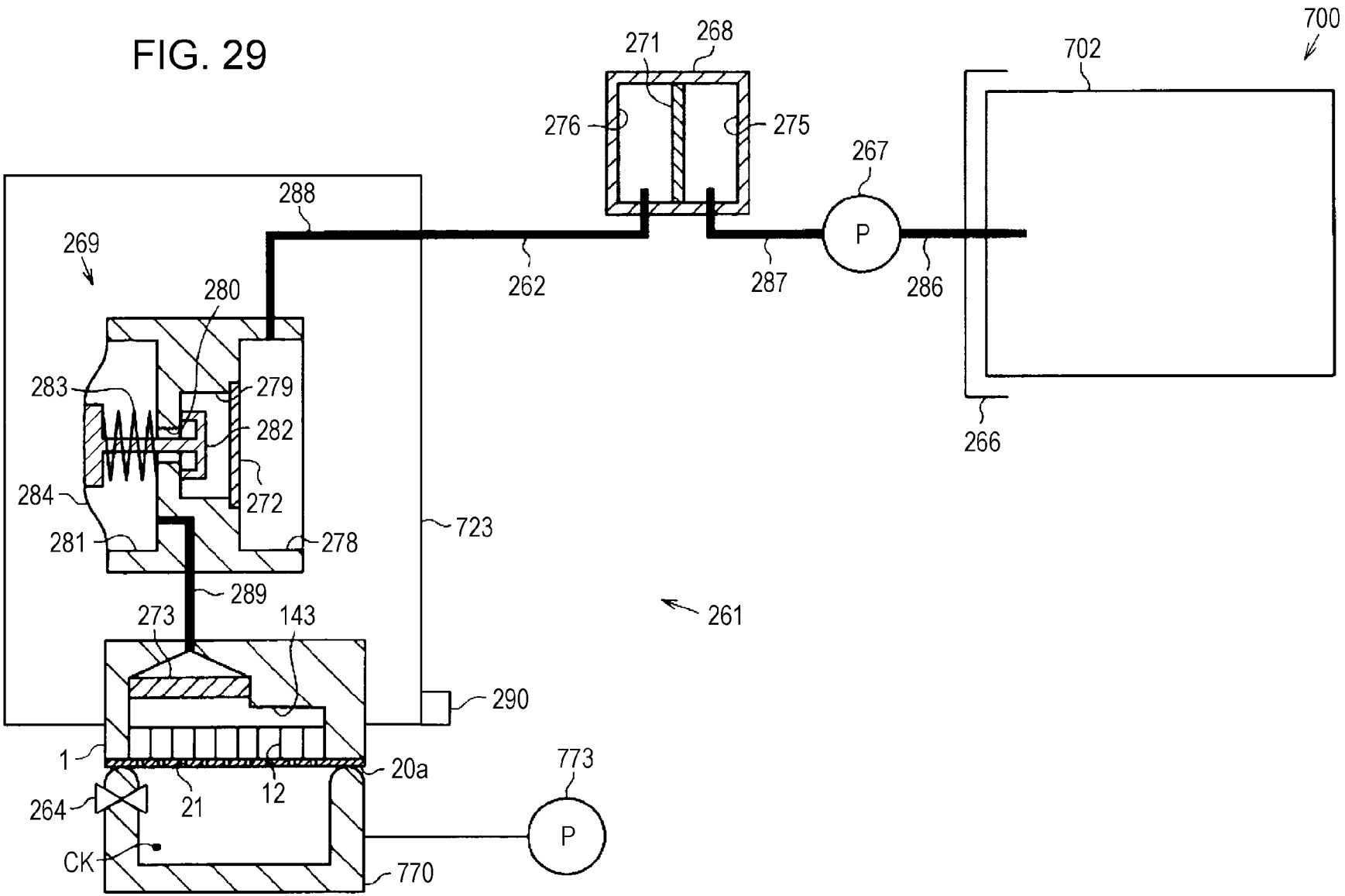
FIG. 29 is an overall configuration diagram schematically illustrating a modification example of the liquid droplet ejecting apparatus.

As illustrated in FIG. 29, a RGB camera 290 may be attached to the carriage 723. The RGB camera 290 reads a color image formed by ejecting the liquid droplet on the medium ST by RGB color separation, thereby detecting whether or not the liquid droplet is actually ejected from the nozzle 21. In this case, when an image quality of the color image detected by the RGB camera 290 exceeds a predetermined allowable level, the control portion 830 estimates that the ejecting state of the liquid droplet is not normal. A case where the image quality of the color image detected by the RGB camera 290 exceeds a predetermined allowable level, for example, is a case where the landing position of the ink is not within a predetermined area.

The detection and estimation of the ejecting state of the liquid droplet by the RGB camera 290 can be performed in step S4 after step S3, for example. When the ejecting state of the liquid droplet is not normal, the process proceeds to step S6 and it may be estimated that the replacement is necessary. When the ejecting state of the liquid droplet is normal, the process proceeds to step S5 and it may be estimated that the replacement is unnecessary.

Modification Example of Liquid Droplet Ejecting Apparatus

FIG. 29 illustrates a modification example of the liquid droplet ejecting apparatus 700.

As illustrated in FIG. 29, the liquid droplet ejecting apparatus 700 of a modified example includes the liquid droplet ejecting portion 1 and at least one supply mechanism 261. The supply mechanism 261 is configured to be able to supply the liquid accommodated in the liquid supply source 702 to the liquid droplet ejecting portion 1. The liquid supply source 702 is not mounted on the carriage 723, and is disposed at a position away from the carriage 723. The RGB camera 290 for detecting the ejecting state of the liquid droplet may be attached to the carriage 723.

The liquid supply source 702 is an accommodating container capable of accommodating the liquid, and is detachably mounted to a mounting portion 266. The liquid supply source 702 may be an accommodating tank fixed to the mounting portion 266. In this case, the accommodating tank may include a filling port capable of replenishing the liquid. The mounting portion 266 can hold a plurality of liquid supply sources 702.

The liquid droplet ejecting apparatus 700 includes the suction cap 770 and the suction pump 773. The suction cap 770 forms a space CK which is in contact with the liquid droplet ejecting portion 1 and in which the nozzle 21 is open. The suction cap 770 is provided with an atmospheric air open valve 264. The atmospheric air open valve 264 makes the space CK communicate with the atmosphere at the time of valve opening and does not make the space CK to communicate with the atmosphere at the time of valve closing. When the suction pump 773 is driven in a state where the atmospheric air open valve 264 is closed in capping by the suction cap 770, the inside of the nozzle 21 is sucked by the negative pressure generated in the space CK. As described above, at the time of the suction cleaning, the atmospheric air open valve 264 is closed. When the suction cap 770 moves away from the liquid droplet ejecting portion 1, the atmospheric air open valve 264 is opened.

The supply mechanism 261 is provided with a liquid supply path 262 for supplying the liquid to the nozzle 21 that is downstream from the liquid supply source 702 that is upstream. A supply pump 267 for causing the liquid to flow from the liquid supply source 702 toward the nozzle 21, a filter unit 268, and a pressure regulating valve 269 for regulating the pressure of the liquid are arranged in the liquid supply path 262. The supply pump 267 is, for example, a gear pump or a diaphragm pump.

The filter unit 268 includes a first filter 271, and is partitioned into an upstream chamber 275 and a downstream chamber 276 by the first filter 271. The filter unit 268 is detachably provided to the liquid supply path 262.

The pressure regulating valve 269 includes a second filter 272. The liquid droplet ejecting portion 1 includes a third filter 273. The second filter 272 and the third filter 273 are detachably provided to the liquid supply path 262. The first filter 271, the second filter 272, and the third filter 273 are consumable items of which filtration function is deteriorated as foreign matters in the passing liquid are collected in the filter.

The pressure regulating valve 269 includes a filter chamber 278 and a supply chamber 279 which are partitioned by the second filter 272. The pressure regulating valve 269 includes a pressure regulating chamber 281 communicating with the supply chamber 279 via a communication hole 280, a valve body 282 capable of opening and closing between the pressure regulating chamber 281 and a supply chamber 279, and a pressing member 283 pressing the valve body 282. The valve body 282 blocks the communication hole 280 by a pressing force of the pressing member 283.

The pressure regulating chamber 281 is configured of a diaphragm 284 in which a part of the wall surface can be flexibly deformed. The diaphragm 284 receives the atmospheric pressure on the outer surface side and receives the pressure of the liquid in the pressure regulating chamber 281 and the pressing force of the pressing member 283 on the inner surface side. The diaphragm 284 is flexibly displaced according to the change in the differential pressure between the pressure inside the pressure regulating chamber 281 and the pressure received on the outer surface side, and as the diaphragm 284 is displaced toward the inside of the pressure regulating chamber 281, the valve body 282 opens the communication hole 280.

The liquid supply path 262 includes a first connection flow path 286, a second connection flow path 287, a third connection flow path 288, and a fourth connection flow path 289. The first connection flow path 286 connects the liquid supply source 702 and the supply pump 267. The second connection flow path 287 connects the supply pump 267 and the upstream chamber 275 of the filter unit 268. The third connection flow path 288 connects the downstream chamber 276 of the filter unit 268 and the filter chamber 278 of the pressure regulating valve 269. The fourth connection flow path 289 connects the pressure regulating chamber 281 of the pressure regulating valve 269 and a reservoir 143 which is a common liquid chamber of the liquid droplet ejecting portion 1.

The control portion 830 counts the number of times the liquid droplet is ejected from the nozzle 21 and the number of times the liquid droplet ejecting portion 1 is subjected to maintenance. The control portion 830 calculates the amount of the liquid consumed by the liquid droplet ejecting portion 1 based on the number of times of maintenance and stores the calculated amount in the memory 153 as a liquid passage amount in the liquid supply path 262. The memory 153 stores the passage amount which is the amount of the liquid that passes through the first filter 271, the second filter 272, and the third filter 273.

Next, the operation when clogging of the first filter 271, the second filter 272, and the third filter 273 is detected will be described. In the liquid droplet ejecting apparatus 700, when the suction cleaning is performed, foreign matters such as the liquid and air bubbles are discharged from the nozzle 21 covered with the suction cap 770. Therefore, when the detection portion 156 performs the nozzle inspection after the suction cleaning, it is possible to reduce the possibility that the nozzle 21 and the pressure chamber 12 in which air bubbles are mixed are detected.

When flushing is performed after the nozzle inspection, the liquid is supplied from the liquid supply source 702 toward the nozzle 21 through the liquid supply path 262. The first filter 271, the second filter 272, and the third filter 273 are provided to the liquid supply path 262. Therefore, the liquid passes through the first filter 271, the second filter 272, and the third filter 273 and is supplied to the nozzle 21. At this time, when the first filter 271, the second filter 272, and the third filter 273 are clogged, it becomes difficult for the liquid to flow. In this case, the amount of liquid, which can be supplied to the nozzle 21 through the first filter 271, the second filter 272, and the third filter 273 per unit time, may be smaller than the amount of liquid that can be ejected by the nozzle 21 per unit time.

In other words, when the first filter 271, the second filter 272, and the third filter 273 are clogged, a sufficient amount of the liquid may not be supplied even if the liquid droplet is ejected from the nozzle 21. Therefore, a negative pressure in the liquid supply path 262 between the nozzle 21, and the first filter 271, the second filter 272 and the third filter 273 is increased, and air, that is, air bubbles are easily drawn from the nozzle 21.

The detection portion 156 can detect the nozzle 21 and the pressure chamber 12 in which air bubbles are drawn by performing the nozzle inspection. That is, the control portion 830 detects the vibration waveform of the pressure chamber 12 before and after flushing, and estimates whether or not the first filter 271, the second filter 272 and the third filter 273 are clogged based on the change in the state of the pressure chamber 12 due to flushing.

The control portion 830 estimates that the first filter 271, the second filter 272 and the third filter 273 are clogged when the change in the state in the pressure chamber 12 detected before and after flushing is an increase in air bubbles in the pressure chamber 12. Specifically, when there are a larger number of the pressure chambers 12 after flushing than before flushing, the pressure chambers 12 in which air bubbles detected by nozzle inspection are mixed, it is estimated that air bubbles are mixed due to the flushing. In this case, it is considered that the supply mechanism 261 is in a state in which the first filter 271, the second filter 272 and the third filter 273 are clogged and a sufficient amount of the liquid cannot be supplied. Therefore, when the control portion 830 estimates that the first filter 271, the second filter 272, and the third filter 273 are clogged and malfunctions, the control portion 830 urges the user to replace the first filter 271, the second filter 272 and the third filter 273.

When the control portion 830 estimates that the functions of the first filter 271, the second filter 272 and the third filter 273 are normal, the control portion 830 can estimate whether or not the detection portion 156 detects that the state in the pressure chamber 12 is not normal a predetermined number of times. Then, when the control portion 830 estimates that it is detected that the state in the pressure chamber 12 is normal or the state in the pressure chamber 12 is not normal less than the predetermined number of times, and when the control portion 830 estimates that it is detected that the ejecting state of the liquid droplet is normal or the ejecting state of the liquid droplet is not normal less than the predetermined number of times, the control portion 830 can estimate that the replacement of the liquid droplet ejecting portion 1 is not necessary. On the other hand, when the control portion 830 estimates that it is detected that the state in the pressure chamber 12 is not normal the predetermined number of times or when the control portion 830 estimates that it is detected that the ejecting state of the liquid droplet is not normal the predetermined number of times, the control portion 830 estimates that the replacement of the liquid droplet ejecting portion 1 is necessary, and notifies the user that the replacement of the liquid droplet ejecting portion 1 is necessary.

In this manner, when the change in the state in the pressure chamber 12, which is detected before and after the maintenance is caused by the increase in air bubbles in the pressure chamber 12, the control portion 830 can estimate that the first filter 271, the second filter 272 and the third filter 273 are clogged. That is, the control portion 830 can estimate the malfunction of collecting the foreign matters of the first filter 271, the second filter 272 and the third filter 273 based on the change in the state in the pressure chamber 12 before and after ejecting the liquid droplet from the nozzle 21.

As illustrated in FIG. 28, after confirming that both the third filter 273 and the maintenance unit 710 are functioning normally, the control portion 830 can estimate whether or not the replacement of the liquid droplet ejecting portion 1 is necessary. In this case, the control portion 830 detects the vibration waveform of the pressure chamber 12 before and after flushing by using the detection portion 156, and can estimate whether the third filter 273 is clogged based on the change in the state of the pressure chamber 12 due to the flushing. When the control portion 830 estimates that the third filter 273 is clogged, the control portion 830 can notify the user that the third filter 273 is clogged.

The control portion 830 may detect the state in the pressure chamber 12 before the suction cleaning and during the suction cleaning.

When the negative pressure is applied to the space CK in which the nozzle 21 is open, the inside of the nozzle 21 and the inside of the pressure chamber 12 which are communicating with the space CK also have the negative pressure. Therefore, the vibrating plate 50 is displaced in a direction in which the volume of the pressure chamber 12 is decreased. Therefore, when the actuator 130 is driven in a state where the vibrating plate 50 is deformed and the vibration waveform of the pressure chamber 12, which is vibrated by the drive of the actuator 130, is detected, the vibration waveform is different from the vibration waveform detected in a state where the vibrating plate 50 is not deformed.

The control portion 830 first detects the vibration waveform of the pressure chamber 12 in a state where the negative pressure before the suction cleaning is not applied. Subsequently, the control portion 830 detects the vibration waveform of the pressure chamber 12 in a state where the negative pressure is applied during the suction cleaning. The control portion 830 estimates that the function of the maintenance unit 710 is normal when the state in the pressure chamber 12 before the suction cleaning and during the suction cleaning is changed.

In this manner, when the space CK formed by the suction cap 770 is set to a negative pressure, the negative pressure is also applied to the pressure chamber 12 via the nozzle 21. When the negative pressure is applied to the pressure chamber 12 and when the negative pressure is not applied to the pressure chamber 12, the vibration waveform of the pressure chamber 12 varies. Therefore, in the case in which the state in the pressure chamber 12 is changed between before the suction cleaning and during the suction cleaning, the negative pressure is applied to the pressure chamber 12, it can be estimated that the maintenance unit 710 is functioning normally.

Similarly, the control portion 830 may drive the suction pump 773 when the suction cap 770 is in the capping state to estimate whether or not the atmospheric air open valve 264 is functioning normally. In this case, in a state where the atmospheric air open valve 264 is opened and the negative pressure is not applied and in a state where the atmospheric air open valve 264 is closed and the negative pressure is applied, the states in the pressure chamber 12 may be compared.

In this manner, when the vibration waveform of the pressure chamber 12 is detected during the suction cleaning, a valve may be provided at the upstream of the pressure chamber 12, and the suction cleaning may be performed in a state where the valve is closed. That is, by providing the valve, consumption of the liquid can be reduced, and the vibrating plate 50 can be easily deformed.

Other Modification Examples

The present embodiment can be modified and implemented as follows. The present embodiment and the following further examples can be implemented in combination with one another as long as there is no technical contradiction.

The control portion 830 may estimate a cause of the abnormality of the ejecting state based on the vibration waveform obtained by the maintenance operation of the liquid droplet ejecting portion 1 such as flushing which is performed in timing when the cap 803 is switched from the capping state to the non-capping state. In this case, the estimation process and the maintenance operation of the liquid droplet ejecting portion 1 can be performed in combination.

The abnormality of the ejecting state may be detected by detecting the liquid droplet ejected from the nozzle 21 by using an optical sensor. The abnormality of the ejecting state may be detected by checking a printed check pattern by using an imaging device such as a camera. The user may check the printed check pattern and input information on an omission nozzle that cannot eject the liquid droplet normally to the liquid droplet ejecting apparatus 700 to detect the abnormality of the ejecting state. When liquid droplet is ejected from the nozzle 21 by using a heat energy of a heat generating element (heater), a temperature detection element (temperature sensor) may detect a temperature change due to the driving of the heating element to detect the abnormality of the ejecting state. A cause of the abnormality of the ejecting state may be estimated from the detection result of the temperature change due to the drive of the heat generating element and the detection result of the liquid droplet ejected from the nozzle 21.

The liquid droplet ejecting apparatus 700 may include a cleaning device that cleans the cap 803 of the cap device 800. When the control portion 830 estimates that the contamination of the cap 803 by the liquid causes the abnormality of the ejecting state which occurs in the capping state, cleaning of the cap 803 may be performed by a cleaning device. When the control portion 830 estimates that the abnormality of the ejecting state occurs in the capping state after the cleaning of the cap 803 is performed by the cleaning device, the control portion 830 may estimate that the malfunction of the cap 803 causes the abnormality of the ejecting state.

When the liquid adheres to a portion, in which the cleaning is difficult, in the cap 803, for example, the inside of the groove 828 of the pin 827 constituting the atmosphere communicating portion 823, the malfunction of the cap 803, which is not recovered by the cleaning of the cap 803 occurs. Therefore, when the control portion 830 estimates that the abnormality of the ejecting state caused by the contamination of the cap 803 by the liquid continuously occurs in the capping state even if the cap 803 is cleaned, the control portion 830 may cause the notification portion 703 to perform a display to urge the user to replace the cap 803.

The nozzle inspection in the capping in FIG. 22 may be performed in the capping state by the suction cap 770. In this case, the liquid can be discharged into the suction cap 770 according to the result of the nozzle inspection.

The liquid droplet ejecting apparatus 700 may be replaced with a so-called full line liquid droplet ejecting apparatus 700 including the long liquid droplet ejecting portion 1 corresponding to the entire width of the medium ST without including the carriage 723.

In addition to the actuator 130 for ejecting liquid droplet from the nozzle 21, a sensor for detecting the vibration waveform of the pressure chamber 12 may be provided as the detection portion 156. The control portion 830 may estimate the state of the pressure chamber 12 based on the vibration waveform of the pressure chamber 12, which is detected by the sensor which is the detection portion 156. In this case, a piezoelectric element may be adopted as the sensor.

The liquid ejected by the liquid droplet ejecting portion 1 is not limited to an ink, and may be, for example, a liquid material in which particles of a functional material are dispersed or mixed in the liquid. For example, the liquid droplet ejecting portion 1 may eject the liquid material containing the material such as an electrode material or a coloring material used for manufacturing a liquid crystal display, an electroluminescence display, a surface light emitting display, or the like in a dispersed or dissolved state.

The medium ST is not limited to a paper, and it may be a plastic film or a thin plate material, or a cloth used for a textile printing apparatus or the like. The medium ST may be a clothing having any shape such as a T-shirt or a three-dimensional object having any shape such as dishes and stationery.

In the following, technical ideas and their effects and advantages which are grasped from the above-described embodiment and the modification example will be described.

A liquid droplet ejecting apparatus includes a liquid droplet ejecting portion that includes a plurality of nozzles ejecting liquids as liquid droplets, a cap configured to be in a capping state in which a space in which the plurality of nozzles are open is formed and a non-capping state in which the cap is separated from the liquid droplet ejecting portion, a detection portion configured to detect an abnormality of an ejecting state of the liquid droplets from the nozzles, and a control portion that estimates that a malfunction of the cap causes the abnormality of the ejecting state when the abnormality of the ejecting state occurs in the capping state, in which the control portion causes a notification portion to perform a display corresponding to the malfunction of the cap when the control portion estimates that the malfunction of the cap causes the abnormality of the ejecting state.

When the abnormality of the ejecting state occurs in the capping state, the malfunction of the cap is suspected of causing the abnormality of the ejecting state. According to the configuration, based on the display corresponding to the malfunction of the cap, appropriate measures can be taken to eliminate the malfunction of the cap. Therefore, appropriate maintenance can be performed with respect to the thickening of the liquid.

In the liquid droplet ejecting apparatus, the control portion may estimate that contamination of the cap by the liquids causes the abnormality of the ejecting state when an elapsed time in the capping state is less than a set time in a case in which the abnormality of the ejecting state occurs in the capping state.

When the abnormality of the ejection state occurs in the capping state even if the elapsed time in the capping state is less than the set time, the contamination of the cap by the liquid is suspected of causing the malfunction of the cap. When the cap is contaminated by the liquid, the liquid may adsorb the solvent of the liquid in the nozzle. Therefore, the thickening of the liquid in the nozzle is promoted. According to the configuration, appropriate measures can be taken to eliminate the contamination of the cap by the liquid.

In the liquid droplet ejecting apparatus, the control portion may cause the notification portion to perform a display to urge a user to clean the cap when the control portion estimates that the contamination of the cap by the liquids causes the abnormality of the ejecting state.

According to the configuration, the contamination of the cap by the liquid can be eliminated.

Therefore, appropriate maintenance can be performed with respect to the thickening of the liquid. In the liquid droplet ejecting apparatus, the control portion may estimate that the malfunction of the cap, which is not recovered by cleaning of the cap, causes the abnormality of the ejecting state when the elapsed time in the capping state is equal to or more than the set time in the case in which the abnormality of the ejecting state occurs in the capping state.

It is suspected that the cap is not in the normal capping state when the elapsed time in the capping state is equal to or more than the set time in the case in which the abnormality of the ejection state occurs in the capping state. There is a possibility that the malfunction of the cap is not recovered by cleaning of the cap when the cap is not in the normal capping state. According to the configuration, appropriate measures can be taken to eliminate the malfunction of the cap which is not recovered by cleaning of the cap.

In the liquid droplet ejecting apparatus, the control portion may cause the notification portion to perform a display to urge the user to replace the cap when the control portion estimates that the malfunction of the cap, which is not recovered by the cleaning of the cap, causes the abnormality of the ejecting state.

According to the configuration, the malfunction of the cap which is not recovered by cleaning of the cap can be eliminated. Therefore, appropriate maintenance can be performed with respect to the thickening of the liquid.

In the liquid droplet ejecting apparatus, when the control portion estimates that the malfunction of the cap, which is not recovered by the cleaning of the cap, causes the abnormality of the ejecting state, the control portion may cause the notification portion to perform a display to urge the user to clean the cap, and when the abnormality of the ejecting state occurs in the capping state after the display, the control portion may estimate that the malfunction of the cap causes the abnormality of the ejecting state and cause the notification portion to perform a display to urge the user to replace the cap.

According to the configuration, even when the malfunction of the cap, which is not recovered by cleaning of the cap, causes the abnormality of the ejecting state, the cleaning of the cap is performed once. When the malfunction of the cap is eliminated by cleaning the cap, the cap can be used continuously. Therefore, replacement frequency of the cap can be reduced.

In the liquid droplet ejecting apparatus, the control portion may estimate the cause of the abnormality of the ejecting state based on the abnormality of the ejecting state detected by the detection portion in timing when the cap is switched from the capping state to the non-capping state.

According to the configuration, it can be appropriately estimated whether or not the abnormality of the ejecting state occurs in the capping state.

In the liquid droplet ejecting apparatus, the liquid droplet ejecting portion may include a pressure chamber to which the liquids are supplied from a liquid supply source, the nozzles that communicate with the pressure chamber, and an actuator that vibrates the pressure chamber, and the detection portion may detect the abnormality of the ejecting state of the liquid droplets from the nozzles by detecting a vibration waveform of the pressure chamber.

According to the configuration, it is possible to appropriately detect the abnormality of the ejecting state of the nozzle that ejects the liquid droplet.

In the liquid droplet ejecting apparatus, the control portion may estimate that the malfunction of the cap causes the abnormality of the ejecting state when the abnormality of the ejecting state caused by thickening of the liquids occurs in two or more of the nozzles in the capping state.

According to the configuration, the malfunction of the cap can be appropriately estimated.

A maintenance method for a liquid droplet ejecting apparatus which includes a liquid droplet ejecting portion including a plurality of nozzles ejecting liquids as liquid droplets, a cap configured to be in a capping state in which a space in which the plurality of nozzles are open is formed and a non-capping state in which the cap is separated from the liquid droplet ejecting portion, and a detection portion configured to detect an abnormality of an ejecting state of the liquid droplets from the nozzles, the method includes estimating that a malfunction of the cap causes the abnormality of the ejecting state when the abnormality of the ejecting state occurs in the capping state, and causing a notification portion to perform a display corresponding to the malfunction of the cap.

When the abnormality of the ejecting state occurs in the capping state, the malfunction of the cap is suspected of causing the abnormality of the ejecting state. According to the configuration, based on the display corresponding to the malfunction of the cap, appropriate measures can be taken to eliminate the malfunction of the cap. Therefore, appropriate maintenance can be performed with respect to the thickening of the liquid.

What is claimed is:

1. A liquid droplet ejecting apparatus comprising:

a liquid droplet ejecting portion that includes a plurality of nozzles ejecting liquids as liquid droplets;

a cap configured to be in a capping state in which a space in which the plurality of nozzles are open is formed and a non-capping state in which the cap is separated from the liquid droplet ejecting portion;

a detection portion configured to detect an abnormality of an ejecting state of the liquid droplets from the nozzles; and a control portion that estimates that a malfunction of the cap causes the abnormality of the ejecting state when the abnormality of the ejecting state occurs in the capping state, wherein the control portion causes a notification portion to perform a display corresponding to the malfunction of the cap when the control portion estimates that the malfunction of the cap causes the abnormality of the ejecting state, wherein the control portion estimates that contamination of the cap by the liquids causes the abnormality of the ejecting state when an elapsed time in the capping state is less than a set time in a case in which the abnormality of the ejecting state occurs in the capping state.

2. The liquid droplet ejecting apparatus according to claim 1, wherein the control portion causes the notification portion to perform a display to urge a user to clean the cap when the control portion estimates that the contamination of the cap by the liquids causes the abnormality of the ejecting state.

3. The liquid droplet ejecting apparatus according to claim 1, wherein the control portion estimates that the malfunction of the cap, which is not recovered by cleaning of the cap, causes the abnormality of the ejecting state when the elapsed time in the capping state is equal to or more than the set time in the case in which the abnormality of the ejecting state occurs in the capping state.

4. The liquid droplet ejecting apparatus according to claim 3, wherein the control portion causes the notification portion to perform a display to urge a user to replace the cap when the control portion estimates that the malfunction of the cap, which is not recovered by the cleaning of the cap, causes the abnormality of the ejecting state.

5. The liquid droplet ejecting apparatus according to claim 3, wherein the liquid droplet ejecting portion includes a pressure chamber to which the liquids are supplied from a liquid supply source, and the nozzles that communicate with the pressure chamber, and an actuator that vibrates the pressure chamber, the detection portion detects the abnormality of the ejecting state of the liquid droplets from the nozzles by detecting a vibration waveform of the pressure chamber, and when the control portion estimates that the malfunction of the cap, which is not recovered by the cleaning of the cap, causes the abnormality of the ejecting state, the control portion causes the notification portion to perform a display to urge a user to clean the cap, and when the abnormality of the ejecting state occurs in the capping state after the display, the control portion estimates that the malfunction of the cap causes the abnormality of the ejecting state and causes the notification portion to perform a display to urge the user to replace the cap.

6. The liquid droplet ejecting apparatus according to claim 1, wherein the control portion estimates the cause of the abnormality of the ejecting state based on the abnormality of the ejecting state detected by the detection portion in timing when the cap is switched from the capping state to the non-capping state.

7. The liquid droplet ejecting apparatus according to claim 1, wherein the liquid droplet ejecting portion includes a pressure chamber to which the liquids are supplied from a liquid supply source, the nozzles that communicate with the pressure chamber, and an actuator that vibrates the pressure chamber, and the detection portion detects the abnormality of the ejecting state of the liquid droplets from the nozzles by detecting a vibration waveform of the pressure chamber.

8. The liquid droplet ejecting apparatus according to claim 1, wherein the control portion estimates that the malfunction of the cap causes the abnormality of the ejecting state when the abnormality of the ejecting state caused by thickening of the liquids occurs in two or more of the nozzles in the capping state.

9. A maintenance method for a liquid droplet ejecting apparatus which includes a liquid droplet ejecting portion including a plurality of nozzles ejecting liquids as liquid droplets, a cap configured to be in a capping state in which a space in which the plurality of nozzles are open is formed and a non-capping state in which the cap is separated from the liquid droplet ejecting portion, and a detection portion configured to detect an abnormality of an ejecting state of the liquid droplets from the nozzles, the method comprising:

estimating that a malfunction of the cap causes the abnormality of the ejecting state when the abnormality of the ejecting state occurs in the capping state, wherein the estimating comprises estimating that contamination of the cap by the liquids causes the abnormality of the ejecting state when an elapsed time in the capping state is less than a set time in a case in which the abnormality of the ejecting state occurs in the capping state; and causing a notification portion to perform a display corresponding to the malfunction of the cap.

* * * * *